US006655860B2

(12) United States Patent
Nozawa et al.

(10) Patent No.: US 6,655,860 B2
(45) Date of Patent: Dec. 2, 2003

(54) PHOTOSENSITIVE MATERIAL PROCESSING APPARATUS

(75) Inventors: Ryoei Nozawa, Kanagawa (JP); Hideto Yamamoto, Kanagawa (JP); Shinichi Matsuda, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 40 days.

(21) Appl. No.: 09/876,174

(22) Filed: Jun. 7, 2001

(65) Prior Publication Data

US 2002/0016242 A1 Feb. 7, 2002

(30) Foreign Application Priority Data

| | | |
|---|---|---|
| Jun. 8, 2000 | (JP) | 2000-172322 |
| Aug. 23, 2000 | (JP) | 2000-252951 |
| Sep. 27, 2000 | (JP) | 2000-294603 |
| Sep. 27, 2000 | (JP) | 2000-294604 |
| Sep. 28, 2000 | (JP) | 2000-296230 |

(51) Int. Cl.[7] ..... G03D 3/08

(52) U.S. Cl. ..... 396/614; 396/617; 396/620; 492/30

(58) Field of Search ..... 396/612, 617, 396/620, 626, 614; 492/30, 35, 28

(56) References Cited

U.S. PATENT DOCUMENTS 4,383,751 A * 5/1983 Schornig et al. ..... 396/622
5,349,413 A * 9/1994 Ohishi et al. ..... 396/620

FOREIGN PATENT DOCUMENTS

JP 6-295071 * 10/1994

* cited by examiner

*Primary Examiner*—D Rutledge
(74) *Attorney, Agent, or Firm*—Sughrue Mion, PLLC

(57) ABSTRACT

A brush roller is structured such that a web body having wire members is wound in a helical manner around a roller main body to which an axial end member is mounted. A fastening member is mounted to a rotary shaft of the axial end member, and one end of the web body is fixed to a holding member which is arranged between the fastening member and the axial end member so as to freely rotate relatively. The holding member relatively rotates in a winding direction due to an urging force of a torsional coil spring when elongation occurs in the web body, thereby preventing slack from occurring in the web body.

13 Claims, 35 Drawing Sheets

PHOTOSENSITIVE MATERIAL PROCESSING APPARATUS

BACKGROUND OF THE INVENTION

1. Field of the Invention

The present invention relates to a brush roller for brushing a surface of a photosensitive material at a time of processing of the photosensitive material by a processing solution. More particularly, the present invention relates to a brush roller in which a web-like member provided with wire members is wound around a peripheral surface of a roller main body in a helical manner.

The present invention further relates to a photosensitive material processing apparatus for brushing a surface of a photosensitive material by a brush roller, in which a web-like member provided with wire members is wound around a roller main body in a helical manner, at a time of processing the photosensitive material by a processing solution.

The present invention also relates to a mounting structure of a pair of rollers provided in a photosensitive material processing apparatus for processing a photosensitive material such as a photosensitive surface printing plate or the like by a processing solution and transferring the photosensitive material while holding therebetween.

The present invention still further relates to a spray pipe, a pair of which is provided in a photosensitive material processing apparatus for processing a photosensitive material such as a surface printing plate or the like by a processing solution so as to be arranged in upper and lower portions with respect to a transferring path for the photosensitive material, and discharging the processing solution toward the photosensitive material.

The present invention yet further relates to a filter case provided in a photosensitive material processing apparatus for processing a photosensitive material or the like by a processing solution, to which a filter for removing a solid material in the processing solution is installed.

2. Description of the Related Art

<<Prior Art 1.>>

A photosensitive material includes a photosensitive surface printing plate (hereinafter, referred to as "PS printing plate") in which a photosensitive layer is formed on a surface of a supporting body employing aluminum or the like. Further, the PS printing plate includes a so-called photo polymer printing plate on which a photo polymerization layer is formed as the photosensitive layer.

In a development processing apparatus for processing a development of an image exposed PS printing plate (hereinafter, referred to as "PS printing plate processor"), an image is formed by dipping the PS printing plate into a developing solution so as to swell the photosensitive layer (photo polymerization layer) and removing the photosensitive layer from a portion on the supporting body. Further, in the PS printing plate processor, the structure is made such that a removal of the unnecessary photosensitive layer from the portion on the supporting body can be promoted by brushing the surface of the PS printing plate dipped into the developing solution by a brush roller.

In this case, the brush roller used in the PS printing plate processor includes a cloth to which wire members are previously attached, that is, a structure in which a woven wire cloth corresponding to a web-like member is wound around a roller main body in a helical manner. In conventional, in the brush roller using the woven wire cloth, a back surface side of the woven wire cloth (a surface to which the woven wires are not attached) is bonded to a peripheral surface of the roller main body by an adhesive agent or the like, however, in the case of using the adhesive agent, there is a risk that the adhesive agent runs over the woven wire cloth so as to bind the wire members, and a bonding performance is reduced by the processing solution such as the developing solution or the like, whereby the woven wire cloth is peeled.

Accordingly, there has been proposed a brush roller structured such that a woven wire cloth wound around a roller main body in a helical manner is mechanically fixed to both end portions of an axial portion of the roller main body in a portion out of an area opposing to the PS printing plate by using a band or the like.

However, when the woven wire cloth is dipped into the processing solution such as the developing solution or the like, an elongation is generated in the woven wire cloth to no small extent (for example, about 0.3% after several months in the developing solution processing the PS printing plate). Further, a torsional force is applied to the woven wire cloth wound around the roller main body in a helical manner due to a contact pressure given by the wire members being contact with the PS printing plate.

Accordingly, an elongation is generated in the woven wire cloth and the winding with respect to the roller main body is loosened, in the structure made such that the woven wire cloth is simply fixed to both end portions along the axial direction of the roller main body. Further, the winding tightness is generated in one end side of the roller main body due to the torsional force applied to the woven wire cloth, and when the woven wire cloth is tensioned due to the winding tightness, there is a case that another end side is extended and a gap is generated between the woven wire cloths. The looseness and the gap in the woven wire cloth mentioned above appears on the surface of the PS printing plate as a surface irregularity so as to reduce a finish quality of the PS printing plate.

<<Prior Art 2.>>

As mentioned above, the brush roller used for processing the PS printing plate includes the cloth to which the wire members are previously attached, that is, the structure in which the woven wire cloth corresponding to the web-like member is wound around the roller main body in a helical manner.

In this case, in the case that the woven wire cloth is wound around the roller main body in a helical manner, a boundary portion between the woven wire cloths disposed adjacent to each other along the axial direction of the roller main body is generated around the roller main body in a helical shape. A density of the wire materials is reduced in the boundary portion of the woven wire cloth.

On the other hand, in a photo polymer printing plate employed in a computer to plate (CTP) or the like, it is necessary to increase a contact pressure applied to the PS printing plate by the wire members at a time of brushing.

However, in the case of increasing the contact pressure at a time of brushing, a surface irregularity of density of the wire members in the boundary portion of the woven wire cloth wound around the roller main body appears as a streak-like surface irregularity on the surface of the PS printing plate so as to reduce a finish quality of the image formed in the PS printing plate.

There is a case that the streak-like surface irregularity mentioned above clearly appears if the respective contact portions of the boundary portions of the woven wire cloths of two brush rollers with the surface of the PS printing plate are close to each other or overlapped with each other when brushing the surface of the PS printing plate, for example, with using two brush rollers.

<<Prior Art 3.>>

In the photosensitive material processing apparatus, a process such as a development or the like is performed by a plurality of processing solutions by dipping the photosensitive material into the processing solution while transferring the image exposed photosensitive material, and spraying the processing solution onto the surface of the photosensitive material.

For example, in the PS printing plate processor corresponding to the photosensitive material processing apparatus for processing the photosensitive surface printing plate (PS printing plate) as the photosensitive material, there are provided a plurality of processing steps using the processing solution such as a developing step of dipping the PS printing plate into the developing solution so as to process, a water washing step of spraying a water washing water to the PS printing plate so as to perform a water washing process, a desensitization step of applying a desensitization processing solution such as a gum solution or the like to the surface of the PS printing plate in which the water washing step is finished, so as to perform a desensitization process, and the like, thereby applying the developing, water washing desensitization processes and the like to the image exposed PS printing plate.

In the PS printing plate processor mentioned above, the structure is made such that at a time of transferring the PS printing plate from a processing tank in an upstream side to a processing tank in a downstream side, the PS printing plate is held between a pair of rollers so as to squeeze down the processing solution attached to the surface of the PS printing plate, thereby preventing the processing solution in the upstream side from being mixed into the processing solution in the downstream side.

In this case, in order to hold the PS printing plate by a pair of rollers so as to squeeze down the processing solution, it is necessary to apply a strong gripping force to a portion between a pair of rollers. As a structure applying a nipping force to a pair of rollers mentioned above, for example, both ends of an extension coil spring are connected to each other in a ring shape and the ring-like coil spring is wound around bearings pivoting the respective rollers. Further, there is employed a way of mounting the bearing of the lower roller to a side plate and urging the bearing of the upper roller toward the bearing of the lower roller by urging means using variously structured springs.

In order to squeeze down the processing solution from the PS printing plate, it is necessary to apply a great nipping force to a portion between a pair of rollers, so that it is necessary to employ a spring having a great urging force.

However, in the case of applying the great urging force to the portion between a pair of rollers by using the urging means such as the coil spring or the like which applies the urging force to the portion between the coil spring connected in a ring manner or the side plate and the bearing, it is not easy to attach and detach a pair of rollers with respect to the side plate. For example, it is necessary to urge one roller to another roller by engaging one end of the coil spring with the side plate and engaging another end of the coil spring with the bearing of one roller against the great urging force in a state that the bearings of the opposing rollers can move to directions being contact with each other and being apart from each other. Further, it is necessary to move another end of the coil spring apart from the bearing of one roller against the urging force when taking out a pair of rollers from the side plate, whereby ease of maintenance is reduced.

<<Prior Art 4.>>

In the PS printing plate processor, for example, in the water washing step, the structure is made such that a pair of spray pipes are arranged in upper and lower portions of the transferring path of the PS printing plate, the washing water is discharged toward the PS printing plate from the spray pipe and the developing solution is rinsed from the surface (both of the upper and lower surfaces) of the PS printing plate.

In this case, when jamming in a state that the PS printing plate is held between a pair of spray pipes, it is necessary to cut the PS printing plate by using a metal scissors or the like, in order to take out the PS printing plate.

In the PS printing plate processor, in order to prevent the state that the PS printing plate should be cut from being generated, the structure is made such that a pair of spray pipes arranged in the upper and lower portions of the transferring path of the PS printing plate are respectively mounted independently between a pair of side plates. Further, the structure is made such that the same flow amount of processing solution is supplied to a pair of spray pipes by independently mounting the upper and lower spray pipes so as to independently supply the processing solution.

However, in the case that a pair of spray pipes are independently mounted to the portion between a pair of side plates, it becomes complex to perform an operation of taking out the spray pipe. In particular, since the spray pipe is frequently provided in a narrow space between a pair of rollers for squeezing the washing water from the PS printing plate, at a time of taking out the lower spray pipe, it is necessary to insert hands to a narrow space between a pair of rollers so as to perform the operation after taking out the upper spray pipe, so that a maintenance is not easily performed.

<<Prior Art 5.>>

In the PS printing plate processor, for example, the structure is made such that the brush roller is provided within the developing tank and the surface of the PS printing plate is brushed by the brush roller, whereby removing the unnecessary photosensitive layer is promoted. Further, in the PS printing plate processor, the developing solution within the developing tank is recirculated, whereby the developing solution is stirred so that a concentration and a temperature of the developing solution become uniform. Accordingly, the finish quality of the PS printing plate is intended to be improved.

In this case, there is a case that dusts or grimes such as paper powders of PS-plated inserting paper to be processed or silicates contained in the photosensitive layer are mixed as a lump within the developing solution. When a solid material such as the dusts, the grimes, the lump of silicates or the like is mixed into the developing solution and attached to the surface of the PS printing plate, there is a case that the solid material prevents the developing process from being promoted and stays attached to the surface of the PS printing plate, thereby reducing the finish quality of the PS printing plate.

Accordingly, in the PS printing plate processor, the structure is made such that a filter is provided in the middle of the recirculating path so as to remove the solid material in the developing solution, at a time of recirculating the developing solution within the developing tank.

In this case, since the solid material in the developing solution is attached to the filter and a clogging is generated, it is necessary to frequently perform a maintenance such as cleaning or the like.

The filter mentioned above includes a filter formed in a cylindrical shape, and this filter is received in a cylindrical outer case. In order to take out the filter from the filter case corresponding to the outer case, it is necessary to take out a cap provided in an opening of the filter case and manually draw out the cylindrical filter (filter element) from an inner portion of the filter case. At this time, since the filter is pressed into the filter case, there is a case that it is not easy to take out the filter, so that it is desired to improve an operability at a time of taking out the filter.

SUMMARY OF THE INVENTION

The prevent invention has been made taking the facts mentioned above into consideration, and one object of the present invention is to provide a brush roller which prevents slack due to elongation of a web-like member, such as a woven wire cloth wound around a roller main body in a helical manner or the like, and prevents a gap between the web-like members due to torsional force, caused by contact pressure applied to the web-like members, from occurring.

Another object of the present invention is to provide a photosensitive material processing apparatus which prevents a contact portion of a boundary portion of the web-like member with the photosensitive material from appearing as a surface irregularity at a time of brushing the photosensitive material, such as a PS printing plate or the like, with the brush roller, which is formed by winding the web-like member such as the woven wire cloth or the like around the roller main body in a helical manner.

The other object of the present invention is to provide a mounting structure of a pair of rollers which can apply a desired nip force to a portion between the pair of rollers and enables easy attachment and detachment of the pair of rollers to and from a side plate or the like.

Further, another object of the present invention is to provide a spray pipe which can be easily maintained when a pair of spray pipes are provided at both sides of a transferring path of the photosensitive material such as the PS printing plate or the like.

Further, yet another object of the present invention is to provide a filter case which enables easy attachment and detachment of a filter.

In order to achieve the object mentioned above, in accordance with the present invention, there is provided a brush roller which has a rotational axis and is rotatable around the rotational axis for brushing a surface of a photosensitive material, the brush roller including: a cylindrical roller main body; a web-like member for brushing which is wound around an outer peripheral surface of the roller main body in a helical manner; a holding member provided at one end portion in an axial direction of the roller main body, which holding member holds one end portion of the web-like member and is rotatable with respect to the roller main body while holding the one end portion of the web-like member; and an urging element which urges the holding member to rotate to a side of a winding direction of the web-like member for reducing slack of the web-like member.

In accordance with the present invention, there is also provided a photosensitive material processing apparatus having a transferring path of a photosensitive material and a plurality of brush rollers each including a roller main body and a web-like member for brushing the photosensitive material, the web-like member being wound around an outer peripheral surface of the roller main body in a helical manner and the brush roller potentially forming a track pattern on the photosensitive material at a portion of the photosensitive material that is contacted by a portion of the brush roller corresponding to a boundary portion of the web-like member, wherein at least two of the brush rollers are disposed along the transferring path at one side of the transferring path, and the at least two brush rollers are provided such that a track pattern of one brush roller of the at least two brush rollers is different from a track pattern of another brush roller of the at least two brush rollers.

In accordance with the present invention, there is further provided a photosensitive material processing apparatus which performs a brushing treatment of a surface of a photosensitive material with a brush roller formed by helically winding and fixing a web-like member around an outer peripheral surface of a roller main body, said brush roller potentially forming a track pattern on said photosensitive material at a portion of said photosensitive material that is contacted by a portion of said brush roller corresponding to a boundary portion of said web-like member, wherein at least two of said brush roller are disposed along a transferring path of said photosensitive material, at one surface side of said transferring path, such that an angle of inclination of said track pattern of one of said at least two brush rollers with respect to a transferring direction of said photosensitive material is substantially the same as an angle of inclination of said track pattern of another of said at least two brush rollers with respect to said photosensitive material transferring direction, and overlapping of said track patterns is preventable by alteration of at least one of a rotational speed of said one brush roller relative to said other brush roller, a photosensitive material transferring speed, a distance between said one brush roller and said other brush roller along said transferring path, and a position with respect to said photosensitive material of an axial direction end portion of said boundary portion of said web-like member of said one brush roller relative to a position with respect to said photosensitive material of an axial direction end portion of said boundary portion of said web-like member of said other brush roller.

In accordance with the present invention, there is still further provided a roller pair mounting structure which provides gripping force for gripping a photosensitive material at a portion thereof disposed between a pair of rollers and holds the pair of rollers at a predetermined position of a side plate, the structure including: a first bearing which supports one of the rollers; a second bearing which supports another of the rollers; a base portion detachably mounted at a predetermined position of the side plate; a first bearing receiving portion provided at the base portion, which first bearing receiving portion receives the first bearing and holds the first bearing at a predetermined position; a second bearing receiving portion provided at the base portion, which second bearing receiving portion receives the second bearing such that the second bearing is movable toward and apart from the first bearing; a restricting member disposed at a side of the second bearing opposite to a side thereof at which the first bearing is disposed, which restricting member restricts movement of the second bearing apart from the first bearing and prevents removal of the second bearing from the second bearing receiving portion; and an urging and holding element provided at the restricting member, which urging and holding element provides a predetermined gripping force between the pair of rollers by urging the second bearing toward the first bearing.

In accordance with the present invention, there is yet further provided a spray pipe provided in a photosensitive material processing apparatus which processes a photosensitive material, which is transferred within the processing apparatus, with a processing liquid, the spray pipe discharging the processing liquid toward a surface of the photosensitive material, and the spray pipe including: a pair of pipes, each pipe of the pair of pipes being closed at one end side in a longitudinal direction thereof and having at least one through hole formed at an outer peripheral portion thereof, the through hole being capable of discharging the processing liquid; a holding member which mechanically connects respective the one end sides of the pair of pipes and holds the one end sides with a predetermined separation therebetween; a connecting holder which has a hollow inner portion which is fluid-communicated with the pair of pipes, and mechanically connects respective other end sides in the longitudinal directions of the pair of pipes and holds the other end sides with a predetermined separation therebetween; and a connecting element which has a connecting port communicated with the hollow inner portion of the connecting holder, the connecting port being detachably connected to a processing liquid supply pipe for supplying the processing liquid to the pair of pipes.

In accordance with the present invention, there is still further provided a filter case including: a substantially cylindrical outer case provided with an introduction pipe and a delivery pipe, and having an opening; a cap sealingly attached to the opening of the outer case; an inner tube provided at the cap and received in the outer case when the cap is attached thereto, through which inner tube a processing solution fed from the introduction pipe passes toward the delivery pipe; a filter element having a frame body which is formed in a substantially cylindrical shape and is capable of being received within the outer case, which frame body receives the inner tube when the inner tube is received in the outer case, and having a filter provided at a surface of the frame body, through which filter the processing solution flowing toward the delivery pipe passes when the inner tube is inserted into the frame body; a pawl portion provided at one of the frame body and the inner tube and protruding in a radial direction; and a hole portion provided at another of the frame body and the inner tube, which hole portion is entered by the pawl portion when the inner tube is inserted into the frame body, the filter element being held by an engagement operation of the hole portion and the pawl portion.

DESCRIPTION OF THE PREFERRED EMBODIMENTS

<<First Embodiment>>

Figure 1:
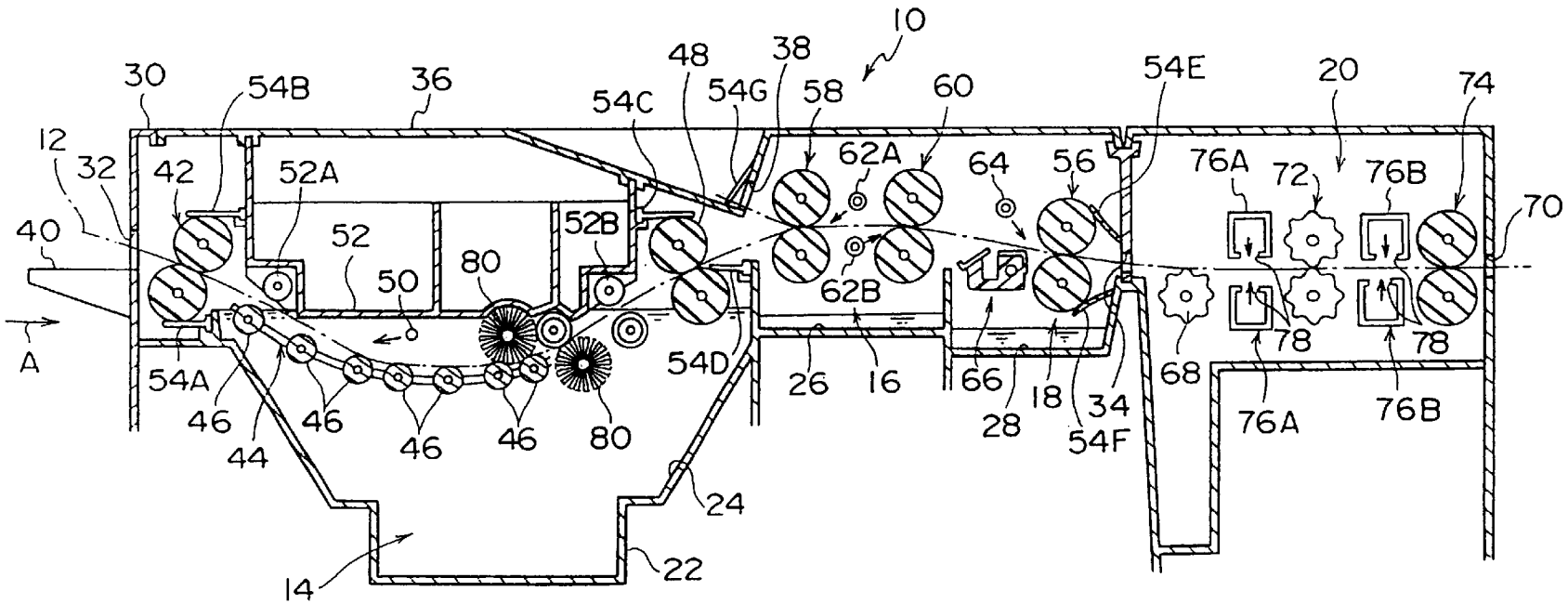
FIG. 1 is a schematic view of a whole of a PS printing plate processor in accordance with a first embodiment of the present invention.

A description will be given of a first embodiment in accordance with the present invention with reference to the accompanying drawings. FIG. 1 shows a schematic structure of a photosensitive surface printing plate processing apparatus (hereinafter, referred to as "PS printing plate processor 10") applied as one embodiment of a photosensitive material processing apparatus. The PS printing plate processor 10 performs a developing process of a photosensitive surface printing plate (hereinafter, referred to as "PS printing plate 12") such as a photo polymer plate corresponding to one of a photosensitive material image exposed by an exposing apparatus (not shown) or the like. In this case, the PS printing plate 12 is structured such that a photosensitive layer is formed in a supporting body constituted by a thin rectangular flat plate such as an aluminum plate or the like, and the photo polymer plate is structured such that a photo junction layer, a photo polymerization layer and an overcoat layer are overlapped with each other, whereby a photosensitive layer is formed, and an image is exposed by a laser beam, whereby a polymerizing reaction of an image portion of the photo polymerization layer is promoted.

In the PS printing plate processor 10, there are arranged a developing portion 14 for processing the PS printing plate 12 by a developing solution, a water washing portion supplying a washing water of the PS printing plate 12 processed by the developing solution so as to wash, a desensitization processing portion 18 applying a gum solution to the PS printing plate 12 after being washed so as to perform a desensitization process, and a drying portion 20 drying the PS printing plate 12.

A processing tank 22 is provided within the PS printing plate processor 10. A developing tank 24 is formed at a position forming the developing portion 14 in the processing tank 22, and a water washing tank 26 and a desensitization processing tank 28 are formed as a processing tank at a position forming the water washing portion 16 and the desensitization processing portion 18.

A slit-like inserting port 32 is formed in an outer plate panel 30 covering the processing tank 22, and a discharge port 34 is formed in a side of the drying portion 20 in the processing tank 22. Further, an inserting port (a sub inserting port) 38 for reentry for inserting the PS printing plate to a portion between the developing portion 14 and the water washing portion 16 is provided in a cover 36 covering the processing tank 22. The reentry inserting port 38 forms an inserting port of the PS printing plate 12 for performing the processes in the PS printing plate processor 10 except the process in the developing portion 14.

An inserting table 40 is provided in an outer portion of the inserting port 32, and a pair of transferring rollers 42 made of rubber are arranged in an inserting side of the PS printing plate 12 in the developing portion 14. The PS printing plate 12 on which an image is exposed is mounted on the inserting table 40, inserted from the inserting port 32 along a direction of an arrow A and fed to a portion between a pair of transferring rollers 42.

A pair of transferring rollers 42 is rotated by a drive force given by drive means (not shown), takes in the inserted PS printing plate 12 and feeds to the developing portion 14 at an angle between about 15 degrees and 31 degrees with respect to a horizontal direction.

The developing tank 24 formed in the processing tank 22 is formed in a substantially angular shape in which a center of a bottom portion is protruded downward, and stores a developing solution for performing a developing process of the PS printing plate 12. A guide plate 44 is arranged in a lower side along the transferring direction of the PS printing plate 12 in the developing tank 24 in such a manner as to be along the bottom portion.

The guide plate 44 is provided in an upstream portion (in a side of the inserting port 32) of the developing tank 24, and a plurality of freely rotating rollers (small rollers) 46 are mounted thereto. The PS printing plate 12 fed within the developing portion 14 by a pair of transferring rollers 42 is transferred on the guide plate 44 while being guided by the rollers 46.

A pair of rollers 48 each having a rubber outer periphery are arranged in a side of the water washing portion 16 in the developing tank 24, and the PS printing plate 12 guided and transferred within the developing tank 24 so as to form a substantially U shape is gripped by a pair of transferring rollers 48 and taken out from the developing tank 24. The PS printing plate 12 is dipped into the developing solution at a time of being transferred within the developing tank 24 in the manner mentioned above, and the unnecessary portion of the photosensitive layer exposed by the image exposure is swelled by the developing solution and peeled from the supporting body, whereby the unnecessary photosensitive layer is removed in correspondence to the exposed image.

In this case, a spray pipe 50 is provided within the developing tank 24, whereby the developing solution within the developing tank 24 sucked by a pump (not shown) is sprayed onto the photosensitive layer surface of the PS printing plate 12, the developing solution is supplied onto the surface of the PS printing plate 12, and the developing solution within the developing tank 24 is circulated.

Further, a brush roller 80 is provided between the guide plate 44 and a pair of transferring rollers 48, within the developing tank 24. The brush roller 80 (details thereof will be mentioned below) rotates wire members while contacting them with the surface of the PS printing plate 12 transferred with being dipped into the developing solution, thereby brushing the surface of the PS printing plate 12 so as to promote removing of the unnecessary photosensitive layer from the surface of the PS printing plate 12.

A liquid surface lid 52 is arranged in the developing portion 14 so that a lower surface thereof is below a liquid surface of the developing solution stored in the developing tank 24. Further, in the wall surface of the developing tank 24 and the liquid surface lid 52, shielding members 54A and 54B are provided in a side of the inserting port 32, and shielding members 54C and 54D are mounted in a side of the water washing portion 24. In the processing tank 22, shielding members 54E and 54F are mounted in the periphery of the discharging port 34, and a shielding member 54G is mounted to the reentry inserting port 38 of the cover 36.

The shielding members 54A to 54G are formed by a silicon rubber or the like, and an inner portion of the developing tank 24 is structured such that the liquid surface lid 52 having a great capacity and contacting with the liquid surface is provided in a space within a sealed portion formed by the shielding members 54A to 54G, a pair of transferring rollers 42 and 48 and the like so as to reduce an amount of air sealed within the space and prevent a fresh air from entering into a portion near the liquid surface of the developing solution by the liquid surface lid 52, the shielding members 54A to 54G and the like, so that it is possible to prevent the developing solution from being deteriorated and a water content from being evaporated due to carbon dioxide gas in the air. In this case, in the liquid surface lid 52, tandem rollers 52A and 52B are provided on lower surfaces of end portions in an upstream side and a downstream side in the transferring direction of the PS printing plate 12, thereby preventing the surface (mainly the photosensitive surface) from being damaged by the PS printing plate 12 transferred within the developing portion 14 being contact with the lower surface of the liquid surface lid 52.

The PS printing plate 12 drawn out from the developing tank 24 by a pair of transferring rollers 48 is fed to the water washing portion 16 by a pair of transferring rollers 48 while the developing solution attached to the surface thereof is squeezed down.

The transferring path for transferring the PS printing plate 12 in a substantially horizontal state by a pair of transferring rollers 58 and 60 arranged above the water washing tank 26 is formed in the water washing portion 16, and the PS printing plate 12 is horizontally transferred above the water washing tank 26 while being gripped by a pair of transferring rollers 58 and 60.

A pair of spray pipes 62A and 62B are provided in upper and lower portions of the transferring path of the PS printing plate 12 between a pair of transferring rollers 58 and 60 in the water washing portion 16. The spray pipes 62A and 62B are arranged so that an axial direction thereof is along a width direction (a direction perpendicular to the transferring direction) of the PS printing plate 12, and a plurality of discharging holes are formed so as to oppose to the transferring path of the PS printing plate 12.

The water washing tank 26 stores a washing water corresponding to the processing solution. In the spray pipes 62A and 62B, the washing water supplied due to an operation of a solution supplying pump in synchronous with the transferring of the PS printing plate 12 is injected out toward the PS printing plate 12 from the discharging hole. In the PS printing plate 12, the developing solution attached to the surface is washed away by the washing water.

The developing solution washed away by the washing water drops down to the water washing tank 26 together with the washing water. In this case, a fresh solution of the washing water is supplied to the water washing tank 26 by means (not shown) in correspondence to an amount of the PS printing plate 12 to be processed.

The PS printing plate 12 is fed out while being gripped by a pair of transferring rollers 60, whereby the washing water supplied to the PS printing plate 12 is squeezed down from the front and back surfaces of the PS printing plate 12 together with the developing solution attached to the front and back surfaces of the PS printing plate 12 and recovered within the water washing tank 26. In this case, an injecting direction of the washing water from the spray pipes 62A and 62B is set such that one of the spray pipe 62A is an upstream side in the transferring direction of the PS printing plate 12 and one of the spray pipe 62B is a downstream side in the transferring direction of the PS printing plate 12, however, is not limited to this and the other directions may be employed.

In the desensitization processing portion 18, a pair of transferring rollers 56 are provided above the desensitization processing tank 28, and the PS printing plate 12 is transferred within the desensitization processing tank 18 by a pair of transferring rollers 56 and thereafter fed out from the discharging port 34.

In the desensitization processing portion 18, a spray pipe 64 is provided in an above side of the transferring path of the PS printing plate 12. The spray pipe 64 is arranged so that an axial direction thereof is along the width direction of the PS printing plate 12, and a plurality of discharging holes are formed so as to oppose to the transferring path of the PS printing plate 12. Further, in the desensitization processing portion 18, a discharging unit 66 in which slits are continuously formed along the width direction of the PS printing plate 12 is arranged below the transferring path of the PS printing plate 12.

In the desensitization processing tank 28, a gum solution used for protecting a plate surface of the PS printing plate 12 is stored, and the gum solution is supplied to the spray pipe 64 and the discharging unit 66 by a pump (not shown) operated in synchronous with the transferring operation of the PS printing plate 12. The spray pipe 64 drops the gum solution toward the PS printing plate 12 so as to expand and apply onto the surface of the PS printing plate 12. Further, the discharging unit 66 applies the gum solution discharged from the slits onto a whole surface in the back surface side of the PS printing plate 12 at a time when the back surface side of the PS printing plate 12 passes through while being contact with the slit portions.

In the PS printing plate 12, a protecting film is formed by the gum solution applied to the front and back surface thereof. In this case, the discharging direction of the gum solution from the spray pipe 64 is not limited to the downward side in the transferring direction of the PS printing plate 12, and may be set to the other directions. Further, the structure is made such that the discharging unit 66 is provided in a lower side of the transferring path of the PS printing plate 12 so as to apply the gum solution, however, the structure is not limited to this, and the structure may be made such that the spray pipe is provided so as to apply the gum solution.

The PS printing plate 12 to which the gum solution is applied in the desensitization processing portion 18 is gripped by a pair of transferring rollers 56, is discharged from the discharging port 34 in a state that the gum solution slightly leaves on the front and back surfaces, and is fed to the drying portion 20.

In the drying portion 20, a supporting roller 68 for supporting the PS printing plate 12 is arranged near the discharging port 34, and a pair of transferring rollers 72 and a pair of transferring rollers 74 are arranged in the center portion of the transferring path of the PS printing plate 12 within the drying portion 20 and near the discharging port 70, whereby the PS printing plate 12 is transferred within the drying portion 20 by the supporting roller 68 and a pair of transferring rollers 72 and 74.

Ducts 76A and 76B are arranged between the supporting roller 68 and a pair of transferring rollers 72 and between a transferring rollers 72 and a pair of transferring rollers 74 so as to form pairs with holding the transferring path of the PS printing plate 12 therebetween. The ducts 76A and 76B are arranged so that a longitudinal direction thereof is along the width direction of the PS printing plate 12, and slit holes 78 are provided on a surface opposing to the transferring path of the PS printing plate 12.

The ducts 76A and 76B are structured such that when a drying wind generated by drying wind generating means (not shown) is supplied from one end side in a longitudinal direction, the dusts 76A and 76B inject the drying wind toward the transferring path of the PS printing plate 12 from the slit holes 78 so as to blow to the PS printing plate 12. Accordingly, in the PS printing plate 12, the gum solution applied onto the front and back surfaces thereof is dried and the protecting film is formed. In this case, a shutter (not shown) separating the processor portion until the desensitization processing portion 18 processing the PS printing plate 12 by the processing solution from the drying portion 20 is provided in the discharging port 34, thereby preventing the discharging port 34 from being unnecessarily opened so as to supply the heated air within the drying portion 20 to the desensitization processing portion 18.

In the PS printing plate processor 10 structured in the manner mentioned above, when the PS printing plate 12 on which the image is recorded by the exposure apparatus (not shown) is mounted on the inserting table 40 and inserted to the inserting port 32, the PS printing plate 12 is drawn by a pair of transferring rollers 42 so as to be fed to the developing portion 14. In this case, in the PS printing plate processor 10, the PS printing plate 12 passing through the inserting port 32 is detected by a sensor (not shown), a timer is started. This timer is used for operating the driving means for transferring the PS printing plate 12, and for measuring a timing for discharging the washing water from the spray pipes 62A and 62B of the water washing portion 16 and a discharge timing of the gum solution in the desensitization processing portion 18.

In the developing portion 14, the PS printing plate 12 is fed by a pair of transferring rollers 42 at an inserting angle in a range between 15 degrees and 31 degrees with respect to the horizontal direction so as to be transferred while being dipped into the developing solution. Further, the PS printing plate 12 is fed out from the developing solution at a discharging angle in a range between 17 degrees and 31 degrees. The PS printing plate 12 is dipped into the developing solution in the developing portion 14, whereby the unnecessary portion in the photosensitive layer is swelled in correspondence to the exposed image, and the swelled photosensitive layer is removed from the supporting body. At this time, the removing of the unnecessary photosensitive layer from the surface of the PS printing plate 12 is promoted by brushing the surface of the PS printing plate 12 by the brush roller 80 arranged within the developing tank 24.

The PS printing plate 12 fed out from the developing solution after being applied to the process performed by the developing solution as mentioned above is drawn out by a pair of transferring rollers 48 so as to be transferred to the water washing portion 16. At this time, a pair of transferring rollers 48 squeeze down the developing solution attached to the front and back surfaces of the PS printing plate 12 from the PS printing plate 12.

In the water washing portion 16, the washing water is injected out from the spray pipes 62A and 62B while the PS printing plate 12 is gripped by a pair of transferring rollers 58 and 60 so as to be transferred in a substantially horizontal state. Further, a pair of transferring rollers 60 arranged in the downstream side in the transferring direction of the PS printing plate 12 feed out the PS printing plate 12 to the desensitization processing portion 18 while squeezing down the washing water supplied to the front and back surfaces of the PS printing plate 12 together with the developing solution left without being squeezed by a pair of transferring rollers 48.

Accordingly, in the PS printing plate 12, the developing solution left on the front and back surfaces thereof is washed down at a time of passing through the water washing portion 16.

The PS printing plate 12 fed to the desensitization processing portion 18 passes through a portion between the spray pipe 64 and the discharging unit 66 so as to be gripped by a pair of transferring rollers 56, thereby being fed out from the desensitization processing portion 18 by a pair of transferring rollers 56.

At this time, in the desensitization processing portion 18, the gum solution is supplied to the spray pipe 64 and the discharging unit 66, and the gum solution is applied onto the front and back surfaces of the PS printing plate 12. A pair of transferring rollers 56 feed out the PS printing plate 12 while gripping it therebetween, thereby forming a thin film of the gum solution on the front and back surfaces of the PS printing plate 12, and squeeze out the surplus gum solution from the front and back surfaces of the PS printing plate 12.

The PS printing plate 12 to which the gum solution is applied is fed to the drying portion 20 from the discharging port 34 by a pair of transferring rollers 56. In this case, the shutter (not shown) provided in the discharging port 34 operates at a timing of starting the process of the PS printing plate 12 or a timing that the PS printing plate 12 is fed out from the desensitization processing portion 18 so as to open the discharging port 34, thereby preventing the drying wind in the drying portion 20 from unnecessarily entering into the desensitization processing portion 18 so that the gum solution is adhered to a pair of transferring rollers 56. Further, the shutter prevents the developing solution from being deteriorated by the carbon dioxide gas in the air which enters from the discharging port 34 and reaches the developing portion 14, and further prevents the water content in the developing solution, the washing water and the water content in the gum solution from being evaporated and going out from the discharging port 34.

In the drying portion 20, the drying wind is blown from the ducts 76A and 76B while the PS printing plate 20 is transferred by the supporting roller 68 and a pair of transferring rollers 72 and 74. Accordingly, the protecting film is formed on the PS printing plate 12 by the applied gum solution and the PS printing plate 12 is discharged from the discharging port 70.

Figure 2:
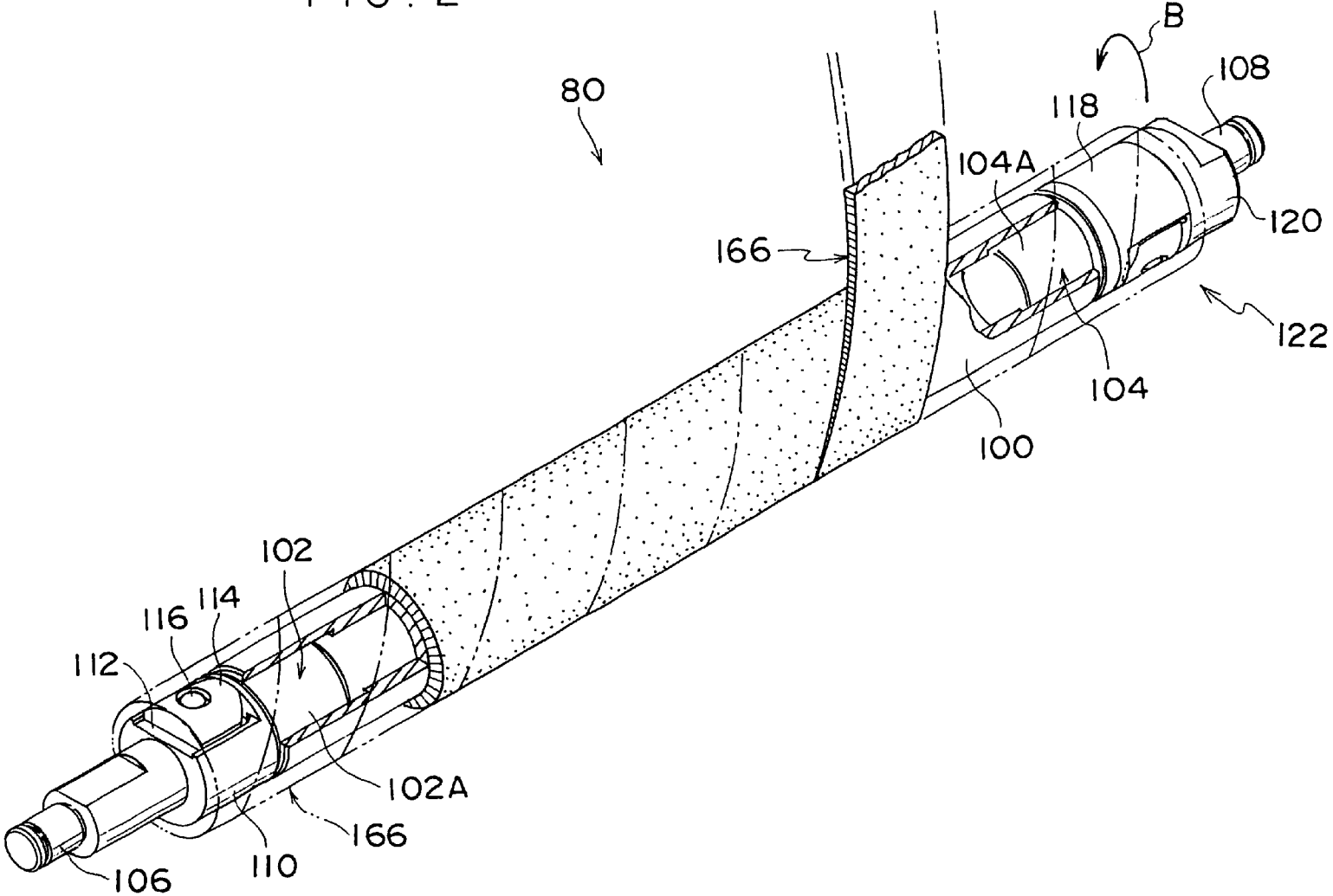
FIG. 2 is a schematic perspective view showing a brush roller in accordance with the present embodiment.

As shown in FIG. 2, each of the brush rollers 80 is provided with a (hollow or solid) cylindrical roller main body 100. The brush roller 80 is mounted so that the roller main body 100 is along the width direction (corresponding to the direction perpendicular to the transferring direction) of the PS printing plate 12 and opposes to the transferred PS printing plate 12 (refer to FIG. 1).

Axial end members 102 and 104 are provided in end portions in an axial direction of the roller main body 100. The axial end members 102 and 104 are mounted in accordance with a way that small diameter portions 102A and 104A are press inserted to the roller main body 100 so as to be adhered thereto, or the like.

Rotary shafts 106 and 108 are protruded from the axial end members 102 and 104, the brush roller 80 is structured such that the rotary shafts 106 and 108 are pivoted and mounted to a bearing (not shown), and the brush roller 80 is rotated by a driving force transmitted via the rotary shafts 106 or 108.

The brush roller 80 is structured such that a web body for brushing 166 (hereinafter, simply referred to as web body 166) corresponding to the web-like member is wound around an outer peripheral portion of the roller main body 100 in a helical manner.

Figure 3A:
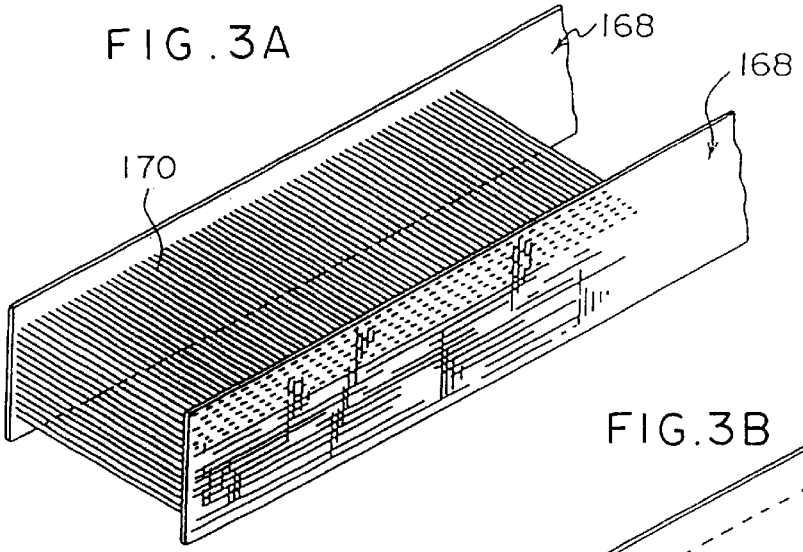
FIGS. 3A to 3D are flow views showing one embodiment of a manufacturing step of a web body.

The web body 166, for example, as shown in FIG. 3A, holds a pair of woven cloths 168 corresponding to a sheet-like base material in such a manner as to oppose to each other and weaves wire members 170 so as to extend over the woven cloths 168.

For the wire members 170, for example, a pile of natural fiber or artificial fiber is applied, however, a metal may be employed as far as having a suitable thinness. That is, as a material for the wire members 170 of the brush roller 80, it is possible to employ a natural fiber such as a vegetable fiber, an animal fiber and the like, an artificial fiber such as a polyamide system including a nylon 6, a nylon 66, a nylon 6.10, a nylon 11 and the like, a polyester system including a polyethylene terephthalate, a polybutylene terephthalate and the like, a polyacrylic system including, a polyacrylonitrile, polyacrylic alkyl and the like, a polypropylene, a polystyrene and the like, and a metal fiber such as a stainless steel, a brass and the like.

Figure 3B:
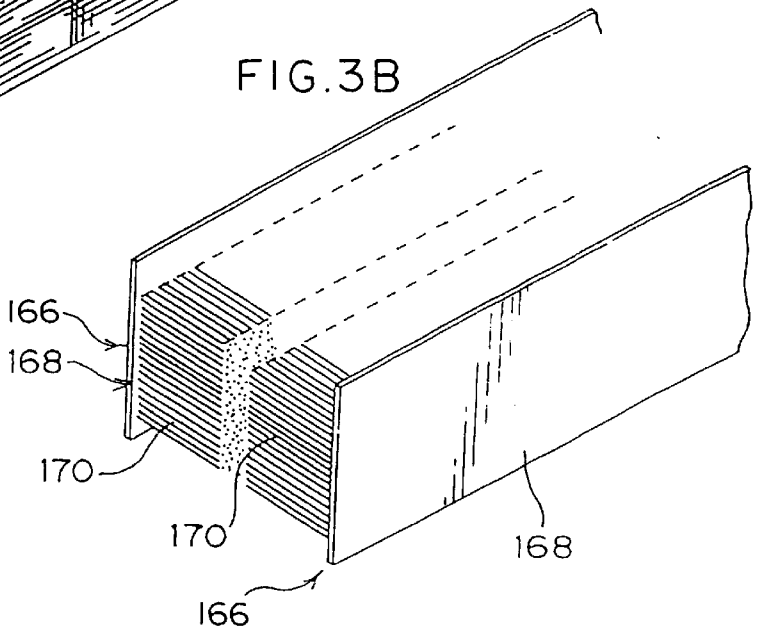
Figure 3D:
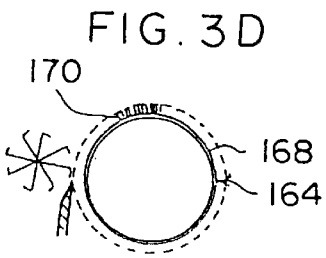
Figure 3C:
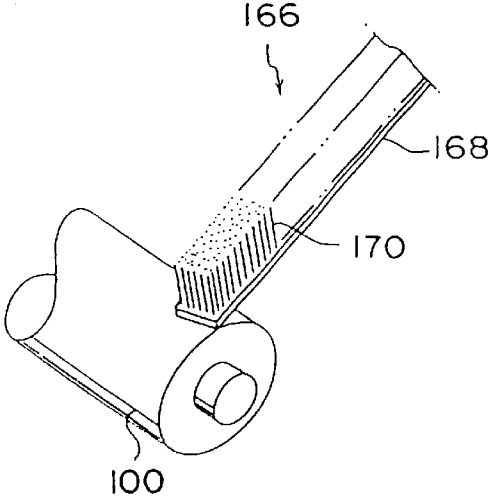

As shown in FIG. 3B, the web body 166 is formed by weaving the wire materials 170 in the woven cloth 168 in a tensional state and thereafter cutting the wire members 170 at a middle portion thereof. The brush roller 80 is obtained by winding the web body 166 around a peripheral surface of the roller main body 100 in a helical manner (refer to FIGS. 2 and 3C) and shirring so as to uniformly make up a length of the wire members 170 (refer to FIG. 3D).

As shown in FIG. 2, a fixing member 110 is provided in one axial end member 102. The fixing member 110 has substantially the same diameter as that of the roller main body 100, and the rotary shaft 106 is protruded from the fixing member 110.

A flat surface portion 112 is formed in the fixing member 110 in a shape that a part of an outer peripheral portion thereof is cut. A restricting plate 114 opposes to the flat surface portion 112 and the restricting plate 114 is fixed by a screw 116.

The web body 166 wound around the roller main body 100 is structured such that one end side is mounted on the flat surface portion 112 of the fixing member 110, and the web body 166 is fixed to the fixing member 110 with being gripped between the flat surface portion 112 and the restricting plate 114 by fixing the restricting plate 114 mounted on one end side of the web body 166 to the fixing member 110 by the screw 116.

The web body 166 is wound in a helical manner while being drawn in a direction of an arrow B along the peripheral surface of the roller main body 100 in a state that one end is fixed to the fixing member 110.

On the other hand, an urging mechanism 122 constituted by a holding member 118 and a fastening member 120 is provided in another axial end member 104.

Figure 4:
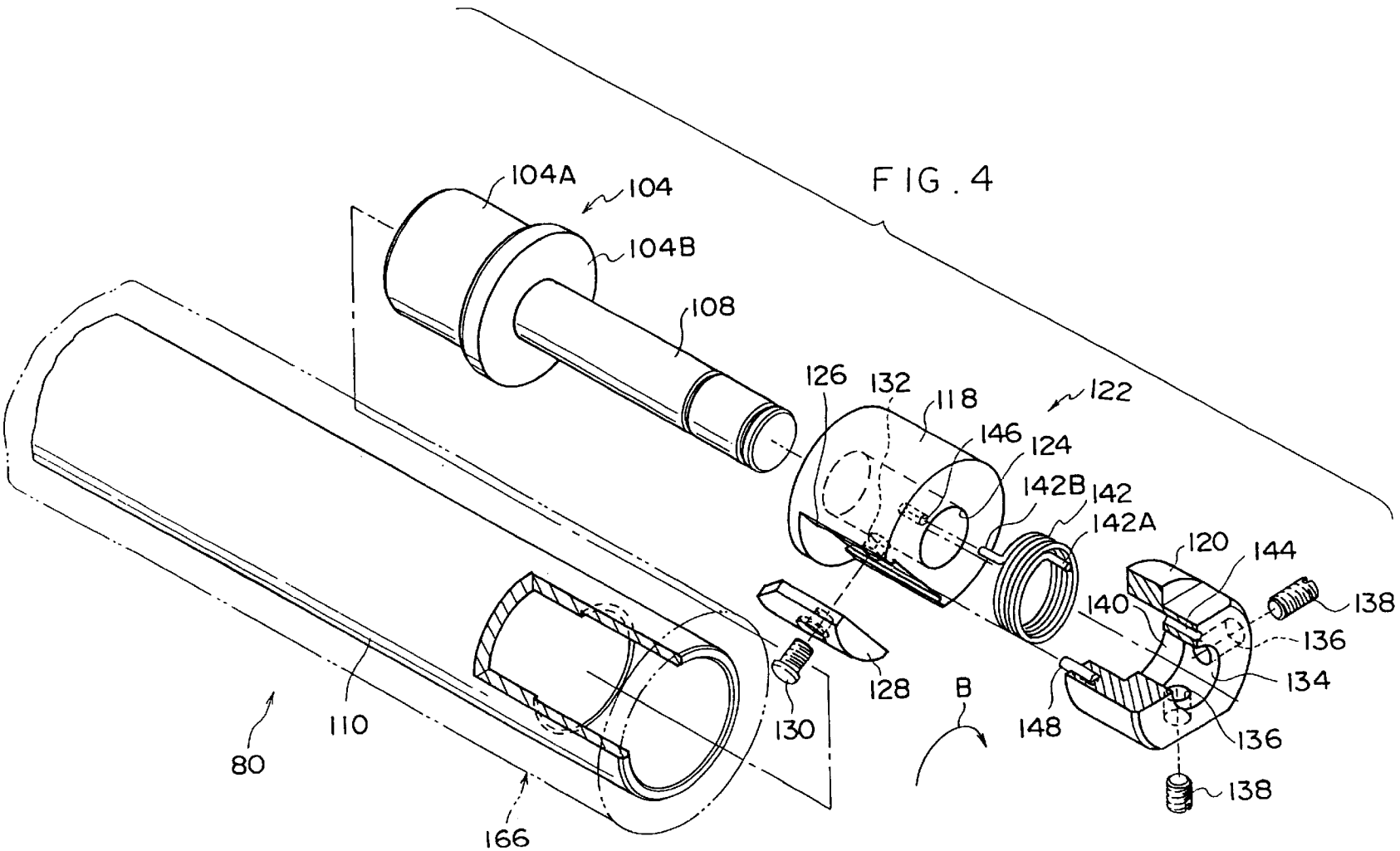
FIG. 4 is an exploded perspective view showing one end side in an axial direction of the brush roller.

As shown in FIG. 4, the holding member 118 is formed in a cylindrical block having the same diameter as that of the roller main body 110. The rotary shaft 108 is inserted to an axial hole 124 formed in an axial core portion, whereby the holding member 118 is mounted to the roller main body 100 in such a manner as to freely rotate relatively.

A flat surface portion 126 is formed in the holding member 118 in a shape that a part of an outer peripheral portion is cut in a recessed manner. A restricting plate 128 is opposed to the flat surface portion 126, and the restricting plate 128 is engaged with a screw hole 132 having a screw hole 130 formed in the flat surface portion 126, thereby being fixed to the holding member 118.

An end portion of the web body 166 wound around the roller main body 100 in a helical manner is mounted to the flat surface portion 126 of the holding member 118, and is gripped between the flat surface portion 126 and the restricting plate 128 so as to be fixed to the holding member 118 by fixing the restricting plate 128 mounted on the end portion of the web body 166 to the holding member 118.

In this case, at a time of fixing the web body 166 to the fixing member 110 and the holding member 118 by the restricting plates 114 and 128, the wire members 170 may be woven in the woven cloth 168, or the web body 166 may be formed by cutting the wire members 170 at both end of the web body 166 corresponding to an area opposing to the fixing member 110 and the holding member 118, an area opposing at least to the restricting plates 114 and 128 in accordance with a shirring or the like, or previously weaving the wire members 170 except the area of the woven cloth 168.

Further, at a time of winding the web body 166 around the roller main body 100, the web body 166 may be temporarily fastened to the flat surface portions 112 and 126 by applying a slight amount of adhesive agent onto the back surface side of the web body 166 opposing to the flat surface portion 112 of the fixing member 110 and the flat surface portion 126 of the holding member 118 and having no wire members 170, or the like.

The fastening member 120 is formed in a block shape, and an axial hole 134 to which the rotary shaft 108 is inserted is formed in a center portion thereof. Further, a plurality of screw holes 136 extending to the axial hole 134 from the outer peripheral portion are formed in the fastening member 120. A lock screw 138 such as a square screw or the like is engaged with each of the screw holes 136.

The fastening member 120 is fixed to the axial end member 104 by screwing the rotary shaft 108 by a plurality of lock screws 138 engaged with the screw holes 136 in a state that the rotary shaft 108 is inserted to the axial hole 134.

The urging mechanism 122 is mounted to the rotary shaft 108 of the axial end member 104 so that the holding member 118 becomes in a side of the roller main body 100. At this time, the fastening member 120 is fixed to the rotary shaft 108, whereby the holding member 118 can relatively rotate between the flange portion 104B of the axial end member 104 and the fastening member 120.

In the fastening member 120, a recess portion 140 is formed on a surface in a side of the holding member 118. A torsional coil spring 142 used as the urging means is received within the recess portion 140. Further, in the fastening member 120, an engaging hole 144 is formed on a bottom surface within the recess portion 140 as seen from a side of the holding member 118.

One end portion 142A of the torsional coil spring 142 received within the recess portion 140 of the fastening member 120 is inserted to the engaging hole 144. Accordingly, the torsional coil spring 142 is engaged with the fastening member 120.

In the holding member 118, an engaging hole 146 is formed on an end surface in a side of the fastening member 120, and another end portion 142B of the torsional coil spring 142 is inserted to the engaging hole 146. Accordingly, the holding member 118 is engaged with the fastening member 120 via the torsional coil spring 142 received within the recess portion 140 of the fastening member 120, and is urged toward a winding direction side of the web body 166 due to an urging force of the torsional coil spring 142.

Further, a restricting pin 148 is protruded in the fasting member 120 from an end surface in the side of the holding member 118, for serving as restricting means. The restricting pin 148 is protruded to a space formed above the flat surface portion 126 and is structured such as to be brought into contact with the flat surface portion 126 of the holding member 118 by relatively rotating the holding member 118 and the fastening member 120.

Accordingly, the holding member 118 can relatively rotate with respect to the fastening member 120 within a range that the restricting pin 148 is apart from the flat surface portion 126. That is, the restricting pin 148 restricts a relative rotation range of the holding member 118 with respect to the fastening member 120 and the roller main body 100. In this case, the restricting plate 128 fixed to the flat surface portion 126 has a position and a size at which the restricting plate 128 is not in contact with the restricting pin 148.

The brush roller 80 is structured such that the web body 166 is wound around the roller main body 100 in a helical manner and the front end of the web body 166 is fixed to the holding member 118. In this state, the restricting pin 148 is brought into contact with the flat surface portion 126 of the holding member 118 by rotating the fastening member 120 in a winding direction of the web body 166, whereby the holding member 118 is rotated in the winding direction of the web body 166.

Accordingly, the web body 166 fixed to the holding member 118 is drawn in the winding direction to the roller main body 100, and the web body 166 is wound around the roller main body 100 in a tensioned state. At this time, the torsional coil spring 142 applies a predetermined tensile force to the web body 166 wound around the roller main body 100 by urging the holding member 118 in the winding direction of the web body 166, whereby the web body 166 wound around the roller main body 100 keeps the tensional state due to the tensile force.

In this case, when an elongation is generated in the web body 166 by using the brush roller 80 for a long time period or the like, the holding member 118 is rotated in the winding direction of the web body 166 due to the urging force of the torsional coil spring 142. Further, when the web body 166 tends to compress against the urging force of the torsional coil spring 142 and accordingly the holding member 118 relatively rotates in a direction opposite to the winding direction at a certain degree, the restricting pin 148 is brought into contact with the flat surface portion 126 of the holding member 118 so as to prevent the holding member 118 from relatively rotating in the direction opposite to the winding direction of the web body 166.

Figure 5:
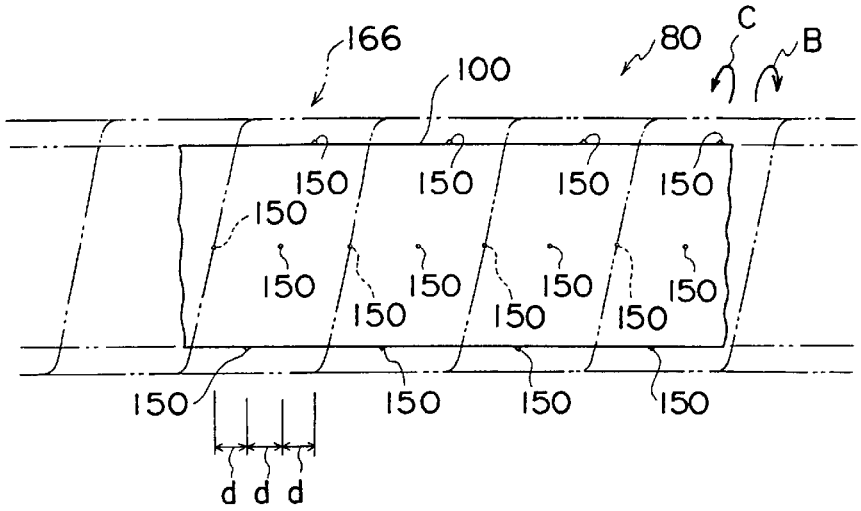
FIG. 5 is a schematic view showing a main portion of a roller main body.
Figure 6A:
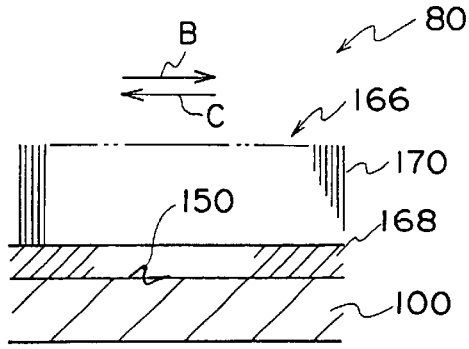
FIG. 6A is a cross sectional view of a main portion of the roller main body showing a portion near a projection formed in the roller main body shown in FIG. 5.

On the other hand, as shown in FIG. 5, a plurality of projections 150 are formed on a peripheral surface of the roller main body 100. The projections 150 are formed, for example, by striking the peripheral surface of the roller main body 100 by a punch having a predetermined shape or the like so as to make a front end of the punch or the like bite into the peripheral surface of the roller main body 100 toward a direction (a direction of an arrow C) inverse to the winding direction of the web body 166, thereby projecting upward. At this time, as shown in FIG. 6A, fine recesses having a crater shape are formed in the side of the winding direction of the projection 150. Accordingly, the projection 150 is formed so that the upper end is directed to the winding direction of the web body 166 and a surface opposite to the fine recess having the crater shape becomes comparatively smooth.

When tightly winding the web body 166 around the roller main body 100 having the projections 150 formed so as to be closely attached to the peripheral surface thereof, it is possible to easily move the woven cloth 168 (the web body 166) in the winding direction, and the structure is made such that when the woven cloth 168 (the web body 166) tends to be shifted in the direction opposite to the winding direction with respect to the roller main body 100, the projection 150 eats into the woven cloth 168 of the web body 166, whereby a contact resistance becomes great.

Accordingly, the web body 166 can move in the winding direction, however, when the movement is going to be generated in a slacking direction corresponding to a direction opposite to the winding direction, the projection 150 engaged so as to eat into the woven cloth 168 prevents the web body 166 from being shifted.

Figure 6B:
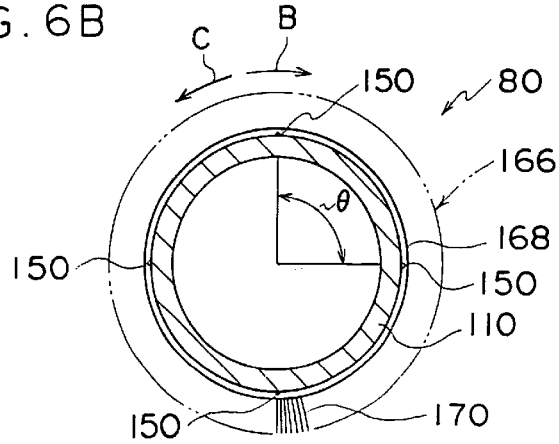
FIG. 6B is a schematic cross sectional view obtained by cutting the roller main body along an axial direction.

As shown in FIG. 5, the projection 150 is formed on the peripheral surface of the roller main body 100 at a helical position along the winding direction of the web body 166. At this time, as shown in FIG. 6B, the projection 150 is formed on the peripheral surface of the roller main body 100 so that an angle formed between the projection 150 and the adjacent projection 150 along the winding direction becomes a predetermined angle θ (for example, 90 degrees).

Accordingly, as shown in FIG. 5, the structure is made such that an interval between the adjacent projections 150 along the axial direction of the roller main body 100 becomes a predetermined interval d, whereby a plurality of projections 150 are not formed on the same circumference crossing the axial direction of the roller main body 100. In this case, the angle θ (refer to FIG. 6B) can be optionally set, for example, in a range between 5 degrees and 180 degrees, and preferably in a range between 15 degrees and 90 degrees.

A description will be given below of an operation of the present embodiment.

The brush roller 80 is constituted by winding the web body 166 formed by weaving the wire members 170 in the woven cloth 168 around the peripheral surface of the roller main body 100 in a helical manner. At this time, one end side of the web body 166 is fixed by the fixing member 110 and another end side is fixed to the holding member 118. The holding member 118 forms the urging mechanism 122 together with the fastening member 120, and is urged to the side of the winding direction (the direction of the arrow B) of the web body 166 by the torsional coil spring 142 provided between the holding member 118 and the fastening member 120.

In general, the web body 166 (the woven cloth 168) slightly generates an elongation when being dipped into the developing solution or the like. In the brush roller 80, since the web body 166 is not bonded to the roller main body 100 by the adhesive agent, a slack is easily generated in the web body 166 due to the elongation.

At this time, in the brush roller 80, the web body 166 is always drawn in the winding direction due to the urging force of the torsional coil spring 142. Accordingly, even when the elongation is generated in the web body due to some reasons, the elongation does not appear as a slack of the web body 166 wound around the roller main body 100.

That is, the urging mechanism 122 provided in the brush roller 80 urges the holding member 118 to which the end portion of the web body 166 is fixed, in the winding direction of the web body 166 due to the urging force of the torsional coil spring 142, and when the elongation is generated in the web body 166, the holding member 118 rotates in the winding direction of the web body 166 due to the urging force of the torsional coil spring 142, thereby preventing the slack from being generated in the web body 166 wound around the roller main body 100.

Further, the restricting pin 148 is provided in the fastening member 120 constituting the urging mechanism 122 together with the holding member 118, and the restricting pin 148 is brought into contact with the flat surface portion 112 of the holding member 118, thereby restricting the relative rotation of the holding member 118 with respect to the fastening member 120.

Accordingly, even when the web body 166 is going to draw the holding member 118 in the direction opposite to the winding direction against the urging force of the torsional coil spring 142, the restricting pin 148 is brought into contact with the flat surface portion 112 of the holding member 118 so as to restrict the relative rotation of the holding member 118 in the direction opposite to the winding direction. Accordingly, the web body 166 draws the holding member 118 in the direction opposite to the winding direction, whereby no slack is generated in the web body 166.

As mentioned above, in the brush roller 80, both end portions of the web body 166 wound around the roller main body 100 in a helical manner are fixed by the fixing member 110 and the holding member 118 of the urging mechanism 122, thereby preventing the slack from being generated in the web body 166 without bonding the web body 166 to the roller main body 100 by the adhesive agent.

On the other hand, the fine projections 150 are formed on the peripheral surface of the roller main body 100 around which the web body 166 is wound with an interval at a position forming a helical shape. The projection 150 is structured such that the front end is directed to the winding direction of the web body 166, and when the woven cloth 168 of the web body 166 wound around the roller main body 100 in a helical manner is going to be shifted in the winding direction, the web body 166 can be shifted, however, when it is going to be shifted in the direction opposite to the winding direction, the projection 150 eats into the woven cloth 168 of the web body 166 so as to increase a frictional resistance, thereby preventing the web body 166 from being shifted.

Accordingly, when the urging mechanism 122 prevents the slack due to the elongation of the web body 166, the web body 166 is shifted in the winding direction, and a uniform tensile force is applied to all the area of the web body 166 wound around the roller main body 100. On the other hand, when the torsional force is applied to the web body 166 wound around the roller main body 100 at a time of brushing the PS printing plate 12, the projections 150 eat into the web body 166, thereby preventing the web body 166 from being shifted in the direction opposite to the winding direction.

Accordingly, in the brush roller 80, it is securely prevent a partial slack from being generated in the web body 166 due to the winding tightness of the web body 166 wound around the roller main body 100.

On the other hand, the projections 150 are formed so as to be shifted at a predetermined angle θ along the peripheral direction of the roller main body 100 between the adjacent projections 150 at a time of being formed at helical positions in the roller main body 100, whereby a plurality of projections 150 do not appear on the same circumference of the roller main body 100. That is, the structure is made such that a plurality of projections 150 do not exist on the same circumference of the roller main body 100 and the interval between the adjacent projections 150 along the axial direction becomes a predetermined interval d. Accordingly, the peripheral surface of the roller main body 100 is formed, for example, in a coarse-grained rubbing metal.

In the case that a plurality of projections 150 exist on the same circumference of the roller main body 100, a plurality of projections 150 rub down the same position at a time of brushing the PS printing plate 12 by the brush roller 80, so that a stripe-shaped rubbed surface irregularity is easily generated along the transferring direction of the PS printing plate 12, however, in the brush roller 80, since the less than one projection 150 is formed on the same circumference of the roller main body 100, the rubbed surface irregularity due to the projections 150 does not appear on the surface of the PS printing plate 12.

In order to prevent the web body 166 wound around the roller main body 100 from being shifted, a method of increasing a frictional resistance between the peripheral surface of the roller main body 100 and the web body 166 includes a method of applying a knurling work onto the peripheral surface of the roller main body 100, however, in the case of partly applying the knurling work onto the peripheral surface of the roller main body 100, a plurality of convex portions are arranged on the same circumference of the roller main body 100 and the rubbed surface irregularity is generated on the surface of the PS printing plate 12 even when a difference between concave and convex is about 0.3 mm.

Further, applying the knurling work onto a whole surface of the outer periphery of the roller main body 100 generates a vibration or the like in the brush roller 80 due to reduction of circulaity of the roller main body 100 or the like.

On the other hand, by forming the projections 150 at the helical positions on the peripheral surface of the roller main body 100, it is possible to securely prevent the web body 166 wound around the roller main body 100 in a helical manner from being shifted, particularly, prevent the web body 166 from being shifted in the direction opposite to the winding direction, without generating vibration in the brush roller 80.

Accordingly, in the PS printing plate processor 10, by brushing the surface of the PS printing plate 12 by the brush roller 80, it is possible to securely remove the unnecessary photosensitive layer or the like without generating a finish defect such as the rubbed surface irregularity or the like on the surface of the PS printing plate 12.

Further, the present embodiment does not limit the structure of the present invention. In the present embodiment, the fixing member 110 is provided in one end in the axial direction of the roller main body 100 and the urging mechanism 122 is provided in another end thereof, however, the structure may be made such that the urging mechanisms 122 are provided in both ends in the axial direction of the roller main body 100 and the respective urging mechanisms 122 urge both end portions of the web body 166 in the direction of wining around the roller main body 100.

Further, in the present embodiment, the restricting pin 148 provided in the fastening member 120 prevents the holding member 118 from relatively rotating in the direction opposite to the winding direction of the web body 166, however, the structure of the restricting means is not limited to this. For example, the structure may be made such that a one-way clutch mechanism is provided between the holding member 118 and the fastening member 120 or the axial end member 104 so as to prevent the holding member 118 from relatively rotating in one direction, or a ratchet mechanism may be employed in place of the one-way clutch mechanism.

Figure 7:
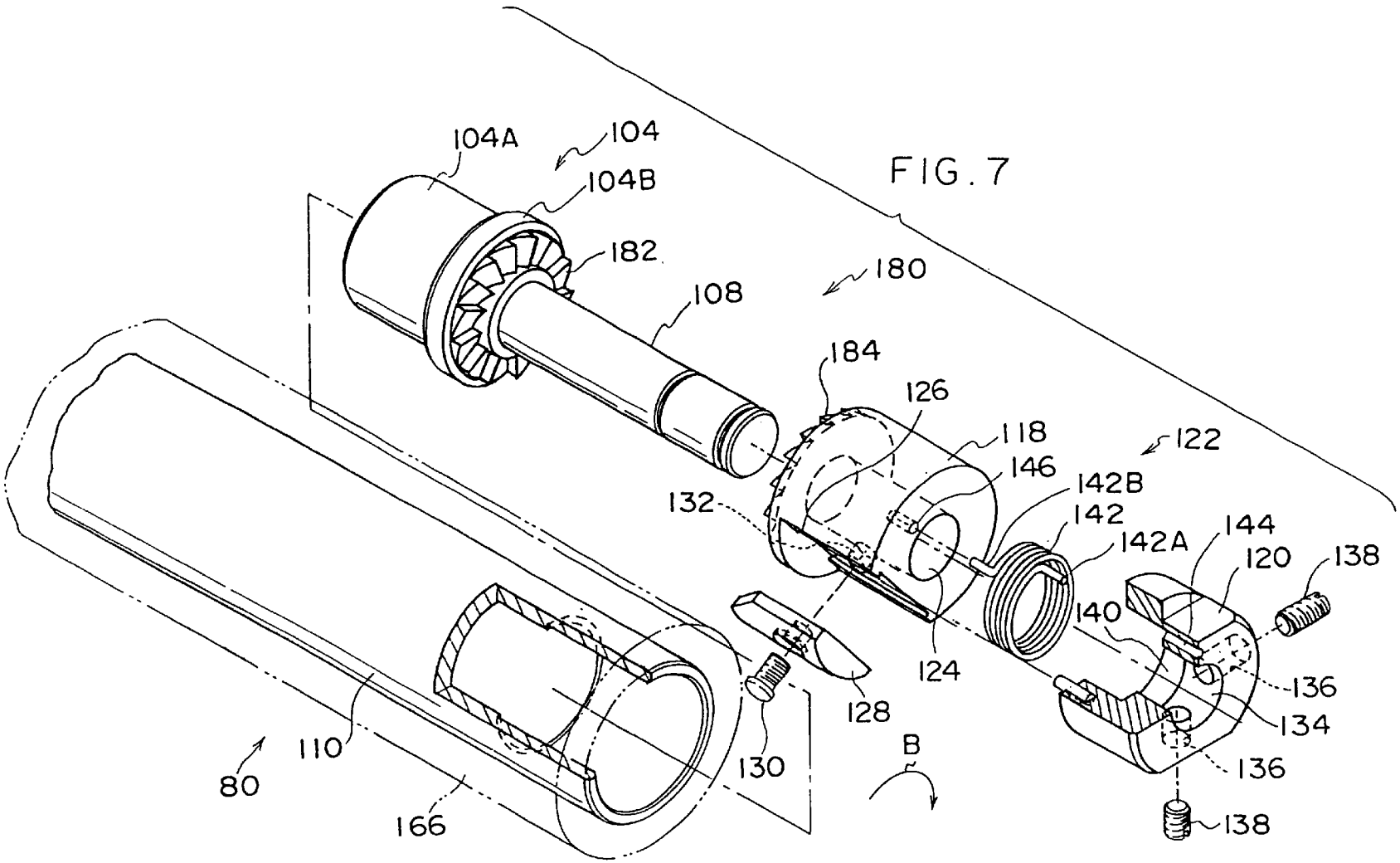
FIG. 7 is a schematic perspective view of one end side in an axial direction of a brush roller employing a ratchet mechanism corresponding to one embodiment of restricting means.

A ratchet mechanism 180 shown in FIG. 7 is constituted by a ratchet gear 182 formed in the flange portion 104B of the axial end member 104 and a ratchet gear 184 formed on an end surface in a side of the axial end member 104 of the holding member 118 opposing to the ratchet gear 182.

The holding member 118 is urged toward the axial end member 104 due to the urging force of the urging means (not shown), whereby the ratchet gears 182 and 184 are engaged with each other.

The ratchet mechanism 180 prevents the holding member 118 from relatively rotating in the direction opposite to the winding direction of the web body 166 with respect to the axial end member 104 by the ratchet gears 182 and 184 being relatively engaged with each other.

Further, the ratchet mechanism 180 is structured such that the holding member 118 can relatively rotate in the winding direction with respect to the axial end member 104, and when the elongation is generated in the web body 166 and the holding member 118 relatively rotates due to the urging force of the torsional coil spring 142, the engaging position of the ratchet gears 182 and 184 moves.

By using the ratchet mechanism 180 mentioned above, it is possible to securely prevent the slack from being generated due to the elongation of the web body 166 or the like while preventing the slack of the web body 166 due to the rotation of the holding member 118 in the direction opposite to the winding direction.

In this case, the ratchet gears 182 and 184 may be provided between the holding member 118 and the fastening member 120. Further, one of the ratchet gears 182 and 184 may be replaced by a ratchet pawl. Further, the ratchet mechanism corresponding to the restricting means is not limited to this, and an optional structure can be employed as far as the structure enabling the holding member 118 to relatively rotate in the winding direction between the holding member 118 and any one of the axial end member 104, the rotary shaft 108 and the fastening member 120 and preventing the relative rotation in the direction opposite to the winding direction.

Here, in the present embodiment, the description is given of the present invention with reference to the embodiment of the brush roller 80 provided in the PS printing plate processor 10, however, the brush roller employing the present invention is not limited to the PS printing plate such as a photo polymer plate, a thermal plate, a surface printing plate with no water and the like, and when a brush roller is used for brushing a surface of a photosensitive material in a photosensitive material processing apparatus for processing the other photosensitive material such as an X-ray film, a general black-and-white film, a color film, a black-and-white printing paper, a color printing paper and the like, the present invention can be applied to the brush roller.

That is, the present invention can be applied to the brush roller in the optionally structured photosensitive material processing apparatus without being limited to the PS printing plate processor.

As mentioned above, the present invention can securely prevent the web-like member from being slacked even when the elongation or the like is generated in the web-like member wound around the roller main body in a helical manner. Further, in accordance with the present invention, the shift in the direction opposite to the winding direction is prevented from being generated in the web-like member by forming the projection at the helical position on the peripheral surface of the roller main body, whereby it is possible to securely prevent a partly winding tightness or slack from being generated due to the shifting of the web-like member.

Therefore, in accordance with the present invention, there can be obtained an excellent effect that it is possible to securely prevent the rubbed surface irregularity or the like from being generated on the photosensitive material due to the slack or wind tightness of the web-like member wound around the roller main body in a helical manner.

<<Second Embodiment>>

A description will be given below of a second embodiment. With respect to the same elements and parts as those of the embodiment mentioned above, an overlapping description will be optionally omitted and a description will be mainly given of characteristic portions.

Figure 8:
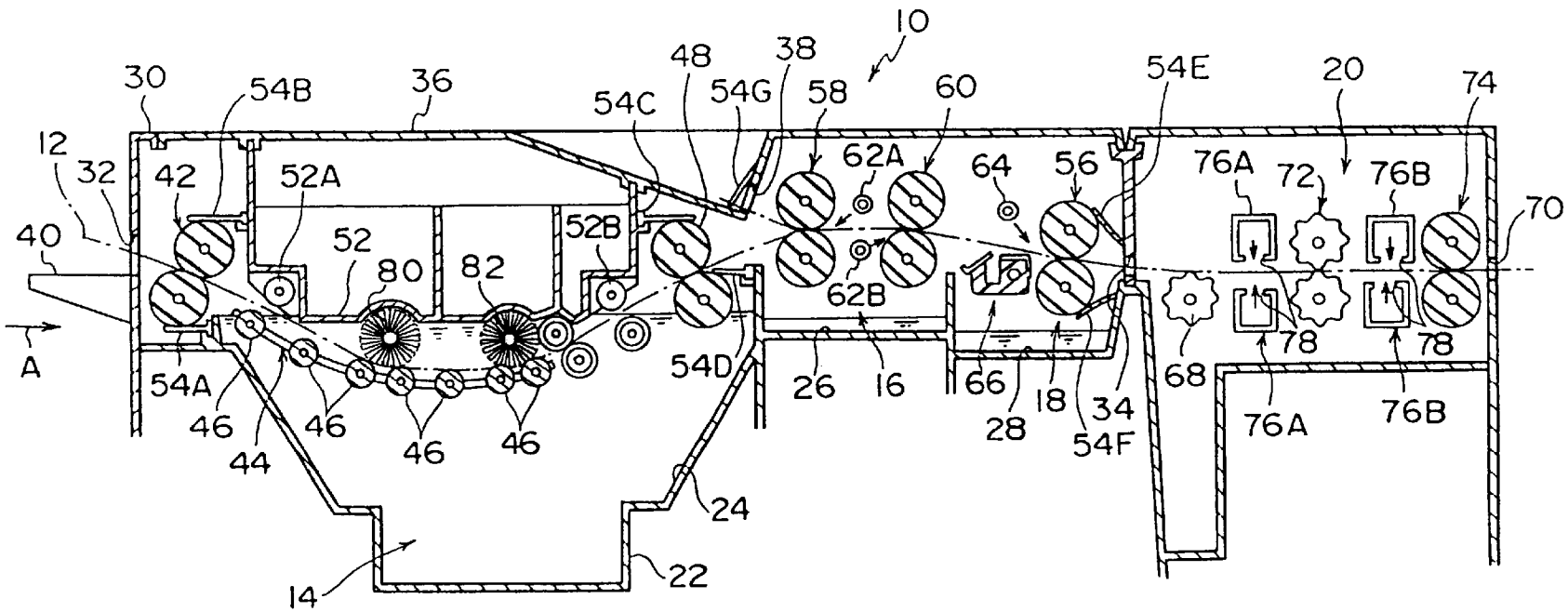
FIG. 8 is a schematic view of a whole of a PS printing plate processor in accordance with a second embodiment of the present invention.

With reference to FIG. 8, in the PS printing plate processor 10, the brush roller 80 and 82 are provided within the developing tank 24. The brush roller 80 and 82 are arranged along the transferring path of the PS printing plate 12, and respectively opposed to the surface of the photosensitive layer side of the PS printing plate 12. Accordingly, in the PS printing plate 12 transferred in the developing solution within the developing tank 24, the surface in the photosensitive layer side is brushed by the brush rollers 80 and 82, whereby the photosensitive layer swelled by the developing solution is promoted to be peeled.

In this case, a description will be given of the brush rollers 80 and 82 provided in the PS printing plate processor 10 with reference to FIG. 9 and FIGS. 10A to 10D. In this case, the basic structures of the brush rollers 80 and 82 are the same.

Figure 9:
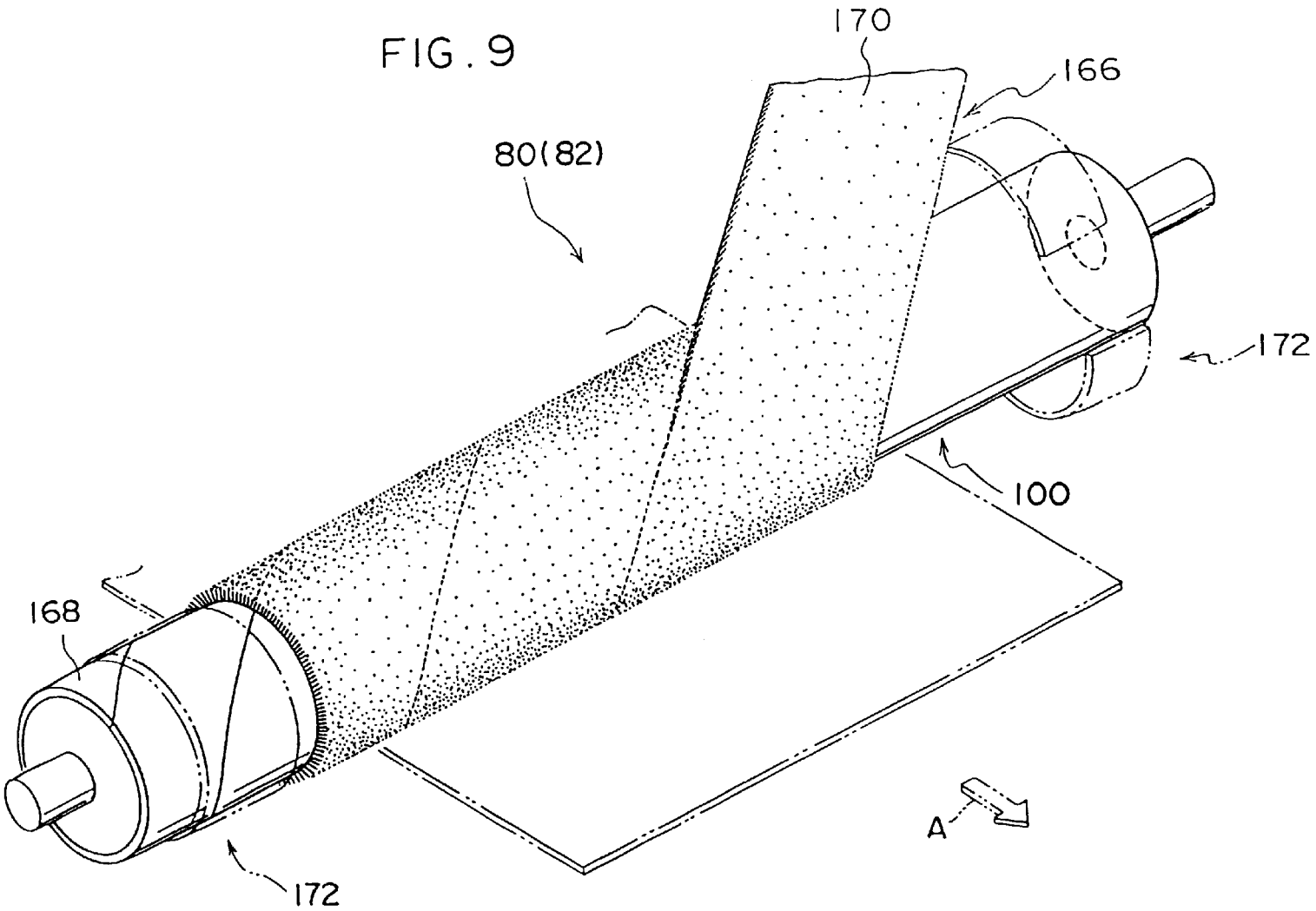
FIG. 9 is a schematic perspective view showing a brush roller in accordance with the present embodiment.

As shown in FIG. 9, the brush roller 80 is constituted by the roller main body 100 corresponding to a core material, and a web body for brushing 166 (hereinafter, simply refer to the web body 166) corresponding to the web-like member wound around the outer peripheral portion of the roller main body 100.

Figure 10A:
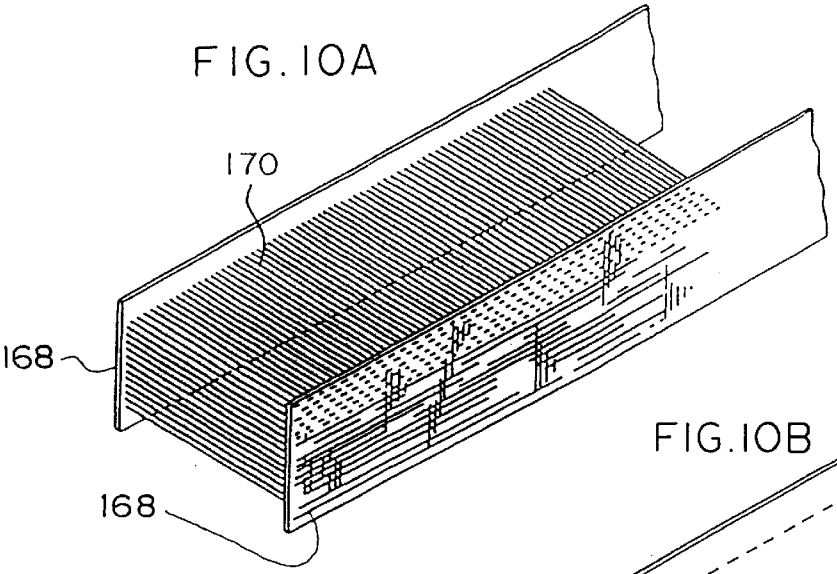
FIGS. 10A to 10D are flow views showing one embodiment of a manufacturing step of a web body.
Figure 10B:
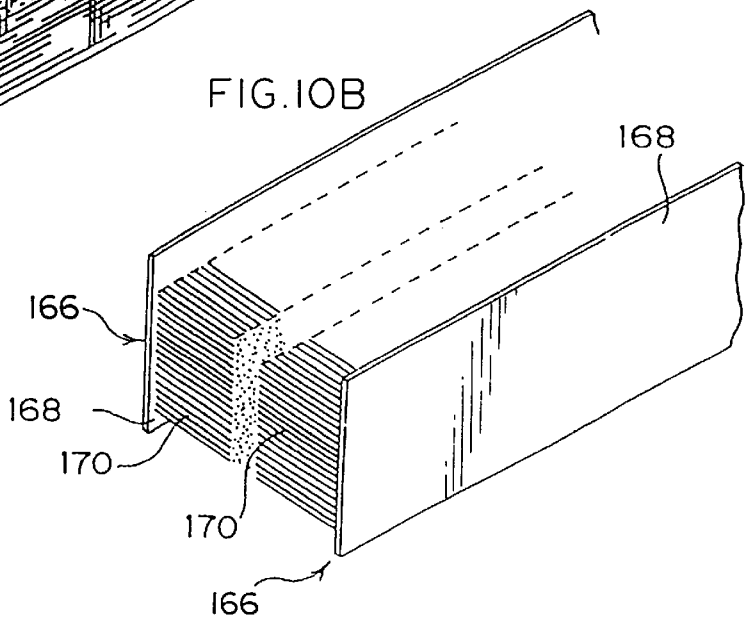
Figure 10D:
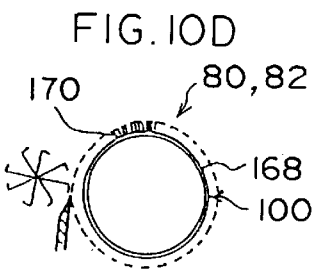
Figure 10C:
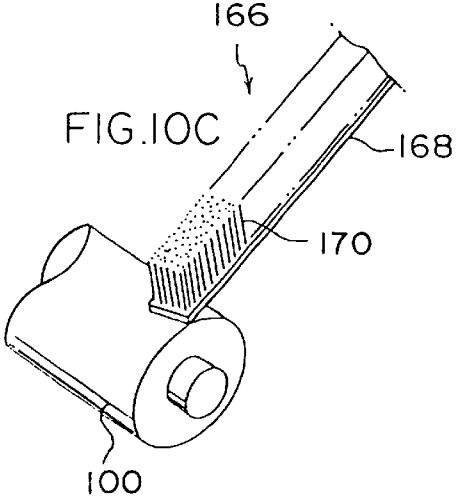

The web body 166, as shown in FIG. 10A, holds a pair of woven cloths 168 corresponding to a sheet-like base material in such a manner as to oppose to each other and weaves wire members 170 so as to extend over the woven cloths 168.

For the wire members 170, for example, a natural fiber or an artificial fiber is applied. In this case, the wire members 170 are not limited to the natural fiber and the artificial fiber, and a metal may be employed as far as having a suitable thinness. That is, as a material for the wire members 170, it is possible to employ a natural fiber such as a vegetable fiber, an animal fiber and the like, an artificial fiber such as a polyamide system including a nylon 6, a nylon 66, a nylon 6.10, a nylon 11 and the like, a polyester system including a polyethylene terephthalate, a polybutylene terephthalate and the like, a polyacrylic system including, a polyacrylonitrile, polyacrylic alkyl and the like, a polypropylene, a polystyrene and the like, and a metal fiber such as a stainless steel, a brass and the like.

In this case, the web body 166 (FIG. 10B) applied to the present embodiment is completed by weaving the wire materials 170 in the woven cloth 168 in a tensional state and thereafter cutting the wire members 170 at a middle portion thereof. The brush roller 80 is obtained by winding the web body 166 around a peripheral surface of the roller main body 164 in a helical manner (refer to FIG. 10C) and shirring so as to uniformly make up a length of the wire members 170 (refer to FIG. 10D).

As shown in FIG. 9, the brush roller 80 fixes the woven cloth 168 corresponding to the base material of the web body 166 to both end portions of the roller main body 100, for example, by winding a fastening band 172 from the above of the web body 166 wound in both end portions of the roller main body 100.

In this case, when fixing the web body 166 to the roller main body 100 by the fastening band 172, the web body 166 may be fixed by being fastened by the fastening band 172 in a state of weaving the wire members 170 in the woven cloth 168. However, as shown in FIG. 9, the web body 166 may be formed by cutting the wire members 170 in a predetermined area at both end portions of the web body 166 opposing to the fastening band 172 in accordance with a shining or the like or previously forming the woven cloth 168 without weaving the wire members 170 in the area opposing to both end portions of the roller main body 100.

Further, when fixing the web body 166 at the end portion of the roller main body 100 by using the fastening band 172, it is preferable to perform the fixing operation in a state of temporarily fixing the woven cloth 168 to the roller main body 100 by applying a slight amount of adhesive agent to the back surface side of the woven cloth 168 opposing to the peripheral surface of the axial end portion of the roller main body 100.

Further, as the brush rollers 80 and 82, it is possible to employ a structure obtained by fixing the web body 166 to the roller main body 100 by using optional fixing means in addition to the fastening band 172. Further, the brush roller 80 and 82 may be structured such as to be fixed by applying the adhesive agent or the like to the back surface side of the woven cloth 168 opposing to the peripheral surface of the roller main body 100 so as to bond to the roller main body 100, that is, the brush rollers 80 and 82 may be structured as far as the web body 166 is tightly wound around the roller main body 100 in a helical shape.

Figure 11:
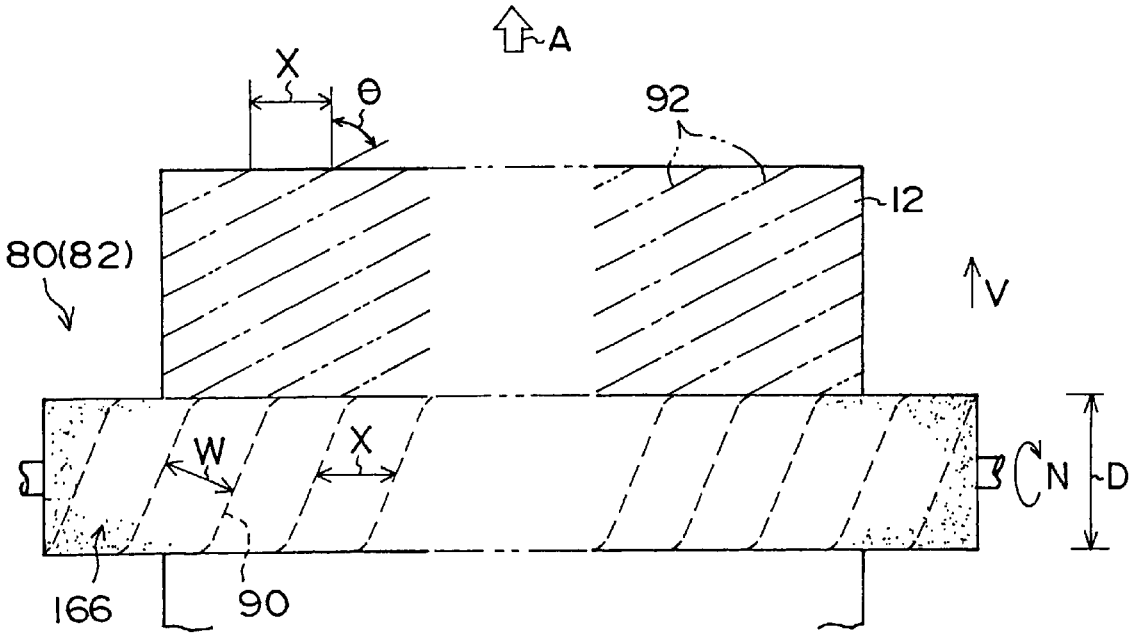
FIG. 11 is a schematic view of a surface of the PS printing plate showing one embodiment of a track on the PS printing plate of a boundary portion of the brush rollers.

On the other hand, as shown in FIG. 11, in the brush rollers 80 and 82 formed by winding the web body 166 around the roller main body 100 in a helical manner, a boundary portion (hereinafter, referred to as "boundary portion 90") between the adjacent web bodies 166 along the axial direction of the roller main body 100 is formed in a helical shape along the peripheral surface of the roller main body 100.

The boundary portion 90 of the web body 166 moves toward the downward side in the transferring direction of the PS printing plate 12 on the surface of the PS printing plate 12 while opposing to the surface of the PS printing plate 12 at a time of brushing the PS printing plate 12 by the brush rollers 80 and 82. Accordingly, as shown by a two-dot chain line in FIG. 11, a track 92 formed by an opposition of the boundary portion 90 on the surface of the PS printing plate 12 becomes an inclined stripe.

An angle θ of the track with respect to the transferring direction (the direction of an arrow A) of the PS printing plate 12 becomes 0 degrees (θ=0°) at a time of transferring the PS printing plate 12 without rotating the brush roller 80 and 82, and becomes substantially 90 degrees (θ=90°) at a time of stopping transferring the PS printing plate 12 and rotating the brush rollers 80 and 82.

Further, an interval between the tracks 92 along the width direction of the PS printing plate 12 becomes a value corresponding to a width W of the web body 166 and a winding angle of the web body 166 around the roller main body 100 (X=f (W)). That is, the track 92 has the interval X corresponding to the width W of the web body 166 and the angle θ corresponding to a transferring speed V of the PS printing plate 12, an outer diameter D of the brush roller 80 (82) and a rotational speed N thereof.

On the other hand, in this boundary portion 90, since a density of the wire members 170 becomes smaller (lower) than that of the peripheral portion, the track 92 easily appears as the rubbed surface irregularity on the surface of the PS printing plate 12 at a time of brushing the surface of the PS printing plate 12 by the brush rollers 80 and 82. In particular, in the case that it is necessary to brush at a higher contact pressure of the wire members 170 against the printed surface, such in the photo polymer plate, the track 92 appears as the rubbed surface irregularity on the PS printing plate 12, thereby tending to reduce a finish quality of the PS printing plate 12 processed by the PS printing plate processor 10.

Here, in the PS printing plate processor 10, two brush rollers 80 and 82 are arranged in the side of the photosensitive layer of the PS printing plate 12 along the transferring path of the PS printing plate 12 and the surface of the photosensitive layer side of the PS printing plate 12 is brushed by the brush rollers 80 and 82, thereby promoting a removal of the unnecessary photosensitive layer from the surface of the PS printing plate 12, and canceling the respective tracks 92 between the brush rollers 80 and 82, so that it is intended to prevent the rubbed surface irregularity generated by the boundary portion 90 from appearing on the surface of the PS printing plate 12.

A description will be given of a structure in which a rubbed surface irregularity is prevented from appearing on the surface of the PS printing plate 12 by canceling the respective tracks 92 by two brush rollers 80 and 82 with reference to the following embodiment examples 1 to 5.

EMBODIMENT EXAMPLE 1

Figure 12:
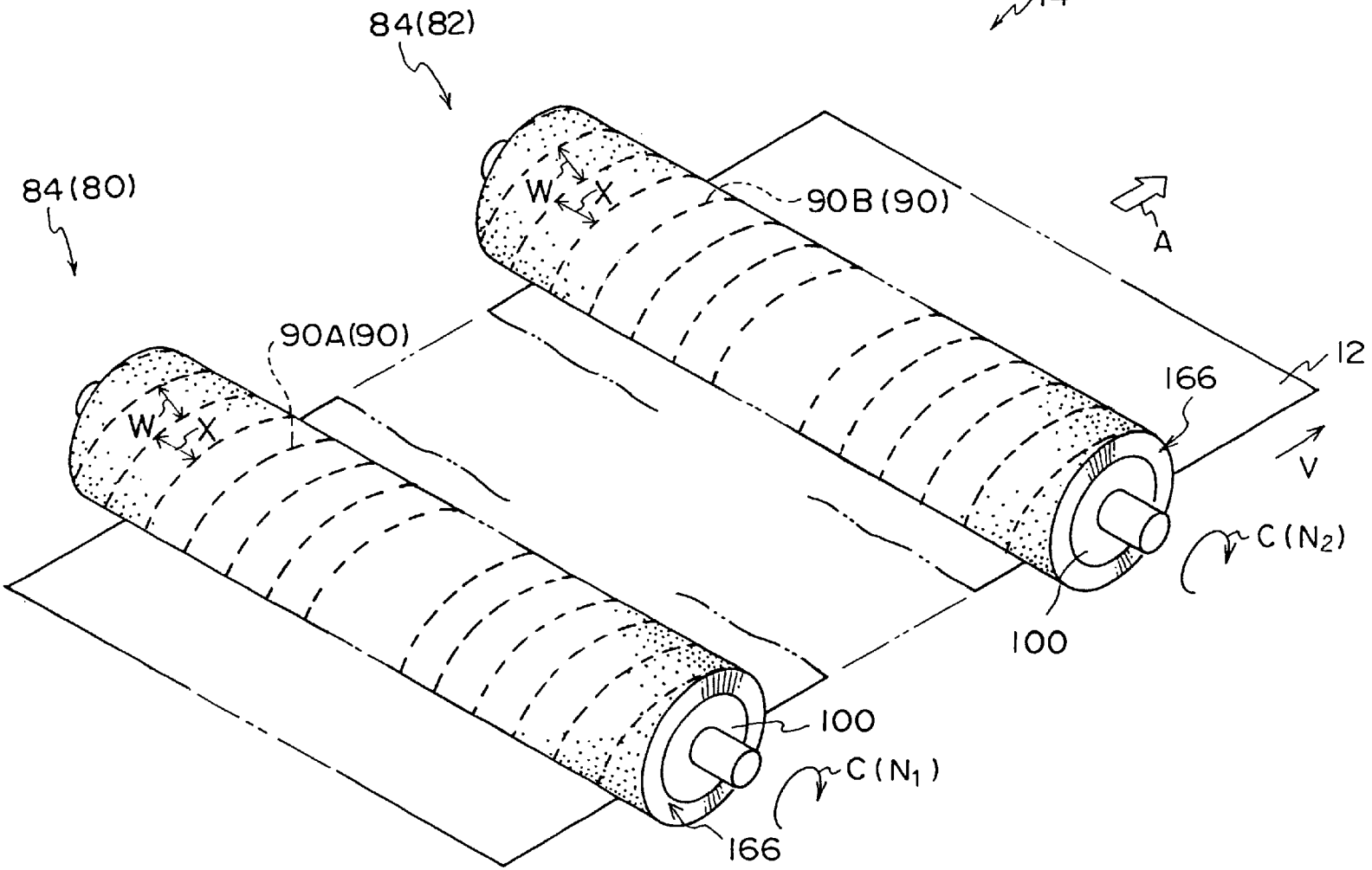
FIG. 12 is a schematic view showing an arrangement of the brush roller in accordance with an embodiment example 1.

FIG. 12 shows an arrangement of the brush rollers 80 and 82 applied to an embodiment example 1. In the embodiment example 1, brush rollers 84 having the same shape and in which the web body 166 having a width W is wound around the roller main body 164 in a helical manner are employed as the brush rollers 80 and 82. Accordingly, in the brush rollers 80 and 82, a boundary portion 90 is formed in a helical manner at the interval W.

In the developing portion 14, two brush rollers 84 (80 and 82) are rotated in the same direction (for example, in a direction of an arrow C) at a time of transferring the PS printing plate 12 at a speed V (mm/min). At this time, in the embodiment example 1, the rotational speed N is changed between two brush rollers 84.

For example, while the structure is made such that the brush roller 84 used as the brush roller 80 is rotated at a rotational speed N1 (r/min), the brush roller 84 used as the brush roller 82 is rotated at a rotational speed N2 larger than the rotational speed $N_1$ ($N_1<N_2$). In this case, the rotational speed N can be changed by using an optional method, for example, changing a gear ratio for transmitting a drive force.

In the developing portion 14 using the brush rollers 80 and 82, the photosensitive layer surface of the PS printing plate 12 is brushed by the brush roller 80 and next brushed by the brush roller 82.

Figure 13:
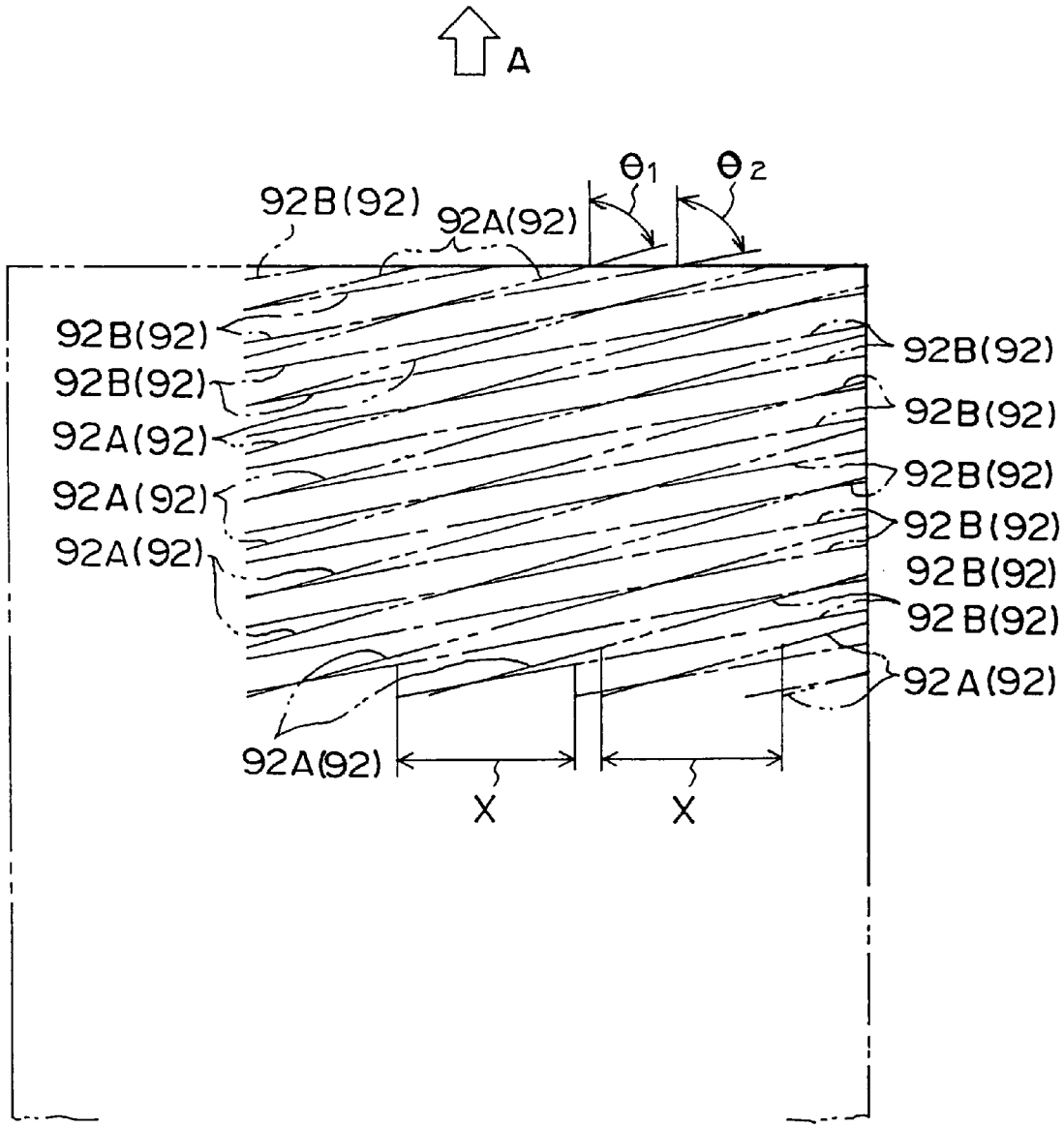
FIG. 13 is a schematic view showing one embodiment of the track by the boundary portion in accordance with the embodiment example 1.

In this case, as shown in FIG. 13, on the assumption that the track 92 structured such that a boundary portion 90A of the brush roller 80 opposes to the surface of the PS printing plate 12 is set to a track 92A, and the track structured such that a boundary portion 90B of the brush roller 82 opposes to the surface of the PS printing plate 12 is set to a track 92B, since the width W of the web body 166 is the same between the brush rollers 80 and 82, the track 92A and the track 92B respectively have the interval X.

On the other hand, in the brush rollers 80 and 82, the rotational directions are the same but the rotational speeds N are different. Accordingly, an angle $\theta_1$ of the track 92A and an angle $\theta_2$ of the track 92B are different. Accordingly, the brush rollers 80 and 82 form different track patterns on the surface of the PS printing plate 12.

At this time, since the rotational speed $N_2$ of the brush roller 82 is greater than the rotational speed $N_1$ of the brush roller 80 ($N_1<N_2$), the angle $\theta_1$ of the track 92A becomes smaller than the angle $\theta_2$ of the track 92B ($\theta_1<\theta_2$). Accordingly, the tracks 92A and 92B do not cross and overlap with each other on the PS printing plate 12.

Accordingly, it is possible to prevent the rubbed surface irregularity from appearing on the PS printing plate 12 due to the overlap between the track 92A formed by the brush roller 80 and the track 92B formed by the brush roller 82 on the PS printing plate 12, and it is possible to brush so as to cancel the mutual tracks 92A and 92B by the brush roller 80 and 82.

In this case, the difference between the rotational speeds $N_1$ and $N_2$ of the brush rollers 80 and 82 can be optionally set, however, a larger one is preferable. By increasing the difference between the rotational speeds $N_1$ and $N_2$, the difference between the angle $\theta_1$ of the track 92A and the angle $\theta_2$ of the track 92B is increased, so that it is possible to more securely prevent the rubbed surface irregularity from appearing (coming into prominence).

Further, in the embodiment example 1, the rotational speed $N_2$ of the brush roller 82 is made larger than the rotational speed $N_1$ of the brush roller 80 ($N_1<N_2$), however, the rotational speed $N_1$ of the brush roller 80 may be made larger than the rotational speed $N_2$ of the brush roller 82 ($N_1>N_2$).

EMBODIMENT EXAMPLE 2

Figure 14:
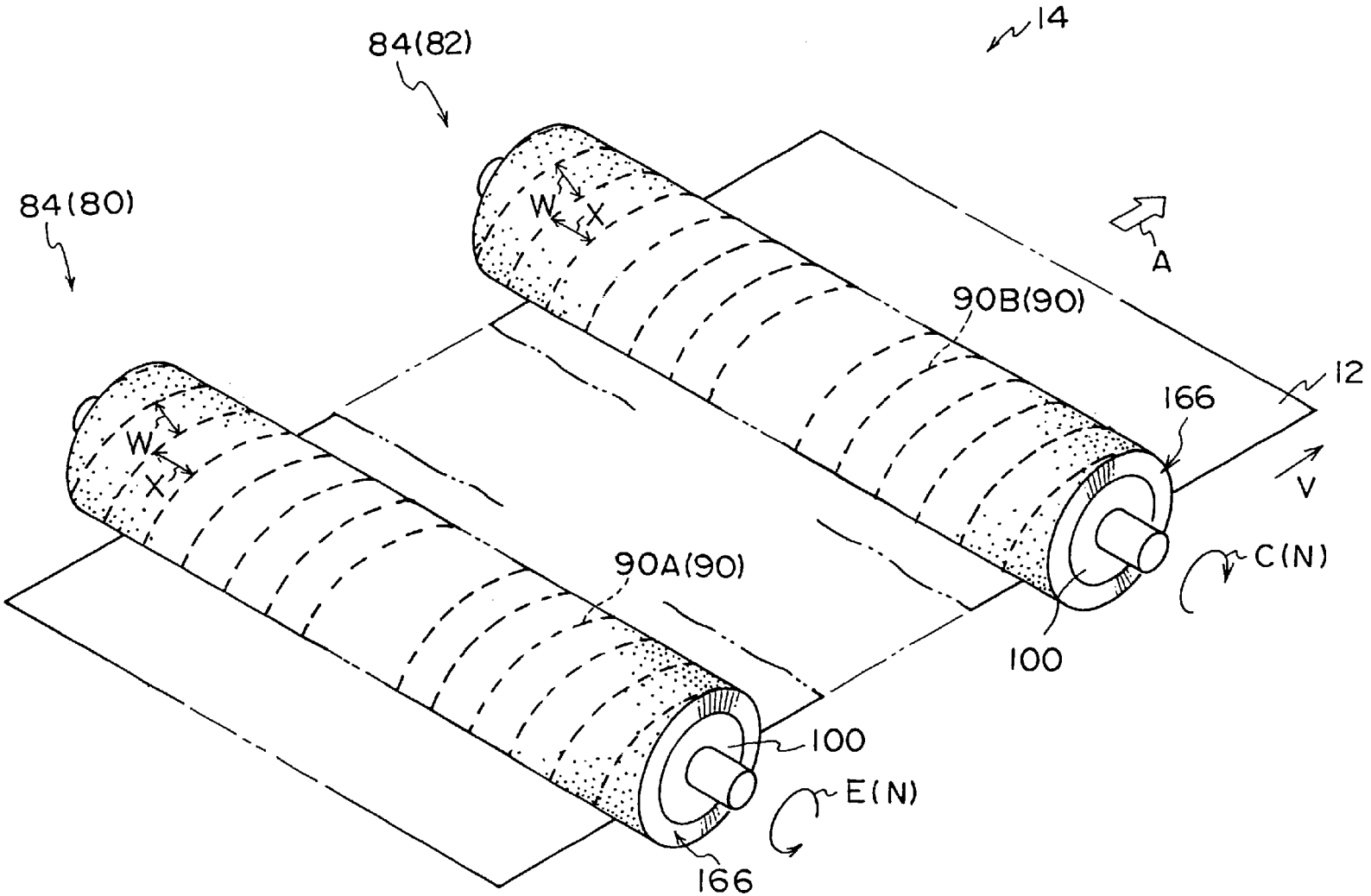
FIG. 14 is a schematic view showing an arrangement of the brush roller in accordance with an embodiment example 2.

FIG. 14 shows an arrangement of the brush rollers 80 and 82 applied to an embodiment example 2. In this embodiment example 2, the brush rollers 84 are employed for the brush rollers 80 and 82, further while the rotational speed N is changed between the brush rollers 80 and 82 in the embodiment example 1, the rotational direction is changed between the brush rollers 80 and 82 in the embodiment example 2.

That is, in the embodiment example 2, when the brush rollers 84 used as the brush rollers 80 and 82 are rotated at the rotational speed N, the brush roller 84 used as the brush roller 82 is rotated in a direction of an arrow C and on the other hand, the brush roller 84 used as the brush roller 80 is rotated in a direction of an arrow E corresponding to an opposite direction to the direction of the arrow C. In this case, the rotational direction between two brush rollers 84 is changed by using an optional method of changing a gear number at a time of transmitting the drive force or the like.

Figure 15:
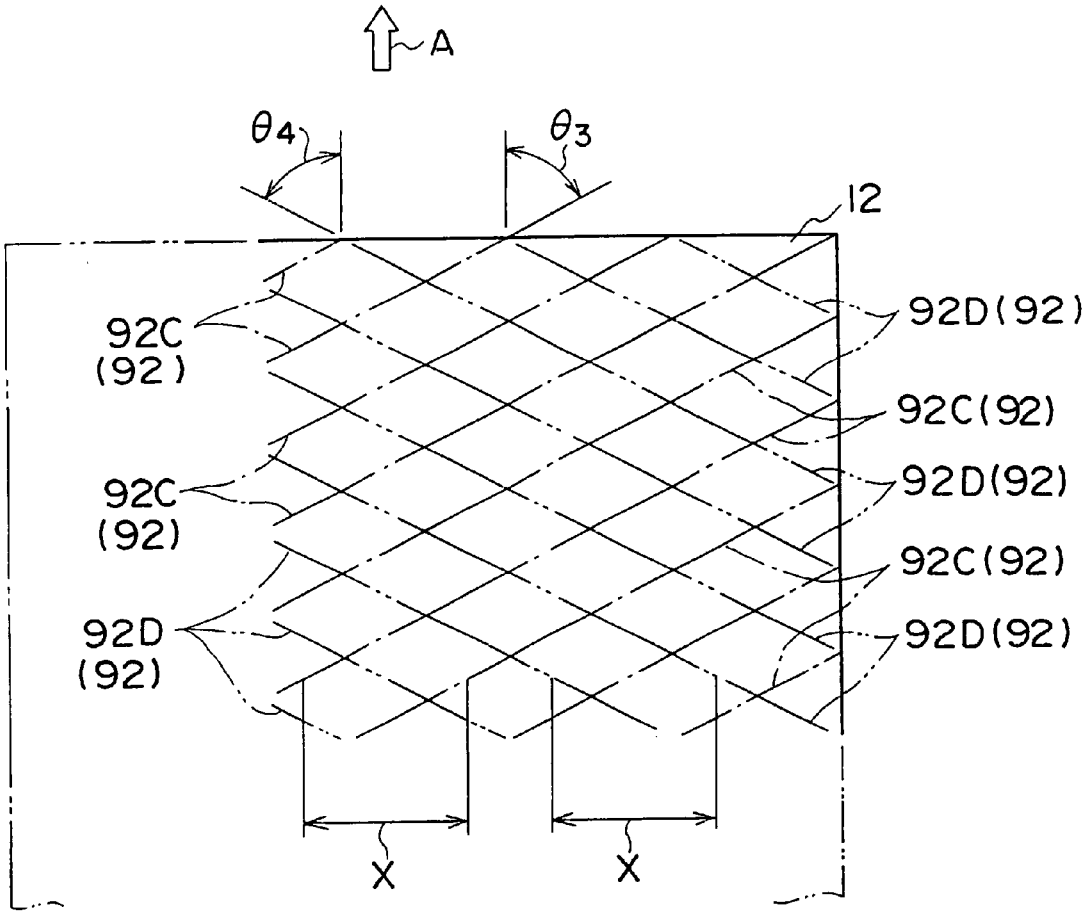
FIG. 15 is a schematic view showing one embodiment of the track by the boundary portion in accordance with the embodiment example 2.

Accordingly, as shown in FIG. 15, on the assumption that the track 92 in which the boundary portion 90 of the brush roller 80 opposes to the surface of the PS printing plate 12 is set to a track 92D and the track in which the boundary portion 90 of the brush roller 82 opposes to the surface of the PS printing plate is set to a track 92C, between the brush rollers 80 and 82, since the width W of the web body 166 is constant, the respective intervals X are the same between the track 92C and the track 92D.

On the other hand, in the brush rollers 80 and 82, the rotational directions are different. Accordingly, the directions of incline are different between the track 92C and 92D. That is, the track 92C formed by the brush roller 82 is inclined rightward with respect to the transferring direction of the PS printing plate 12 at an angle $\theta_3$, on the other hand, the track 92D formed by the brush roller 80 is inclined leftward with respect to the transferring direction of the PS printing plate 12 at an angle $\theta_4$. Accordingly, the brush rollers 80 and 82 form the different track patterns on the surface of the PS printing plate 12.

At this time, the tracks 92C and 92D do not overlap with each other on the PS printing plate 12.

Accordingly, it is possible to prevent the rubbed surface irregularity from appearing on the PS printing plate 12 due to the overlapping on the PS printing plate 12 between the track 92D formed by the brush roller 80 and the track 92C formed by the brush roller 82, whereby it is possible to brush so as to cancel the respective tracks 92 (92D and 92C) by the brush rollers 80 and 82.

In this case, it is sufficient that the rotational directions of the brush rollers 80 and 82 are different from each other, and are not limited to the present embodiment.

EMBODIMENT EXAMPLE 3

Figure 16:
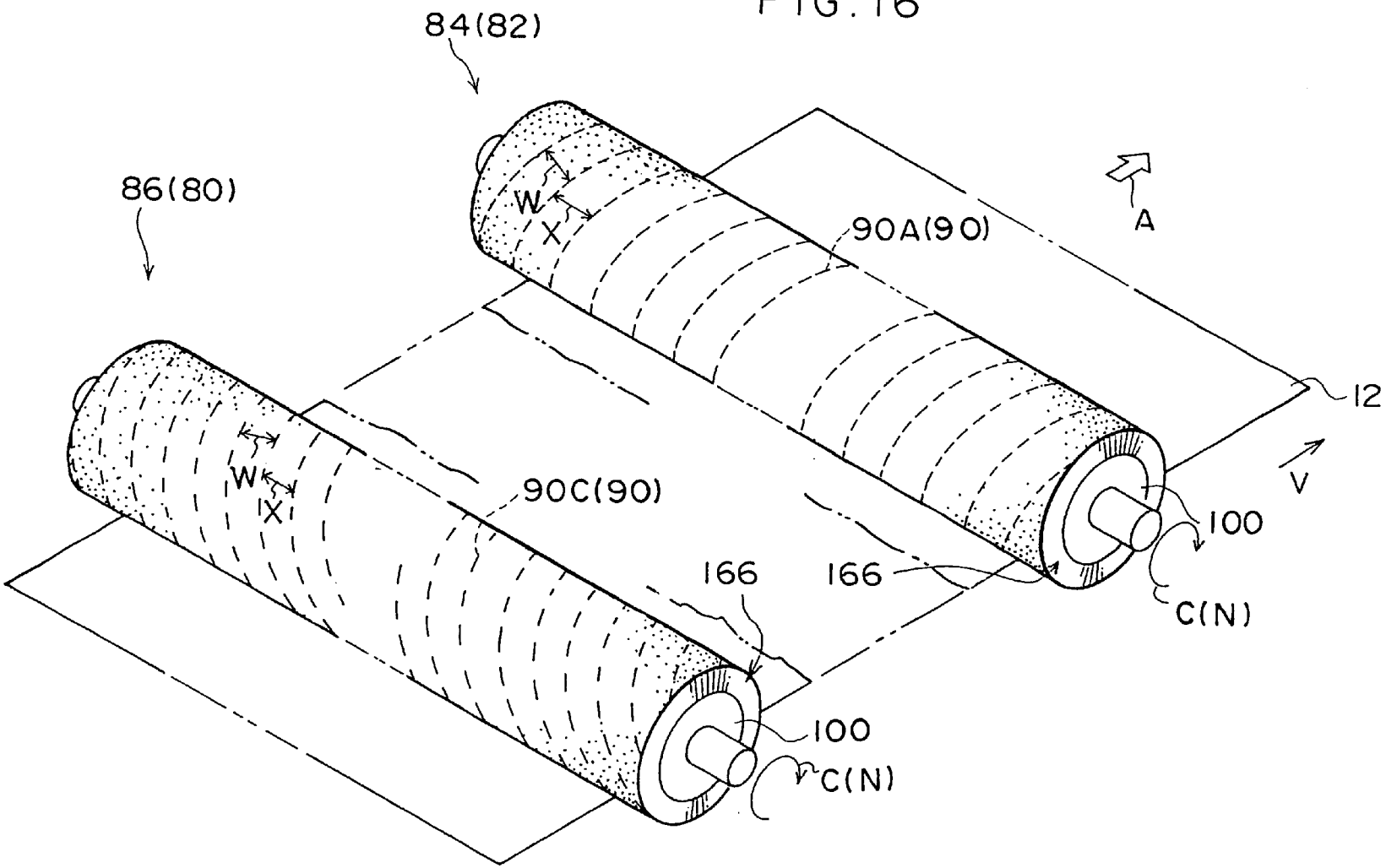
FIG. 16 is a schematic view showing an arrangement of the brush roller in accordance with an embodiment example 3.

FIG. 16 shows an arrangement of the brush rollers 80 and 82 applied to the embodiment example 3. In the embodiment example 3, the brush roller 84 is used as the brush roller 82 and a brush roller 86 is used as the brush roller 80.

The brush roller 86 is structured such that the winding direction of the web body 166 around the roller main body 164 is changed with respect to that of the brush roller 84. That is, the brush roller 84 is structured such that the web body 166 is wound around the roller main body 100 in a counterclockwise direction as seen from a right side of the paper surface of FIG. 16, and on the other hand, the brush roller 86 is structured such that the web body 166 is wound in a clockwise direction as seen from a right side of the paper surface of FIG. 16.

Accordingly, in the brush roller 86, a boundary portion 90C formed in a helical shape in an opposite direction to that of the boundary portion 90A of the brush roller 84 is provided.

As mentioned above, in the embodiment example 3, the winding directions of the web body 166 are changed between two brush rollers 80 and 82.

In the developing portion 14 using the brush rollers 80 (86) and 82 (84) structured in the manner mentioned above, the brush rollers 80 and 82 are rotated in the same direction (for example, in the direction of the arrow C) at the substantially same rotational speed N while the PS printing plate 12 is transferred at a transferring speed V, and the photosensitive layer surface of the PS printing plate 12 is at first brushed by the brush roller 80 and next, brushed by the brushing roller 82.

Accordingly, the pattern of the track similar to the embodiment example 2 can be obtained on the surface of the PS printing plate 12 (refer to FIG. 15). That is, the track 92 of the boundary portion 90A of the brush roller 82 becomes the track 92C. On the other hand, the track 92 of the brush roller 86 used as the brush roller 80 with respect to the boundary portion 90C is inclined in a left side with respect to the transferring direction of the PS printing plate 12 at the interval X and similar to the track 92D.

Accordingly, even when it is intended to rotate the brush rollers 84 (82) and 86 (80) in the same direction by using the brush rollers 84 (82) and 86 (80) having the different winding directions of the web body 166, the respective tracks 92 do not overlap with each other on the PS printing plate 12.

Accordingly, it is possible to brush by two brush rollers 80 and 82 so as to cancel the track 92 with respect to the respective boundary portion 90 so as to prevent the rubbed surface irregularity from appearing on the PS printing plate 12. In this case, it is a matter of course that the brush roller 84 may be used as the brush roller 80 and the brush roller 86 may be used as the brush roller 82.

EMBODIMENT EXAMPLE 4

Figure 17:
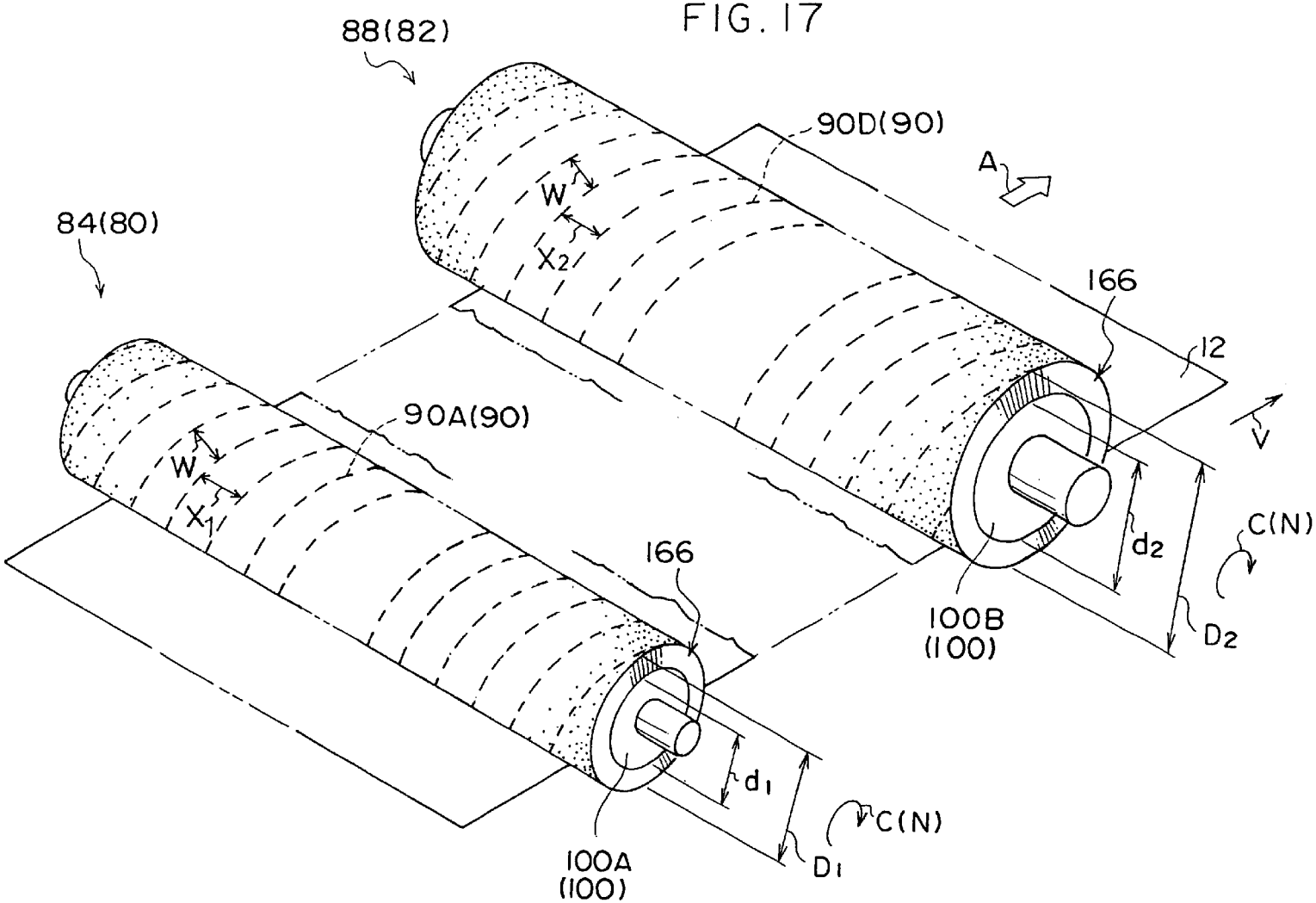
FIG. 17 is a schematic view showing an arrangement of the brush roller in accordance with an embodiment example 4.

FIG. 17 shows an arrangement of the brush rollers 80 and 82 applied to an embodiment example 4. In the embodiment example 4, the brush roller 84 is used as the brush roller 80 and a brush roller 88 is used as the brush roller 82.

The brush roller 88 employs a roller main body 100B having a larger outer diameter than that of the roller main body 100A of the brush roller 84, as the roller main body 100. That is, the brush roller 88 employs the roller main body 100B having an outer diameter $d_2$ larger than an outer diameter $d_1$ of the roller main body 100A ($d_1<d_2$), and is structured such that the web body 166 is wound around the roller main body 100B in a helical manner. Accordingly, an outer diameter $D_2$ of the brush roller 88 is made larger than an outer diameter $D_1$ of the brush roller 84 ($D_1<D_2$).

In the developing portion 14, the brush rollers 84 and 88 are rotated in the same direction (for example, in a direction of an arrow C) at the same rotational speed N while the PS printing plate 12 is transferred at the transferring speed V, and the photosensitive layer surface of the PS printing plate 12 is at first brushed by the brush roller 84 used as the brush roller 80 and next brushed by the brush roller 88 used as the brush roller 82.

In the case of brushing the PS printing plate 12 by the brush rollers 84 and 88 having the different outer diameters, since the width W of the web body 166 is the same, an interval $X_1$ of the track 92 formed by the boundary portion 90A of the brush roller 84 becomes wider than an interval $X_2$ of the track 92 formed by the boundary portion 90D of the brush roller 88 ($X_1>X_2$). Further, since the winding direction of the web body 166 and the rotational directions of the brush rollers 84 and 88 are the same, the direction of incline of the track 92 becomes constant.

On the other hand, since the winding angle of the web body 166 of the brush roller 88 becomes smaller than the winding angle of the web body 166 of the brush roller 84, the angle θ of the track 92 formed by the boundary portion 90C of the brush roller 88 becomes larger than the angle θ of the track 92 formed by the boundary portion 90A of the brush roller 84.

That is, when the brush rollers 84 and 88 having the different outer diameters are used as the brush rollers 80 and 82, it is possible to obtain a pattern of the track 92 similar to that of the FIG. 13 in the embodiment example 1.

Accordingly, two patterns of tracks 92 in which the track 92 of the brush roller 80 (84) and the track 92 of the brush roller 82 (88) cross to each other are formed on the PS printing plate 12, whereby it is possible to brush so as to cancel the respective tracks 92 formed by the mutual boundary portions 90. Accordingly, in the embodiment example 4, it is possible to prevent the rubbed surface irregularity from appearing on the PS printing plate 12.

Figure 18:
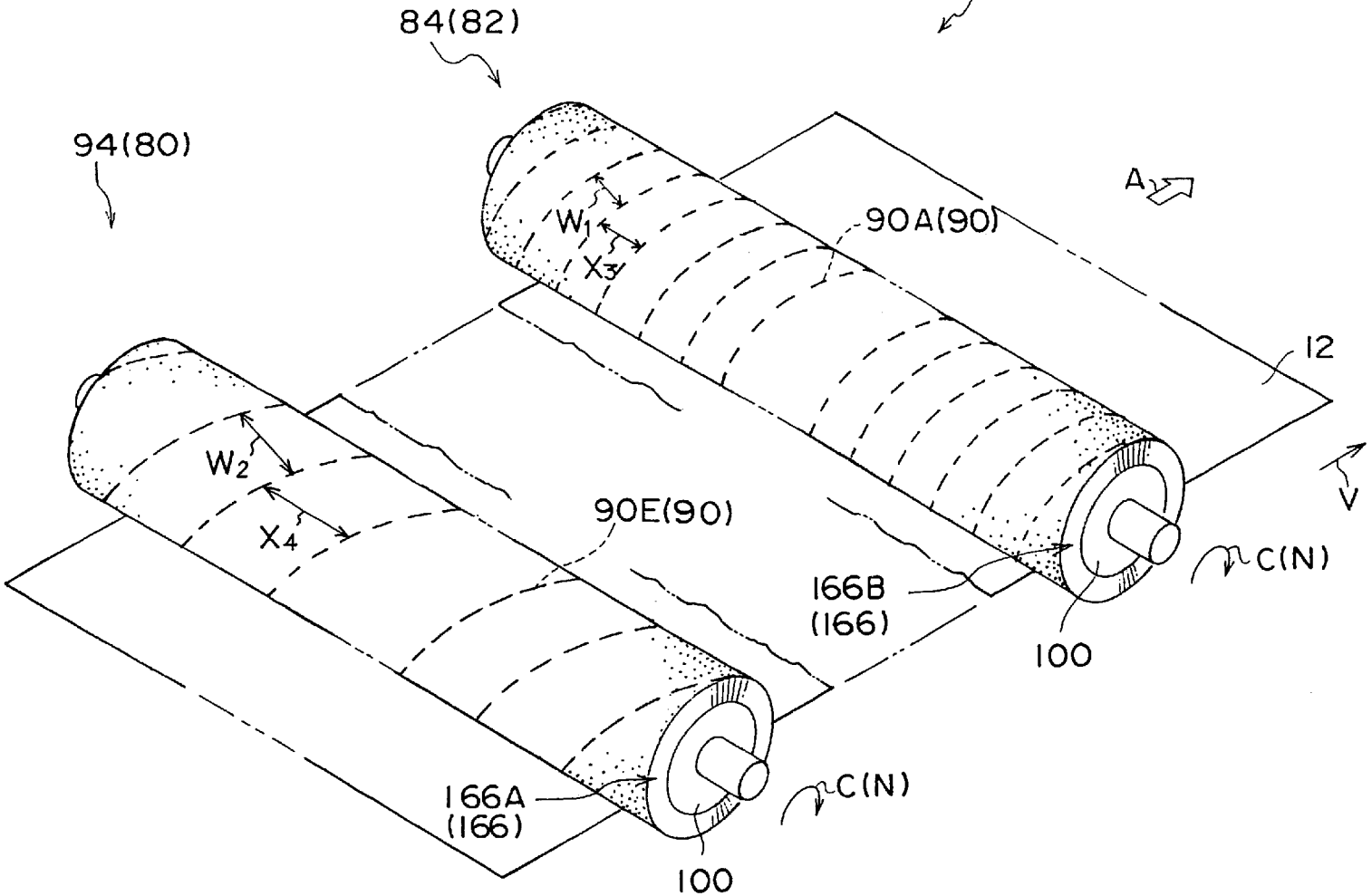
FIG. 18 is a schematic view showing an arrangement of the brush roller in accordance with an embodiment example 5.

FIG. 18 shows an arrangement of the brush roller 80 and 82 applied to an embodiment example 5. In this embodiment example 5, the brush roller 84 is used as the brush roller 82 and a brush roller 94 is used as the brush roller 80.

The brush roller 84 is structured such that a web body 166B having a width W1 is wound in a helical manner, on the other hand, the brush roller 94 is structured such that a web body 166A formed so as to have a larger width $W_2$ than the width $W_1$ ($W_1<W_2$) is wound around the roller main body 164 in a helical manner. That is, in the embodiment example 5, the width of the web body 166 is changed between the brush rollers 80 and 82.

Accordingly, in the brush roller 84 used as the brush roller 82, a boundary portion 90A having an interval $X_3$ is formed in a helical manner, on the other hand, in the brush roller 94 used as the brush roller 80, a boundary portion 90E having an interval $X_4$ is formed in a helical manner.

In the developing portion 14 in which the brush rollers 94 and 84 are used as the brush rollers 80 and 82, the photosensitive layer surface of the PS printing plate 12 is at first brushed by the brush roller 94 and next brushed by the brush roller 84. At this time, in the developing portion 14, the brush rollers 84 and 94 are rotated in the same rotational direction (for example, in a direction of an arrow C) at the same rotational speed N while the PS printing plate 12 is transferred at the transferring speed V, whereby the PS printing plate is brushed.

In this case, the rotational speed N, the rotational direction (the direction of the arrow C) and the transferring speed V of the PS printing plate 12 are the same between the brush rollers 84 and 94. Accordingly, an angle θ of the track 92 formed by the boundary portion 90E of the brush roller 94 becomes larger than an angle θ of the track 92 formed by the boundary portion 90A of the brush roller 84 (not shown).

On the other hand, while the web body 166B wound around the roller main body 164 of the brush roller 84 has the width $W_1$, the web body 166A wound around the roller main body 164 of the brush roller 94 has the width $W_2$. Accordingly, while the track 92 formed by the boundary portion 90A of the brush roller 84 has an interval $X_3$, the track 90 formed by the boundary portion 90E of the brush roller 94 has an interval X4 larger than the interval $X_3$ ($X_3<X_4$). That is, the tracks 92 of patterns having the different intervals X are formed on the PS printing plate 12.

Accordingly, it is possible to brush so as to prevent the mutual tracks 92 from overlapping with each other between the brush roller 80 using the brush roller 94 and the brush roller 82 using the brush roller 84.

Accordingly, it is possible to prevent the stripe-shaped rubbed surface irregularity from appearing on the PS printing plate 12 and it is possible to prevent the finish quality of the PS printing plate 12 caused by the boundary portion 90 of the web body 166 from being deteriorated.

As mentioned above, in the PS printing plate processor 10, it is possible to securely prevent the track 92 formed by the boundary portion 90 from appearing as the rubber surface irregularity on the surface of the PS printing plate 12 by changing any one of the rotational speed, the rotational direction, the outer diameter, the winding direction of the web body 166 and the width of the web body 166 between the brush rollers 80 and 82 at a time of brushing the PS printing plate 12 with using two brush rollers 80 and 82, thereby making the patterns of the respective tracks 92 formed on the PS printing plate 12 due to the boundary portion 90 of the web body 166 caused by the brush rollers 80 and 82 different.

Accordingly, in the PS printing plate processor 10, it is possible to securely prevent the finish quality of the PS printing plate 12 from being reduced, the deterioration being generated due to generation of the rubbed surface irregularity on the surface of the PS printing plate 12 by the boundary portion 90 of the web body 16 wound around the roller main body 100 in a helical manner.

In this case, in the present embodiments mentioned above, the structure is made such that two brush rollers 80 and 82 are provided, and any one of the rotational speed, the rotational direction, the outer diameter, the winding direction of the web body 166 and the width of the web body 166 is changed between the brush rollers 80 and 82, however, the structure may be, for example, made such that these changing conditions are combined such as the width of the web body 166 and the rotational speed are changed, or the like. Accordingly, it is possible to more securely prevent the track 92 formed by the boundary portion 90 of the web body 166 from appearing as the rubbed surface irregularity on the surface of the PS printing plate 12 so as to reduce the finish quality of the PS printing plate 12.

Further, in the present embodiment, the description is given of the embodiment having two brush rollers 80 and 82, however, the present embodiment can be applied to a case of brushing the photosensitive layer surface of the PS printing plate 12 by three or more brush rollers. At this time, it is sufficient that the structure may be made such that the track 92 formed by the boundary portion 90 of the web body 166 has at least two patterns by changing at least one condition among the rotational speed, the rotational direction, the outer diameter, the winding direction of the web body 166 and the width of the web body 166 between at least two brush rollers, and it is preferably that the respective brush rollers form the different track patterns on the surface of the PS printing plate 12 by changing at least one condition among the rotational speed, the rotational direction, the outer diameter, the winding direction of the web body 166 and the width of the web body 166 between all the brush rollers.

Next, a description will be given of a modified embodiment.

Figure 19:
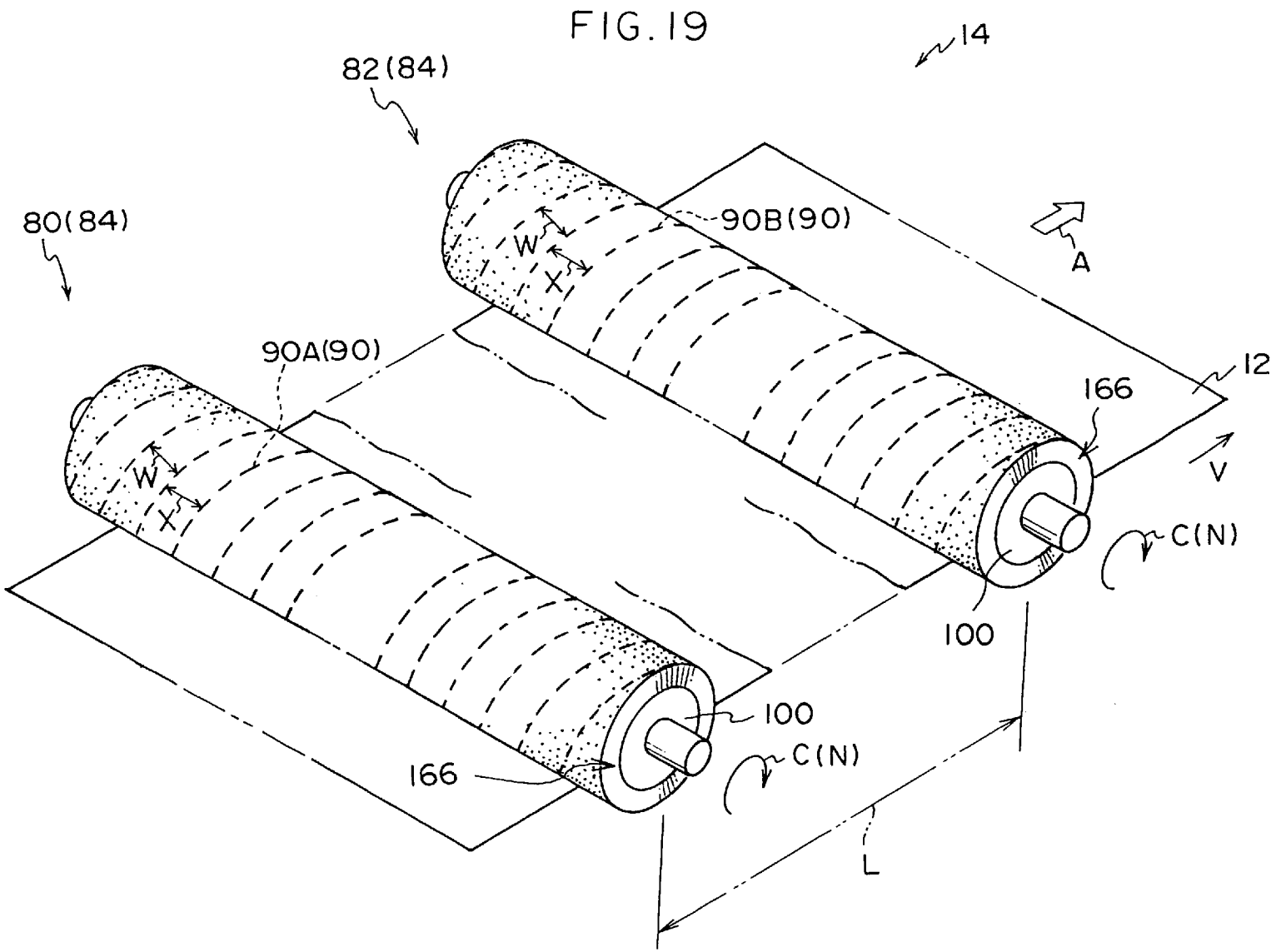
FIG. 19 is a schematic view showing an arrangement of the brush roller in accordance with a modified embodiment.

FIG. 19 shows a schematic arrangement of the brush rollers 80 and 82 in accordance with the modified embodiment. The brush rollers 84 are employed as the brush rollers 80 and 82. Accordingly, the tracks 92 on the PS printing plate 12 caused by the boundary portions 90 of the brush rollers 80 and 82 become the patterns having the same angle of incline with respect to the transferring direction of the PS printing plate 12.

On the other hand, the brush rollers 80 and 82 are arranged along the transferring path of the PS printing plate 12 at a distance L (mm). Accordingly, it is possible to express the number M at which the brush roller 80 rotates after the front end of the PS printing plate 12 transferred along the transferring path is in contact with the brush roller 80 before being in contact with the brush roller 82, by rotating the brush rollers 80 and 82 at the rotational speed N (r/min) with transferring the PS printing plate 12 at the transferring speed V (mm/min) by the following formula.

$$M=L\cdot N/V$$

The brush roller 84 rotates in the direction of the arrow C, whereby the track 92 is formed on the PS printing plate 12 at the interval X.

In this case, for example, by rotating the brush roller 84 in a state of contacting the brush roller 84 with the PS printing plate 12, the position at which the boundary portion 90 is in contact with the PS printing plate 12 moves in the width direction of the PS printing plate 12. That is, the contact position of the boundary portion 90 of the brush roller 84 with the PS printing plate 12 is shifted in correspondence to the rotational position of the brush roller 84.

In this case, when the position at which the end portion of the boundary portion 90A of the web body in the end portion in the axial direction of the brush roller 84 used as the brush roller 80 is in contact with the PS printing plate 12 coincides with the position at which the end portion of the boundary portion 90B of the web body 166 in the end portion in the axial direction of the brush roller 84 used as the brush roller 82 is in contact with the PS printing plate 12, the track 92E of the boundary portion 90A of the brush roller 80 and the track 92F of the boundary portion 90B of the brush roller 82 are overlapped with each other, so that the rubbed surface irregularity will appear on the PS printing plate 12.

Figure 20:
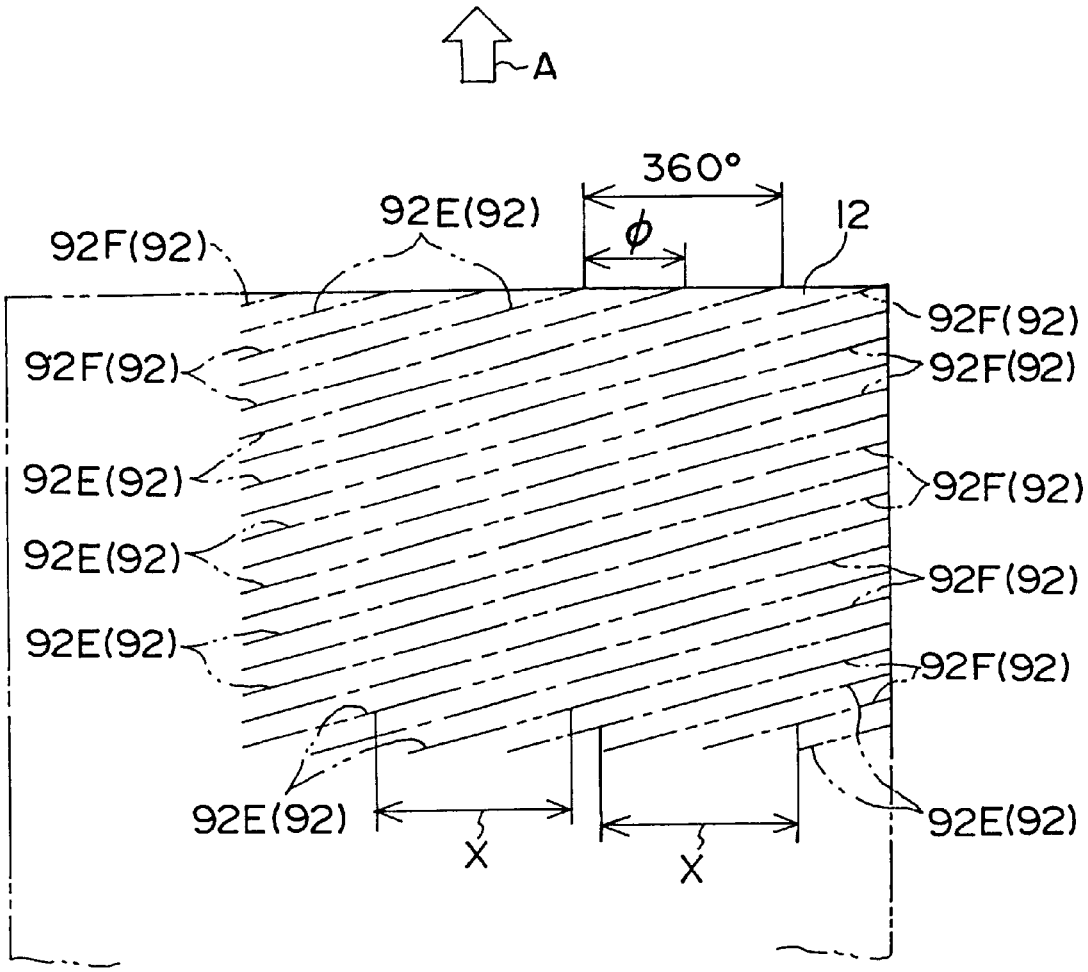
FIG. 20 is a schematic view showing one embodiment of the track by the boundary portion in accordance with the modified embodiment.

That is, as shown in FIG. 20, when a difference between the track 92E formed by the boundary portion 90A of the brush roller 80 and the track 92F formed by the boundary portion 90B of the brush roller 82 is set to a phase difference $\phi$, if the phase difference $\phi$ becomes 0 degree (or 360 degrees), the track 92E and the track 92F are overlapped with each other and the rubbed surface irregularity easily appears on the PS printing plate 12. In this case, the phase difference $\phi$ satisfies the relation 0 degree$\leqq\phi\leqq$360 degrees.

It is possible to prevent the rubbed surface irregularity from appearing on the PS printing plate 12 by shifting the track 92E formed by the boundary portion 90A of the brush roller 80 from the track 92F formed by the boundary portion 90B of the brush roller 82.

That is, the phase difference $\phi$ is set to a relation $\phi\neq0$ degree. Further, taking the widths of the tracks 92E and 92F into consideration, it is set to a relation 20 degrees$\leqq\phi\leqq$340 degrees.

Accordingly, it is possible to prevent the rubbed surface irregularity from appearing on the surface of the PS printing plate 12. In this case, when the phase difference $\phi$ satisfies the relation $\phi$=180 degrees, the track 92F becomes a middle position between two tracks 92E.

In this case, when the number M is an integral number, in order to generate a predetermined phase difference $\phi$ between the track 92E formed by the boundary portion 90A of the brush roller 80 and the track 92F formed by the boundary portion 90B of the brush roller 82, the brush rollers 80 and 82 are previously rotated relatively at a time of placing the apparatus and stopping the operation so as to shift the position of the end portion in the axial direction of the boundary portion 90A of the web body 166 wound around the brush roller 80 with respect to the PS printing plate 12 and the position of the end portion in the axial direction of the boundary portion 90B of the web body 166 wound around the brush roller 82 with respect to the PS printing plate 12 to the position at which the track 92E and the track 92F are not overlapped with each other. Of course, the whole of the boundary portion 90A of the web body 166 wound around the brush roller 80 with respect to the print surface of the PS printing plate 12 and the whole of the boundary portion 90B of the web body 166 wound around the brush roller 82 may be shifted so that the track 92E and the track 92F do not overlap with each other.

Further, when the directions of the brush rollers 80 and 82 are fixed so that the phase difference $\phi$ satisfies the relation $\phi$=0 degree, it is sufficient to adjust the transferring speed V of the PS printing plate 12, the rotational speed N or the distance L so that the number M is not an integral number.

At this time, taking the widths of the tracks 92E and 92F into consideration, for example, it is preferable to make the first decimal place of the result of calculation of the number M be not "0", after rounding off the second decimal place. That is, if a result of rounding off the first decimal place of the number M is set to $I_1(M)$, and the result of rounding off the second place of the number M is set to $I_2(M)$, it is more preferable that the following relation is satisfied.

$$I_1(M)\neq I_2(M)$$

As mentioned above, by giving a predetermined phase difference $\phi$ between the track 92E formed by the boundary portion 90A of the brush roller 80 and the track 92F formed by the boundary portion 90A of the brush roller 82 when the brush rollers 80 and 82 are in contact with the print surface of the PS printing plate 12 so as to shift the tracks 92E and 92F, it is possible to prevent the rubbed surface irregularity caused by the boundary portions 90A of two brush rollers 80 and 82 from appearing on the print surface of the PS printing plate 12 and it is possible to obtain the PS printing plate 12 having a high quality in which no rubbed surface irregularity appears.

When two or more brush rollers are provided, it is sufficient that the structure is made such that the tracks 92 are shifted between at least optional two brush rollers.

The brush roller may be a so-called multi-wound type in which two or more web bodies 166 are wound in a helical manner. Further, a brush roller in which the web body 166 is pitch wound with a slight interval may be employed.

The present invention can be applied, for example, to a brush roller used in a photosensitive material processing apparatus for processing the other photosensitive materials such as an X-ray film, a general black-and-white film, a color film, a black-and-white printing paper, a color printing paper and the like, in addition to the PS printing plate such as the photo polymer plate, the thermal plate, the surface printing plate and the like.

As mentioned above, in accordance with the present invention, since the structure is made such that the track of the photosensitive material surface caused by the boundary portion of the web-like member of the brush roller has two patterns or more at a time of brushing the same surface side of the photosensitive material by at least two brush rollers, it is possible to prevent the track of the boundary portion from appearing as the rubbed surface irregularity.

Accordingly, it is possible to prevent the finish quality of the photosensitive material brushed by the brush roller from being reduced, whereby it is possible to obtain the photosensitive material having a high finish quality.

<<Third Embodiment>>

A description will be given below of a third embodiment, however, an overlapping description about the same parts and portions as those of the embodiment mentioned above will be suitably omitted, and a description will be mainly given of characteristic portions.

Figure 21:
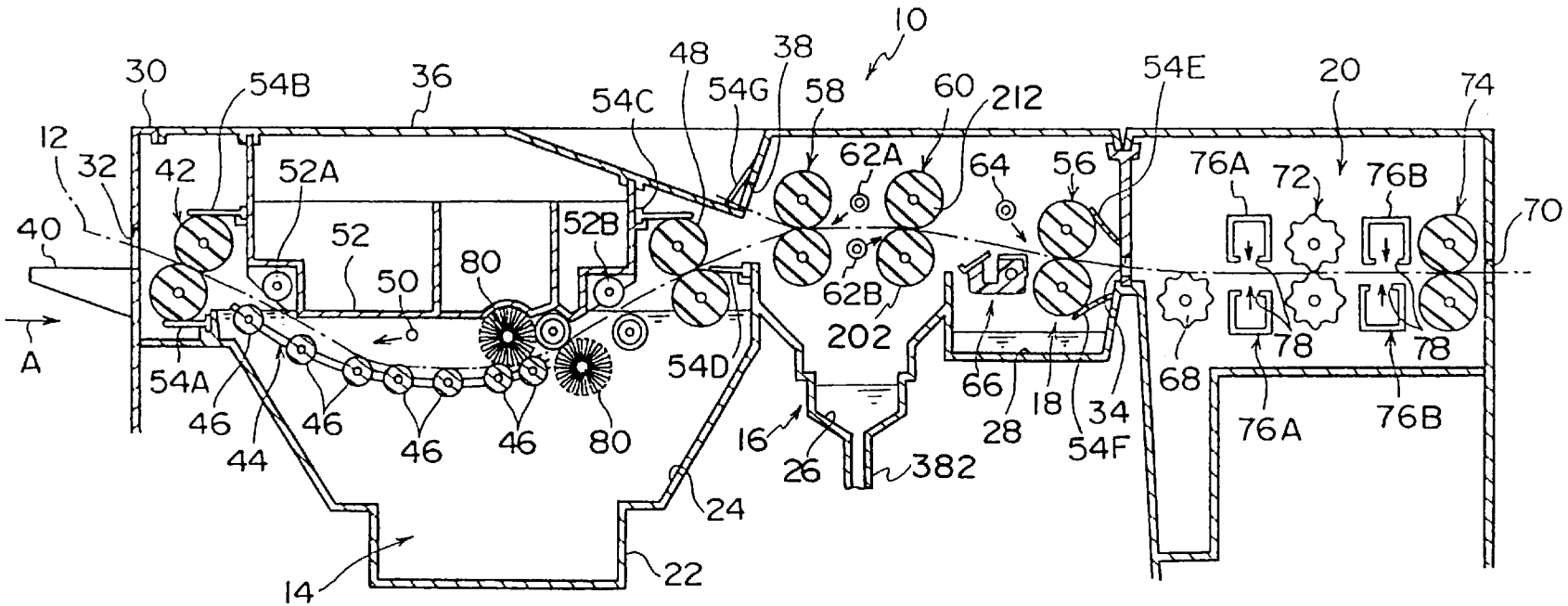
FIG. 21 is a schematic view of a whole of a PS printing plate processor in accordance with a third embodiment of the present invention.

With reference to FIG. 21, in the PS printing plate processor 10, there are provided plural pairs of rollers gripping the PS printing plate 12 and applying the transferring force to the PS printing plate 12, such as pairs of transferring rollers 42, 48, 58, 60, 56, 72, 74 and the like. A gripping force for nipping the PS printing plate 12 between the mutually opposing rollers is applied to the pairs of transferring rollers 42, 48, 58, 60, 56, 72 and 74, and the pairs of transferring rollers 48, 58, 60 and 56 are mounted to a side plate corresponding to an inner wall of the processing tank side in a state that a great gripping force is applied to a portion between the opposing rollers, in order to squeeze down the processing solution attached to the surface of the PS printing plate 12 from the surface of the PS printing plate 12.

Here, a description will be given of a mounting of a pair of transferring rollers 60 to the PS printing plate processor 10 on the basis of an example of a pair of transferring rollers 60, with reference to FIGS. 22 to 24.

A pair of transferring rollers 60 are structured, for example, such that rubber rollers 200 and 202 in which outer peripheral portions of roller main bodies (not shown) are coated by an elastic member such as a silicone rubber or the like are arranged vertically so as to form a pair. Further, gears 204 are provided at both end portions along an axial direction of each of the rubber rollers 200 and 202, and the structure is made such that the gears 204 are engaged with each other by bringing the outer peripheral surfaces of the roller main bodies into contact with each other and rubber rollers 200 and 202 rotate.

In a pair of transferring rollers 60, mounting bases 210 corresponding to base portions are arranged at both end portions along the axial direction of the rubber rollers 200 and 202. In each of the rubber rollers 200 and 202, rotary shafts 206 and 208 protruding out from the gears 204 at both end portions in the axial direction are respectively pivoted to the mounting bases 210, and the mounting bases 210 are mounted to predetermined positions of a pair of side plates 212 (refer to FIGS. 21 and 24) arranged within the processing tank 22 (refer to FIG. 21).

In this case, the side plates 212 are provided at both ends in a width direction (a direction perpendicular to the transferring direction) of the PS printing plate 12 transferred within the processing tank 22. In FIG. 21, only one side plate 212 is shown, and in FIG. 24, a part of the side plate 212 is illustrated. Further, the mounting bases 210 arranged in both end sides in the axial direction of a pair of transferring rollers 60 are formed in the same shape, and the following description will be given with showing any one mounting base 210.

Figure 22:
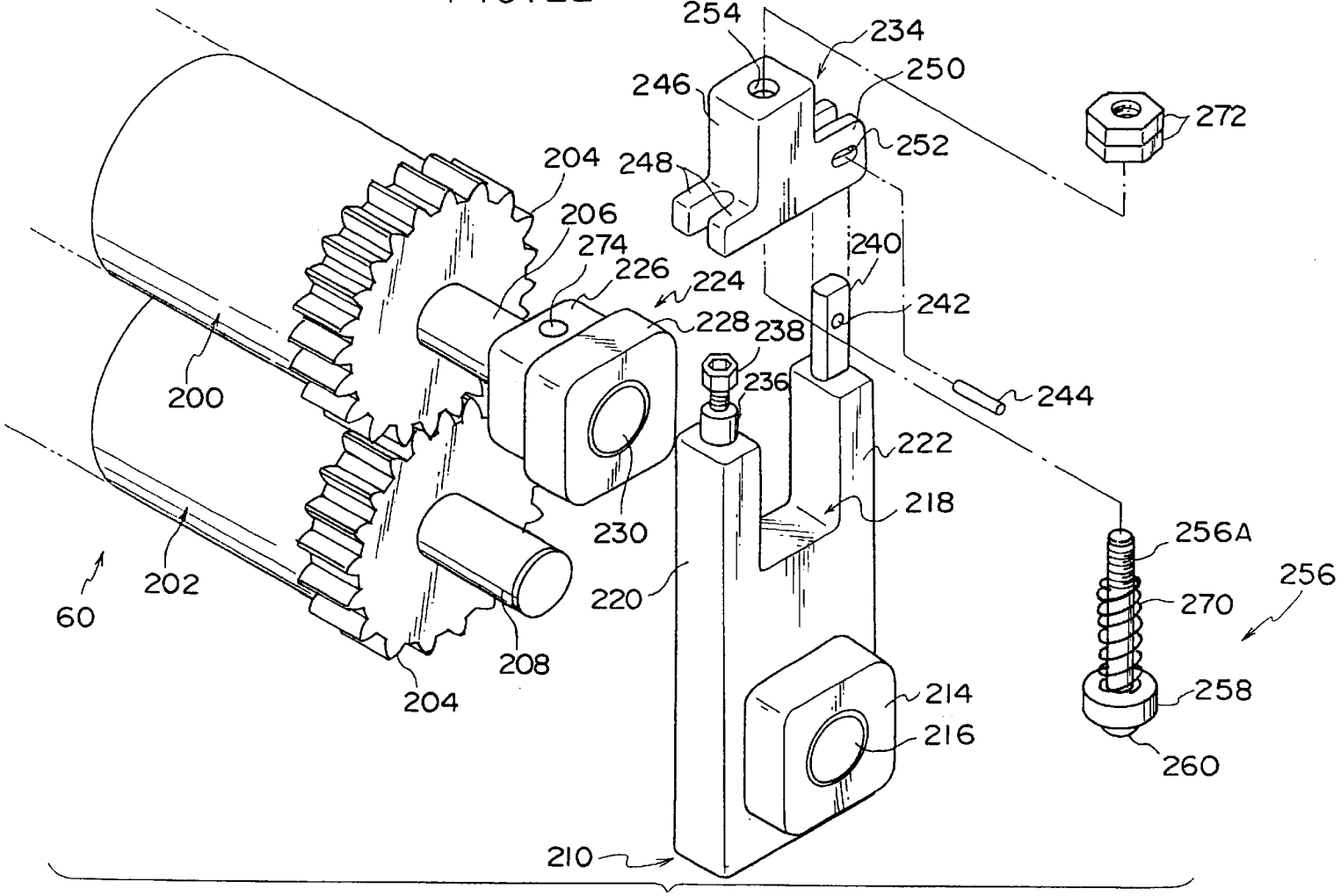
FIG. 22 is a schematic exploded perspective view of one end side of a pair of transferring rollers showing an assembly of a rubber roller to a mounting base.
Figure 23:
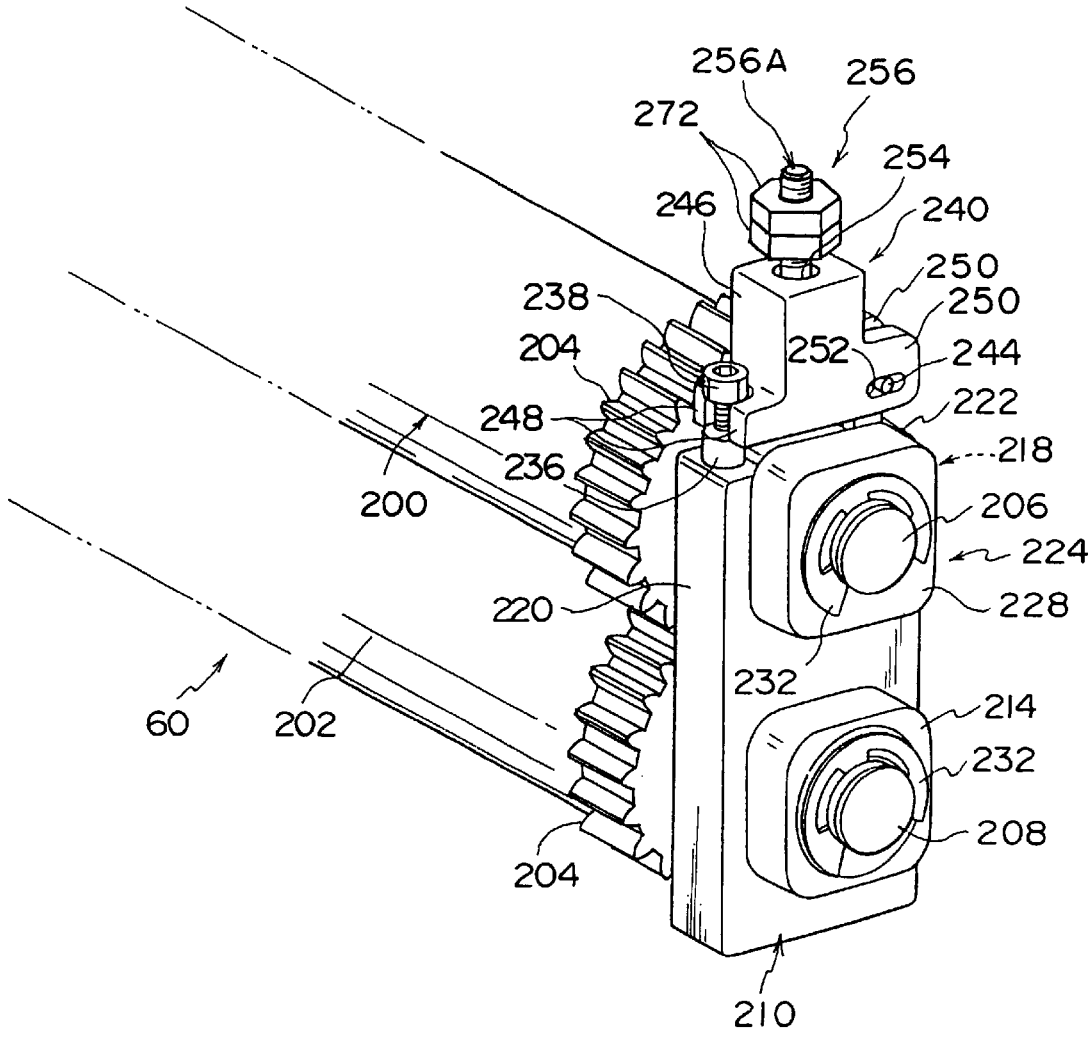
FIG. 23 is a schematic perspective view of one end side of a pair of transferring rollers showing a state of mounting the rubber roller to the mounting base.

As shown in FIGS. 22 and 23, the mounting base 210 is formed in a substantially rectangular flat shape, and a bearing portion 214 is formed in one end side along a longitudinal direction (a vertical direction on the paper surface in FIGS. 22 and 23) corresponding to an opposing side to the rubber roller 202, in the mounting base 210. The bearing portion 214 is formed in a shape protruding to an opposite direction to the rubber roller 202 from the mounting base 210 so as to form a rectangular block shape.

In the bearing portion 214, an axial hole 216 opposing to the rotary shaft 208 of the rubber roller 202 is formed in a center portion of the bearing portion 214. The rubber roller 202 is rotatably supported to the mounting base 210 by inserting the rotary shafts 208 at both ends to the axial holes 216 of the bearing portion 214.

On the other hand, as shown in FIG. 22, a notch 218 formed in a rectangular shape is formed in another end side in a longitudinal direction of the bearing portion 214 in the mounting base 210. The notch 218 is formed toward the bearing portion 214 from another end side in the longitudinal direction of the mounting base 210, whereby leg portions 220 and 222 are formed in the mounting base 210 so as to form a pair.

The structure is made such that bearings 224 provided so as to oppose to the rotary shaft 206 of the rubber roller 200 is arranged within the notch 218. The bearing 224 is structured such that a base portion 226 formed in a substantially rectangular block shape and a flange portion 228 formed so as to expand a width of the base portion 226 are integrally formed, and an axial hole 230 is formed in the center portion so as to pass through the base portion 226 and the flange portion 228.

The rubber roller 200 is structured such that the rotary shaft 206 is inserted to the axial hole 230 of the bearing 224 from the base portion 226 side. At this time, as shown in FIG. 23, a fall-out prevention is applied by attaching a C-ring 232 or the like to a front end of the rotary shaft 206 protruding out to the flange portion 228 side of the bearing 224. Accordingly, the rubber roller 200 and the bearing 224 are connected so as to relatively rotate.

The rubber roller 200 is pivoted to the mounting base 210 by attaching the bearing 224 mounted to the rotary shaft 206 to the mounting base 210. The base portion 226 of the bearing 224 has a size corresponding to an interval between the leg portions 220 and 222, and the bearing 224 is attached to the mounting base 220 by inserting the base portion 226 of the bearing 224 into the notch 228 from the front end side of the leg portions 220 and 222.

At this time, the structure is made such that the bearing 224 can move along a direction of moving close to and apart from the bearing portion 214 corresponding to a longitudinal direction of the mounting base 210, within the notch 218, whereby an outer peripheral surface of the rubber roller 200 mounted to the bearing 224 is brought into contact with an outer peripheral surface of the rubber roller 202 attached to the bearing 214.

Figure 24:
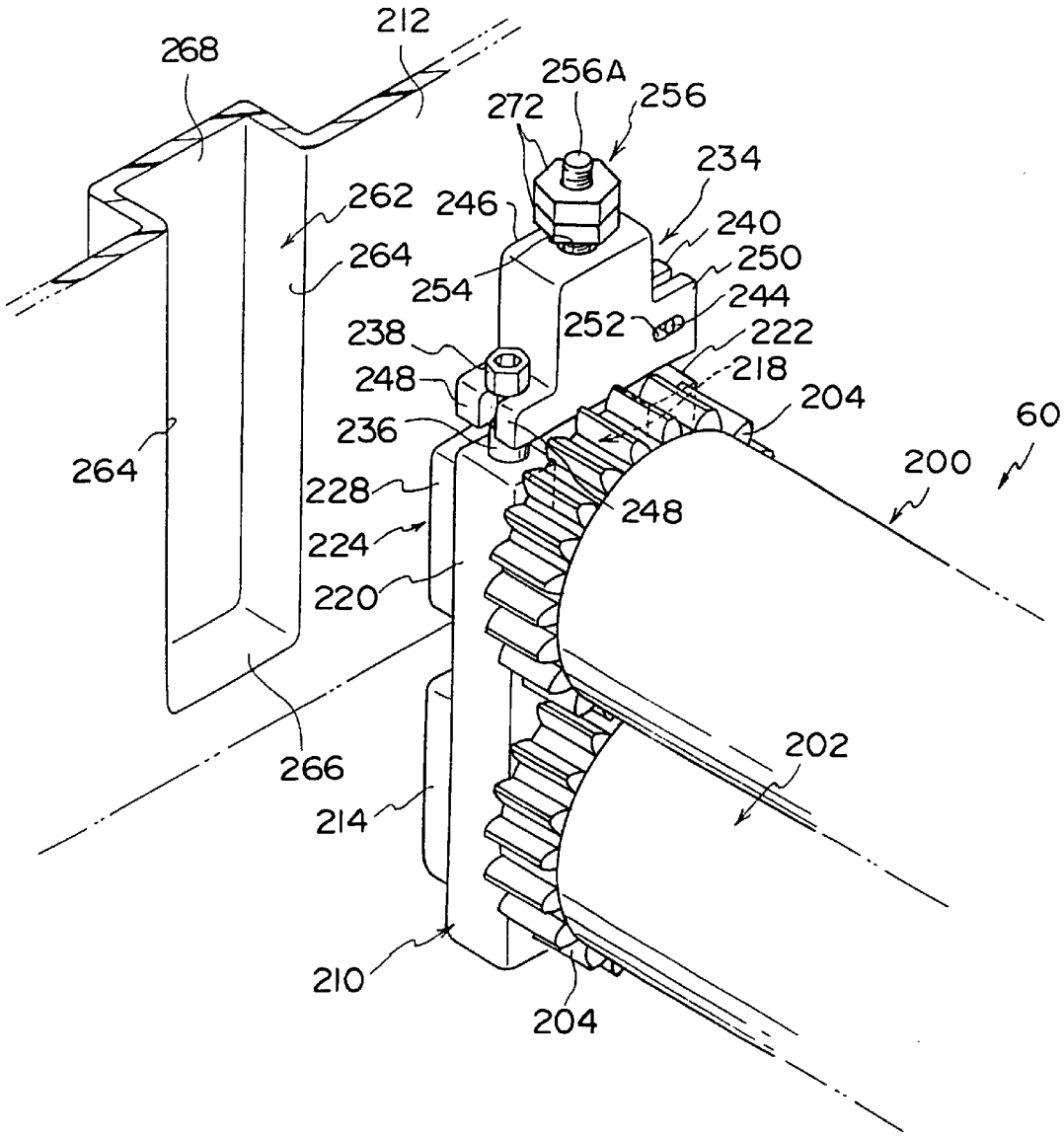
FIG. 24 is a schematic perspective view of another end side of a pair of transferring rollers showing a summary of mounting a pair of rollers to a side plate.

On the other hand, as shown in FIGS. 22 to 24, a restricting member 234 is mounted so as to be extended between front ends of the leg portions 220 and 222. Accordingly, an opening of the notch 218 is closed, thereby preventing the bearing 224 mounted to the rubber roller 200 from being taken out from the notch 218.

That is, the notch 218 corresponding to a second bearing receiving portion is formed in the mounting base 210, and the bearing portion 214 integrally having a first bearing receiving portion and a bearing received in the first bearing receiving portion is formed therein.

As shown in FIG. 22, the structure is made such that a fastening screw 238 inserted to a spacer 236 is engaged with a front end in one leg portion 220. Further, a supporting pin 240 is stood from a front end of another leg portion 222. A pin hole 242 is pierced along an axial direction of the rubber roller 200 and 202, in the supporting pin 240, and the structure is made such that the axial pin 244 is press inserted into the pin hole 242.

On the other hand, in the restricting member 234, a pair of leg portions 248 and 250 are formed so as to oppose to respective upper ends of the leg portions 220 and 222 from the base portion 246 formed in a rectangular block shape. In this case, in FIGS. 22 to 24, an illustration of one of the leg portions 250 is omitted.

The restricting member 234 is arranged in a state that the leg portion 248 is opposed to the leg portion 220 of the mounting base 210 and the leg portion 250 is opposed to the leg portion 222. At this time, the structure is made such that the supporting pin 240 is inserted to the portion between the leg portions 250.

Further, in the leg portion 250 of the restricting member 234, an oblong hole 252 is pierced at a position opposing to the pin hole 242 of the supporting pin 240. Each of both end portions of the axial pin 244 inserted to the in hole 242 of the supporting pin 240 is structured such as to be inserted into the oblong hole 252 formed in the leg portion 250 of the restricting member 234. Accordingly, the restricting member 234 is structured such as to be rotatable around the axial pin 244 within the oblong hole 252 between a position closing the opening of the notch 218 and a position (not shown) opening the notch 218.

The bearing 224 attached to the rubber roller 200 can be taken out from the notch 218 by rotating the restricting member 234 around the axial pin 244 so as to be retracted to the position releasing the opening of the notch 218. That is, it is possible to move the rubber roller 200 from the rubber roller 202 so as to take out by rotating the restricting member 234 to the retracted position.

The leg portion 248 of the restricting member 234 is arranged so as to grip the spacer 236 between the leg portion 248 and the front end of the leg portion 220 of the mounting base 210. The leg portion 248 can be fixed to the leg portion 220 of the mounting base 210 by engaging the fastening screw 238 inserted to the portion between the leg portions 248 with a screw hole (not shown) in the front end of the leg portion 220 of the mounting base 210 in this state. That is, the restricting member 234 is assembled in the mounting base 210 by fixing the leg portion 248 to the fastening screw 238 in a state that the leg portion 250 is engaged with the supporting pin 240.

On the other hand, a through hole 254 is formed in the base portion 246 of the restricting member 234. The through hole 254 is formed so that an axial direction thereof opposes to the base portion 226 of the bearing 224 received in the notch 218 at a time of assembling the restricting member 234 in the mounting base 210.

In this through hole 254, a screw portion 256A of a restricting screw 256 constituting urging and holding means is inserted to the through hole 254. As shown in FIG. 22, in the restricting screw 256, a head portion 258 having an outer diameter larger than an inner diameter of the through hole 254 is formed in one end side in an axial direction, and the screw portion 256A is inserted to the through hole 254 so that the head portion 258 opposes to the base portion 226 of the bearing 224 (refer to FIGS. 23 and 24 (refer to FIGS. 23 and 24).

A compression coil spring 270 corresponding to urging means is inserted into the through hole 254 of the base portion 246, and the screw portion 256A of the restricting screw 256 inserted into the through hole 254 is also inserted to the compression coil spring 270.

The through hole 254 is structured such that a diameter of an end portion in an upper side (an opposite side to the bearing 224) is reduced (not shown), whereby the compression coil spring 270 to which the screw portion 256A is inserted prevents the compression coil spring 270 from being taken out from the upper side of the through hole 254 at a time of being inserted from the lower side of the through hole 254, and can urge the head portion 258 of the restricting screw 256 toward the bearing 224. In this case, in accordance with the present embodiment, the outer diameter of the head portion 258 of the restricting screw 256 is set to be larger than the inner diameter of the through hole 254, however, the structure is made such that the outer diameter of the head portion 258 is made smaller than the inner diameter of the through hole 254 so that the compression coil spring 270 is not removed from the head portion 258, whereby the head portion 258 enters within the through hole 254.

A nut 272 is engaged with the front end portion protruding from the through hole 254 of the restricting member 234, in the screw portion 256A of the restricting screw 256. Accordingly, it is possible to prevent the restricting screw 256 from being taken out from the through hole 254, and the compression coil spring 270 received within the through hole 254 urges the head portion 258 of the restricting screw 256 toward the bearing 224.

As shown in FIG. 22, a pressing head 260 is formed in the head portion 258 of the restricting screw 256 in such a manner as to protrude toward the bearing 224. Further, a patch 274 is provided in the base portion 226 of the bearing 224 so as to oppose to the pressing head 260 of the restricting screw 256. This patch 274 is formed, for example, a stainless steel small piece, and is fixed by applying a rod (for example, a smoothing iron tip) plural portions of which are heated so as to deform the resin base portion 226, a so-called caulking, in a state of being arranged at a predetermined position of the resin base portion 226.

The restricting screw 256 is inserted to the through hole 254 in a state of assembling the restricting member 234 in the mounting base 210 so as to be fixed by the nut 272 in accordance with a double-nut system, whereby the head portion 258 protrudes from the base portion 246 of the restricting member 234. In this state, by fixing the restricting member 234 by the fastening screw 238, the pressing head 260 is brought into contact with the patch 274 provided in the base portion 226 of the bearing 224.

Accordingly, the restricting screw 256 presses the bearing 224 toward the bearing portion 214 due to the urging force of the compression coil spring 270, whereby the outer peripheral surface of the rubber roller 202 is held in a state of being brought into contact with the outer peripheral surface of the rubber roller 200. At this time, by adjusting a degree of engagement of the nut 272 with the screw portion 256A, it is possible to adjust the urging force of the restricting screw 256 to the bearing 224, so that it is possible to adjust a degree of contact of the rubber roller 202 with the rubber roller 200.

As mentioned above, a pair of transferring rollers 60 in which the rubber rollers 200 and 202 are assembled are structured such that the base portion 226 of the bearing 224 presses the restricting screw 256 into the through hole 254 against the urging force of the compression coil spring 270, at a time of gripping the PS printing plate 12 between the rubber rollers 200 and 202. Further, the restricting screw 256 is pressed within the through hole 254, whereby a great nipping force can be obtained at a time of gripping the PS printing plate 12 between the rubber rollers 200 and 202.

In a pair of transferring rollers 60 in which the rubber roller 200 and the rubber roller 202 are assembled via the mounting base 210 in the manner mentioned above, as well as the rubber roller 202, the rubber roller 200 can be assembled in the mounting base 210 in a significantly easy manner. Further, at a time of taking out the rubber roller 200 from the mounting base 210, an operation can be easily performed only by loosening the fastening screw 238 so as to cancel the fixing of the leg portion 248 of the restricting member 234 to the mounting base 210 and thereafter rotating the restricting member 234 around the leg portion 250 side connected to the leg portion 222 of the mounting base 210.

Further, since no operation against the urging force for applying the great nipping force to the PS printing plate 12 exists at a time of taking out the robber rollers 200 and 202 as well as at a time of assembling, a pair of transferring rollers 60 can be significantly easily maintained.

On the other hand, as shown in FIG. 24, a receiving portion 262 for a pair of transferring rollers 60 is formed in the side plate 212 at a time of molding. The receiving portion 262 is formed in a rectangular space in which a longitudinal direction is substantially a vertical direction. The longitudinal direction of the receiving portion 262 coincides with a direction connecting an axis of the rubber roller 200 and an axis of the rubber roller 202 when a pair of rollers 60 form the transferring path of the PS printing plate 12.

Further, the receiving portion 262 is structured such that an interval between wall portions 264 in both sides coincides with the bearing portion 214 of the mounting base 210 and the flange portion 228 of the bearing 224 assembled in the mounting base 210. Accordingly, a pair of transferring rollers 60 are attached to a portion between a pair of side plates 212 provided in both sides in the transferring direction of the PS printing plate 12 by fitting the bearing portion 214 of the mounting base 210 and the flange portion 228 of the bearing 224 mounted to the mounting base 210 to the receiving portion 262.

Further, a bottom portion 266 of the receiving portion 262 is formed so that when the bearing portion 214 of the mounting base 210 is brought into contact therewith, the rubber roller 202 of a pair of transferring rollers 60 is arranged at a position for forming the transferring path of the PS printing plate 12 within the PS printing plate processor 10, and a depth of the receiving portion 262 is set to a depth at which the front ends of the rotary shafts 206 and 208 protruding from the bearing portion 214 and the flange portion 228 of the bearing 224 are not brought into contact with a back wall 268.

In this case, the receiving portion 262 reaches the upper end of the side plate 212 in an upper side corresponding to an opposite side of the bottom portion 266 (not shown), whereby it is possible to insert the bearing portion 214 and the flange portion 228 of the bearing 224 from the above. Further, the mounting base 210 is prevented from moving upward by optional mounting means in a state of receiving the bearing portion 214 and the flange portion 228 of the bearing 224 within the receiving portion 262, whereby a pair of transferring rollers 60 can be assembled between a pair of side plates 212.

Further, in the side plate 212, a gear rotated by a drive force output from a drive source (not shown) is protruded at a predetermined position, and the structure is made such that the gear is engaged with the gear 204 provided in the rubber roller 202 by arranging a pair of transferring rollers 60 at a predetermined position of the side plate 212. Accordingly, the drive force for transferring the PS printing plate 12 to a pair of transferring rollers 60 is transmitted.

As mentioned above, since a pair of transferring rollers 60 are structured such that the rubber roller 200 and the rubber roller 202 are fitted to the receiving portion 262 formed in the side plate 212 in a state of being assembled by the mounting base 210, thereby being significantly easily attached to and detached from the portion between a pair of side plates 212. Further, since a positioning can be performed only by bringing the bearing portion 214 of the mounting base 210 into contact with the bottom portion 266 of the receiving portion 262 at a time of attaching a pair of transferring rollers 60 to the portion between a pair of side plates 212, it is significantly easily perform the positioning at a time of attaching.

In this case, the present embodiment mentioned above does not limit the structure of the present invention. For example, in the present embodiment, the bearing portion 214 corresponding to the first bearing is integrally formed with the mounting base 210, however, the structure may be made such that the bearing 224 is used as the first bearing and a rectangular hole to which the base portion 226 of the bearing 224 is fitted is formed as the first bearing receiving portion in the mounting base 210.

Further, in the present embodiment, the restricting screw 256 provided in the restricting member 234 and the compression coil spring 270 are used as the urging and holding means, however, the urging and holding means in accordance with the present invention is not limited to this, it is possible to employ an optional structure for urging the bearing 224 toward the bearing portion 214 at a time of fixing the restricting member 234 to the leg portion 220 by the fastening screw 238 (for example, a ball plunger or the like).

Further, in the present embodiment, the description is given of the PS printing plate processor 10 for processing the PS printing plate 12 corresponding to the photosensitive material, however, a pair of transferring rollers to which the present invention is applied can be used in an optional photosensitive material processing apparatus for processing the other photosensitive materials such as an optional printing paper, a camera film or the like without being limited to the photosensitive surface printing plate such as the PS printing plate 12 or the like.

As mentioned above, in accordance with the present invention, since the structure is made such that the bearing portion supporting a pair of rollers is arranged in the first and second bearing receiving portions provided in the base portion, and the urging and holding means is provided in the restricting member for preventing the bearing from being taken out from the second bearing receiving portion so as to press the bearing received in the second bearing receiving portion to the bearing received in the first bearing receiving portion by the urging and holding means, it is unnecessary to perform the work against the nipping force applied to the portion between the rollers at a time of taking out the rollers from the base portion as well as at a time of assembling. Accordingly, it is possible to significantly easily perform a maintenance of a pair of rollers.

<<Fourth Embodiment>>

A description will be given below of a fourth embodiment. In this case, with respect to the same parts and portions as those of the embodiments mentioned above, an overlapping description will be suitably omitted and a description will be mainly given of characteristic portions.

Figure 25:
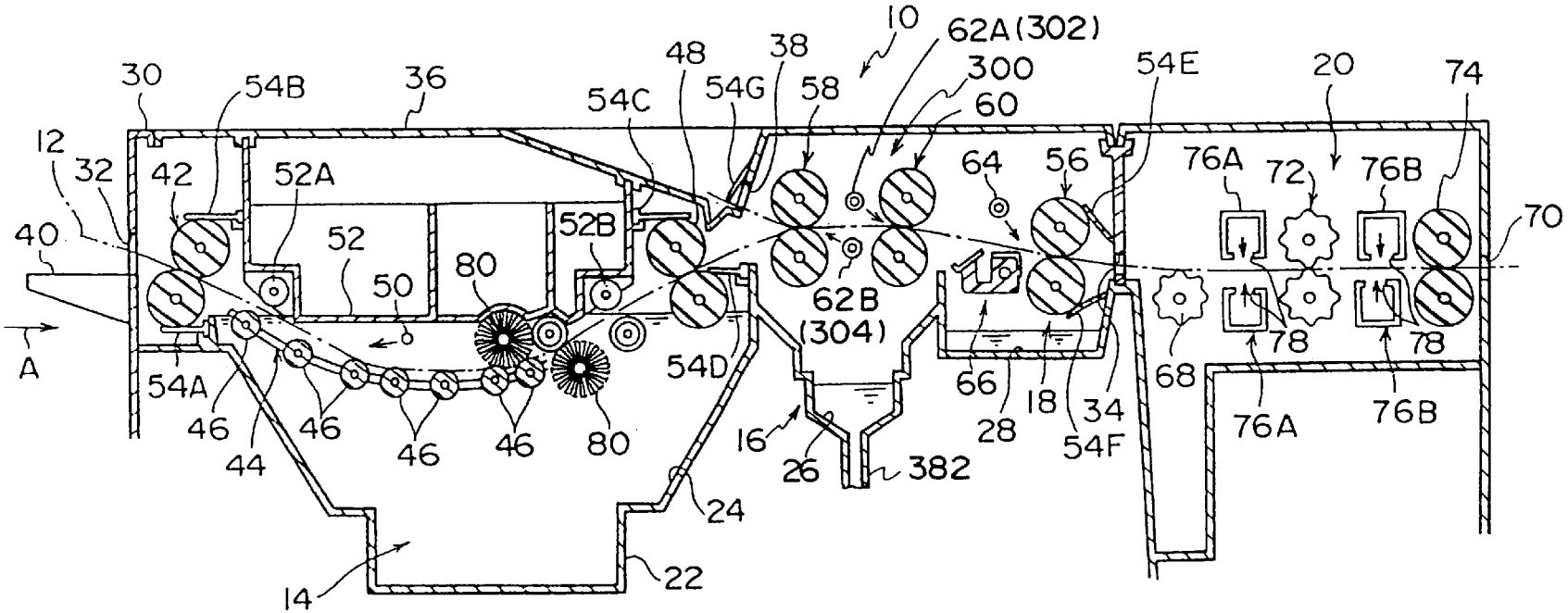
FIG. 25 is a schematic view of a whole of a PS printing plate processor in accordance with a fourth embodiment of the present invention.

With reference to FIG. 25, the spray pipes 62A and 62B provided in the water washing portion 16 and the spray pipe 64 and the discharging unit 66 provided in the desensitization processing portion 18 are respectively arranged in upper and lower portions with respect to the transferring path of the PS printing plate 12 so as to form a pair, and the structure is made such as to discharge the washing water and the gum solution supplied at a predetermined timing toward the front and back surfaces of the PS printing plate 12 so as to apply to the front and back surfaces of the PS printing plate 12.

Here, a description will be given of the spray pipe provided in the PS printing plate processor 10 on the basis of the embodiment of the spray pipes 62A and 62B provided in the water washing portion 16.

As shown in FIGS. 26 to 30, the spray pipes 62A and 62B are provided as a spray unit 300 in the PS printing plate processor 10. The spray unit 300 is constituted by a pipe 302 forming the spray pipe 62A and a pipe 304 forming the spray pipe 62B.

Figure 26:
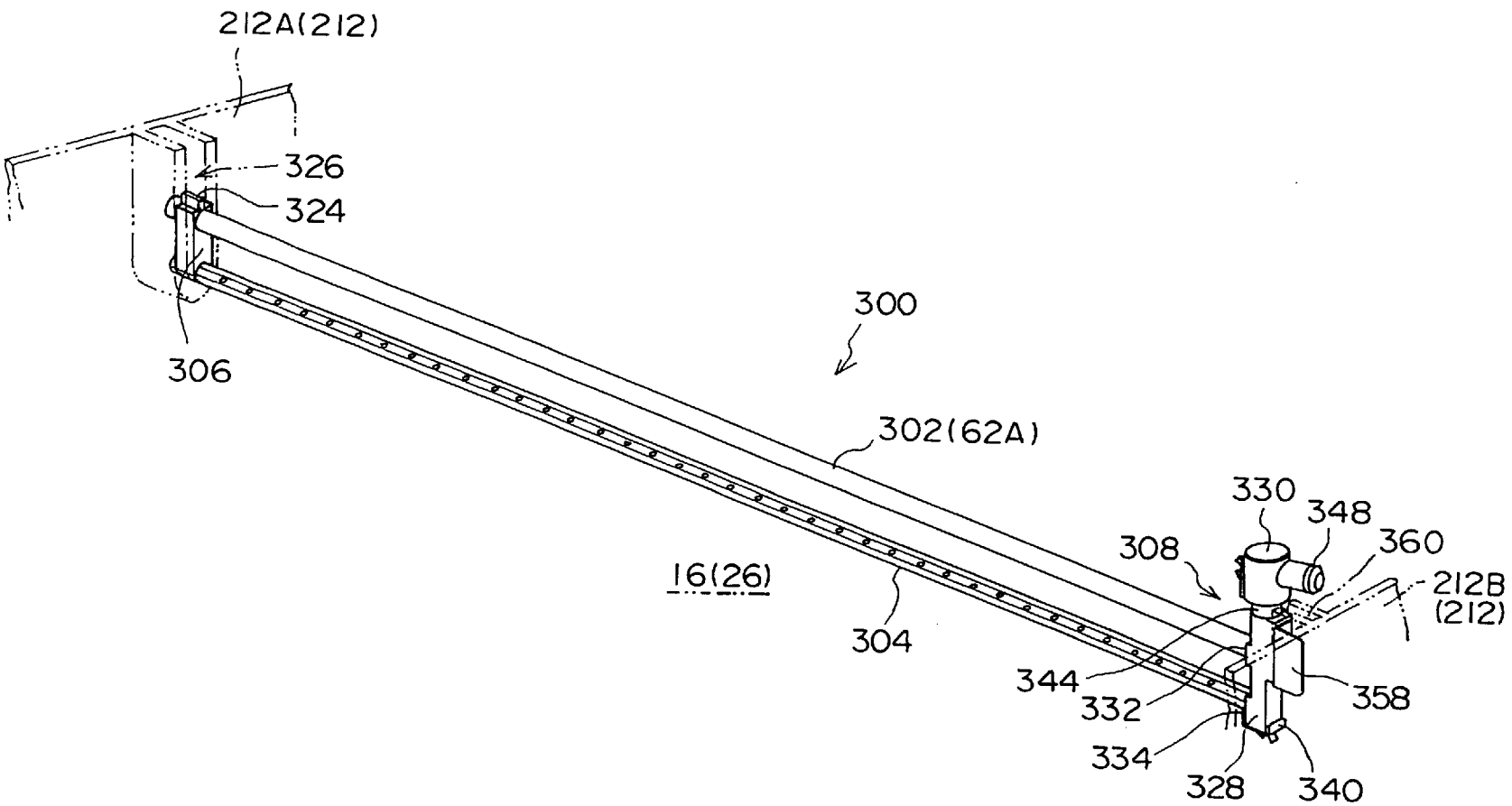
FIG. 26 is a perspective view showing a schematic structure of a spray unit.

As shown in FIG. 26, the pipes 302 and 304 have a length coinciding with a pair of side plates 212 (212A and 212B) arranged in both sides in a width direction perpendicular to the transferring direction of the PS printing plate 12 within the processing tank 22 (refer to FIG. 25) so as to form a pair and axially supporting a pair of transferring rollers 58 and 60 and the like. Further, the spray unit 300 connects one end sides in a longitudinal direction of the pipes 302 and 304 by using a holding member 306 and connects another end sides by using a connecting holder 308 so as to keep the pipes 302 and 304 at a predetermined interval, whereby the PS printing plate 12 (not shown) can pass through the portion between the pipes 302 and 304.

Figure 27:
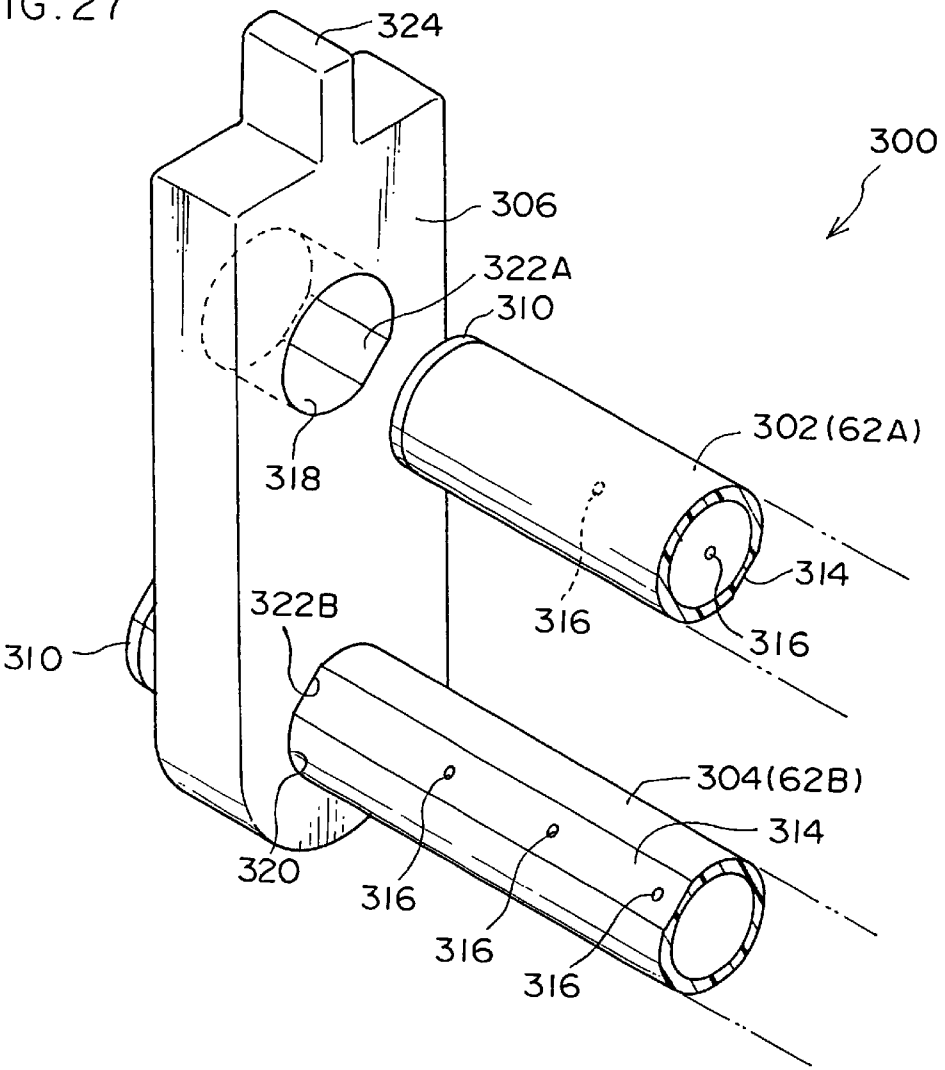
FIG. 27 is a perspective view of a main portion showing a schematic structure of the spray unit in a side of a holding member.

As shown in FIG. 27, an end cap 310 corresponding to a fastening plug is mounted to an end portion in the side of the holding member 306, whereby the pipes 302 and 304 are closed. Further, as shown in FIGS. 26 to 29, a flat portion 314 having a predetermined width is formed in an outer peripheral portion of each of the pipes 302 and 304 along the axial direction, and through holes 316 corresponding to the discharging holes are formed in the flat portion 314 at a predetermined interval.

As shown in FIG. 27, the holding member 306 is formed in a rectangular block shape, and through holes 318 and 320 to which the pipes 302 and 304 are inserted are formed at a predetermined interval along a longitudinal direction. Inner surfaces are formed in a curved manner in the respective through holes 318 and 320 in such a manner as to have inner diameters corresponding to outer diameters of the respective pipes 302 and 304, and flat surfaces 322A and 322B opposing to the flat surfaces 314 of the pipes 302 and 304 are formed at predetermined positions.

The pipes 302 and 304 are inserted to the through holes 318 and 320 in a state of opposing the flat surfaces 314 to the flat surfaces 322A and 322B. Accordingly, the pipes 302 and 304 are prevented from rotating, and the through holes 316 are directed toward a predetermined direction with respect to the holding member 306. In this case, in the spray unit 300, the structure is made such that the pipe 304 is inserted to the inserting hole 320 of the holding member 306, however, the structure may be made such that the pipe 304 and the holding member 306 are integrally formed or previously adhered to each other.

As shown in FIGS. 26 and 27, a projecting portion 324 is provided in an end portion in a side of the through hole 318 (in a side of the pipe 302), in the holding member 306. Further, as shown in FIG. 26, the holding member 306 is structured such as to be inserted into a recess portion 326 formed at a predetermined position of the side plate 212A from the above. At this time, the holding member 306 can be inserted to the recess portion 326 and taken out from the recess portion 326 by pinching and holding the projecting portion 324.

Figure 28:
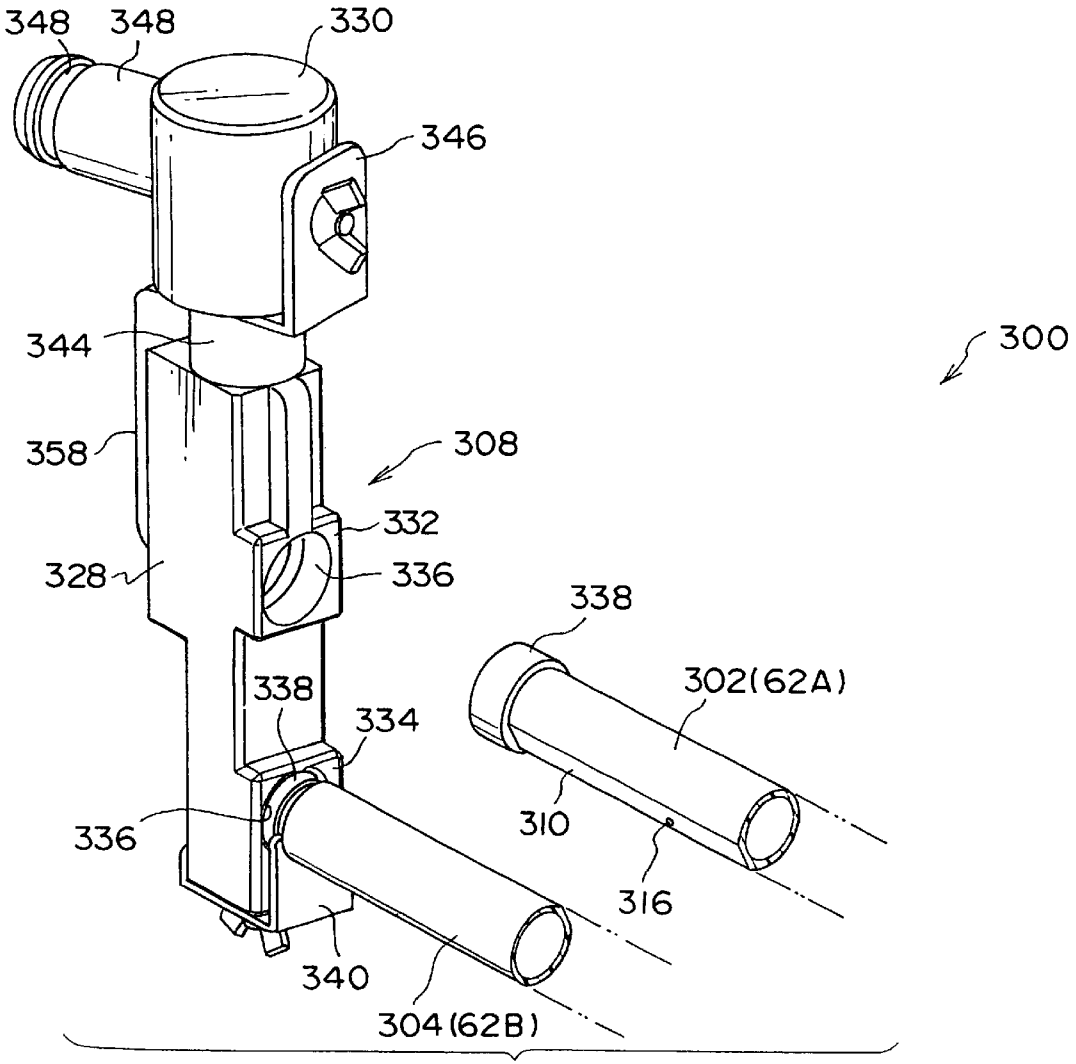
FIG. 28 is a perspective view of a main portion showing a schematic structure of the spray unit in a side of a connecting holder as seen from the side of the holding member.
Figure 29:
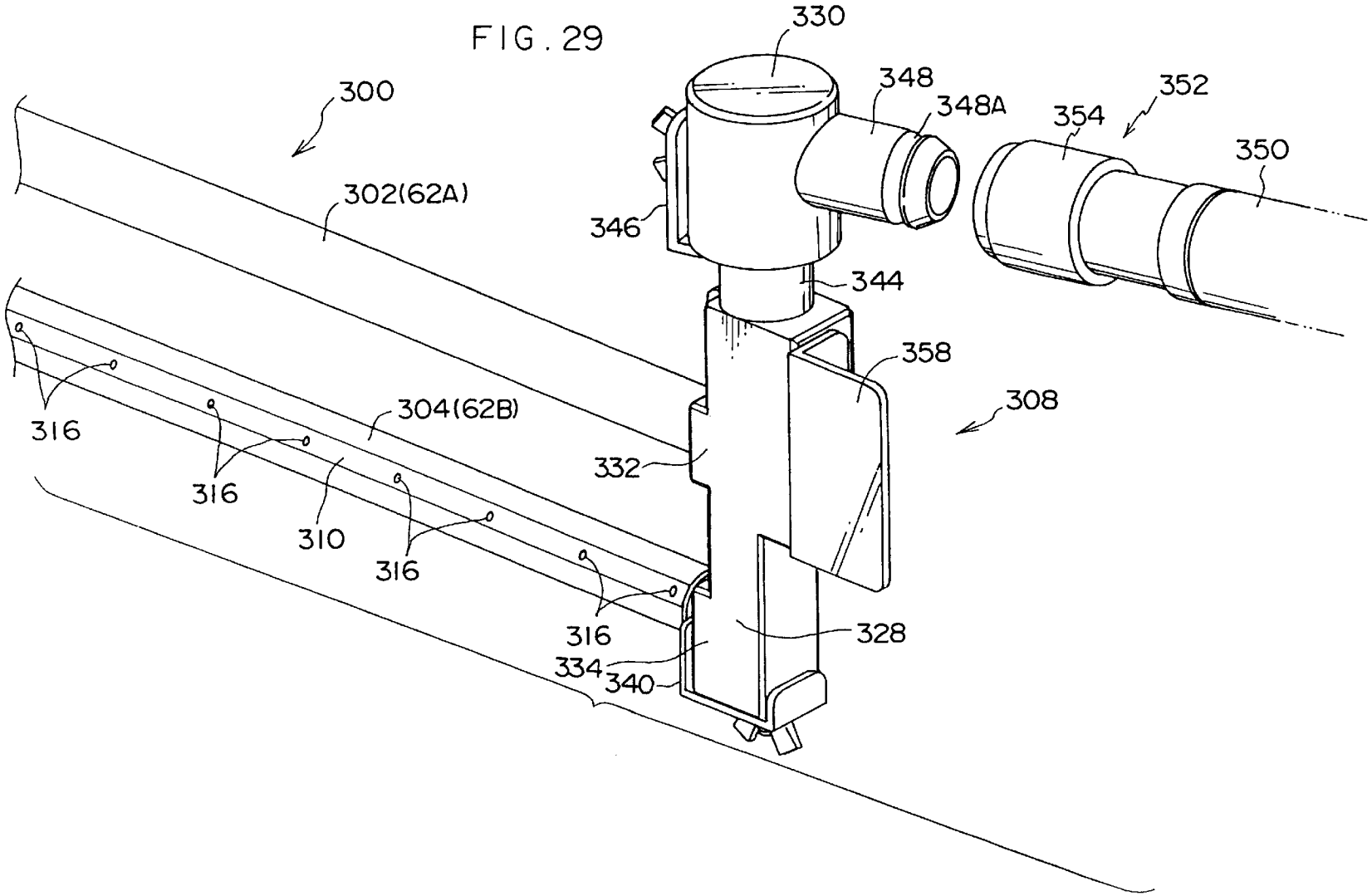
FIG. 29 is a perspective view of a main portion showing a schematic structure of the spray unit in a side of the connecting holder as seen from a different direction from FIG. 28.
Figure 30:
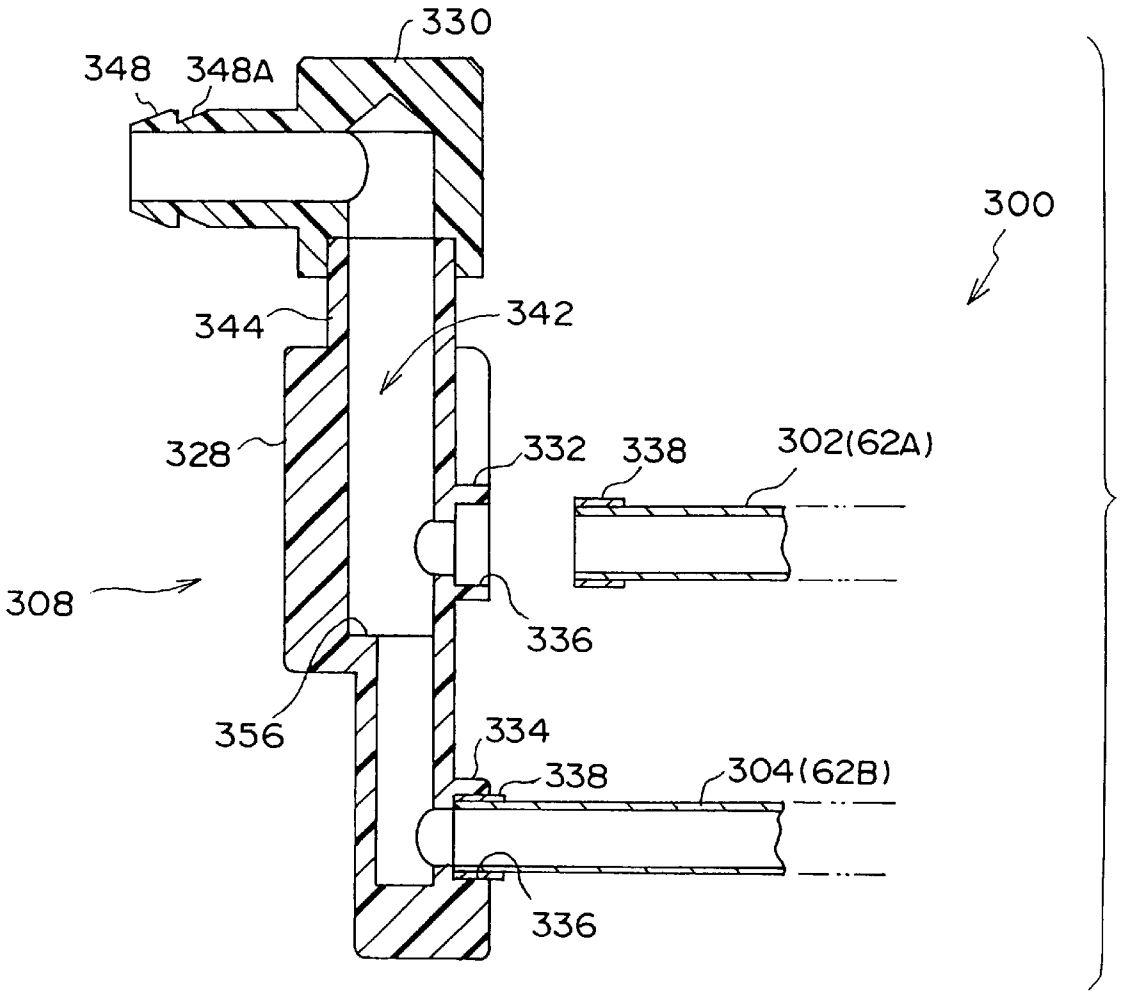
FIG. 30 is a schematic cross sectional view showing an inner portion of the connecting holder.

On the other hand, as shown in FIGS. 28 to 30, the connecting holder 308 is constituted by a block-shaped holder main body 328 and an adapter 330. As shown in FIGS. 28 to 30, connecting portions 332 and 334 respectively opposing to the pipes 302 and 304 are protruded from the holder main body 328. An inserting port 336 is formed in each of the connecting portions 332 and 334.

Seal caps 338 are attached to another end sides of the pipes 302 and 304, and the pipes 302 and 304 are tightly inserted to the inserting ports 336 together with the seal cap 338 so as to be connected to the holder main body 328. In this case, as shown in FIGS. 26, 28 and 29, a fastening metal fitting 340 is mounted to a lower end of the holder main body 328, whereby the pipe 304 is prevented from being taken out from the holder main body 308.

An interval of axes of the inserting ports 336 coincides with an interval between axes of the through holes 318 and 320 formed in the holding member 306, whereby the pipes 302 and 304 are held between the holding member 304 and the connecting holder 306 in a parallel manner.

As shown in FIG. 30, an inner portion of the holder main body 328 is made hollow (a hollow portion 342), and this hollow portion 342 is open to a bottom portion of the inserting port 336. Accordingly, the pipes 302 and 304 mounted to the holder main body 328 are communicated with the hollow portion 342.

A pipe portion 344 is protruded from an upper end portion (an end portion in a side of the adapter 330) of the holder main body 328. As shown in FIG. 30, an inner portion of the pipe portion 344 is communicated with the hollow portion 342 of the holder main body 328.

Further, the adapter 330 is formed in a substantially cylindrical shape in which one end in an axial direction is closed, and the pipe portion 344 is fitted to an opening end thereof. Accordingly, the inner portion of the adapter 330 is communicated with the hollow portion 342 of the holder main body 328. In this case, the holder main body 328 and the adapter 330 is kept in a connected state by a connecting metal fitting 346 so as to be fixed.

An entry port 348 is protruded from an outer peripheral portion in the adapter 330. The entry port 348 is protruded outward in a radial direction from the outer peripheral portion of the adapter 330, and an inner portion thereof is communicated with the inner portion of the adapter, as shown in FIG. 30.

As shown in FIG. 29, the entry port 348 is inserted to a socket (an inserting port) of a coupling 352 provided in a front end of a flexible hose 350, whereby the hose 350 is connected. For example, a constriction portion 348A is formed in the entry port 348, the constriction portion 348A is engaged with a ring provided in an inner portion of the coupling 352 by inserting the entry port 348 to the inner portion of the coupling 352, so that the entry port 348 and the coupling 352 are connected to each other. Further, the coupling 352 is structured such that the engagement with the entry port 348 is cancelled by sliding a sliding portion 354 to a side of the hose 350, whereby the entry port 348 can be drawn out from the coupling 352. That is, the entry port 348 and the coupling 352 can be easily connected and cancelled from the connected state in accordance with a one-touch operation.

The hose 350 is structured such that an end portion in an opposite side to the coupling 352 is communicated with a pipe 382 (refer to FIG. 25) in the bottom portion of the water washing tank 26 via a solution supplying pump (not shown), whereby when the solution supplying pump (not shown) is operated, a cleaning water is supplied to the hollow portion 342 of the holder main body 328 via the hose 350, the adapter 330 and the like.

The washing water supplied to the hollow portion 342 flows into the inner portions of the pipes 302 and 304 from the inserting ports 336 of connecting portions 332 and 334, thereby being discharged from the through holes 316 of the pipes 302 and 304.

On the other hand, as shown in FIG. 30, a step portion 356 is formed between the inserting port 336 of the connecting portion 332 and the inserting port 336 of the connecting portion 334. An opening cross sectional area of the hollow portion 342 is changed by the step portion 356. Accordingly, the holder main body 328 functions as an orifice so as to adjust a flow amount of each of the washing water flowing into the pipe 302 and the washing water flowing into the pipe 304. In this case, in the present embodiment, the step portion 356 is formed so that the flow amount of the washing water flowing into the pipe 302 is substantially equal to the flow amount of the washing water flowing into the pipe 304.

On the other hand, as shown in FIGS. 26 and 29, a substantially L-shaped bracket 358 is mounted to a surface in an opposite side to the connecting portions 332 and 334, in the holder main body 328. The bracket 358 is structured such that a front end is mounted along a longitudinal direction of the holder main body 328.

As shown in FIG. 26, a slit-like mounting groove 360 is integrally formed in the side plate 212B opposing to the connecting holder 308, at a predetermined position. The bracket 358 is inserted to the mounting groove 360 from the above (an upper side on the paper surface in FIG. 26) so as to reach a predetermined position, and held there.

Accordingly, the pipes 302 and 304 connected to the connecting holder 308 are arranged at a predetermined position within the water washing portion 16. Further, at this position, the adapter 330 formed in the connecting holder 108 is arranged at a position at which the adapter 330 protrudes from the upper end of the side plate 212B or a position at which the adapter 330 opposes to a notch (not shown) formed in the side plate 212B, whereby in a state of attaching the connecting holder 308 to the side plate 212B, the hose 350 can be attached to and detached the hose 350 from the entry port 348 (not shown in FIG. 26).

The spray unit 300 constituted in the manner mentioned above is inserted to the portion between a pair of side plates 212 (212A and 212B) in a state of connecting the pipes 302 and 302 corresponding to the spray pipes 62A and 62B by the holding member 306 and the connecting holder 308 so as to integrally form. At this time, the holding member 306 side is inserted into the recess portion 326 by holding the projecting portion 324 and in the connecting holder 308 side, the bracket 358 is inserted to the mounting groove 360 by holding the adapter 330 firmly connected by the connecting metal fitting 346. Accordingly, the holding member 306 and the connecting holder 308 are attached to predetermined positions of the side plates 212A and 212B, whereby the pipes 302 and 304 are respectively arranged at predetermined positions with forming the transferring path of the PS printing plate 12 therebetween so as to oppose to each other.

At this time, since the directions of the through holes 316 of the pipes 302 and 304 with respect to the holding member 306 are defined by the flat portions 314 respectively provided in the pipes 302 and 304 and the flat surface portions 322A and 322B formed in the inserting holes 318 and 320 of the holding member 306, not only the positions of the pipes 302 and 304 and the directions of the through holes 316 can be suitably set by attaching the holding member 306 to the predetermined position of the side plate 212A.

In this case, in the spray unit 300, the directions of the through holes 316 are defined by the relation between the pipes 302 and 304 and the holding member 306, however, the structure can be made such that the directions of the through holes 316 are defined by the relation between the pipes 302 and 304 and the connecting holder 308 (the holder main body 328).

The spray unit 300 inserted between a pair of side plates 212 becomes in a state that the washing water corresponding to the processing solution can be supplied to the pipes 302 and 304, by connecting the hose 350 to the entry port 348 of the adapter 330. At this time, it is possible to easily connect the hose 350 to the entry port 348 by the coupling 352.

Further, at a time of taking out the spray unit 300 from the portion between a pair of side plates 212, the hose 350 is taken out from the entry port 348 of the adapter 330. At this time, since the coupling 352 is used, it is possible to easily take out the hose 350 from the entry port 348.

Thereafter, by integrally lifting up the holding member 306 and the connecting adapter 308 so as to take out from the recess portion 326 and the mounting groove 360, it is possible to easily take out the spray unit 300, that is, the spray pipes 62A and 62B.

On the other hand, the spray unit 300 is structured such that the pipe 302 (the spray pipe 62A) opposing to the upper side of the transferring path of the PS printing plate 12 can slide along the axial direction. Accordingly, at first, the pipe 302 is slid to the side of the holding member 306. Therefore, it is possible to take out the front end in the side of the connecting holder 308 of the pipe 302 from the inserting port 336 formed in the connecting portion 332 of the holder main body 328.

Thereafter, the pipe 302 is slid and moved to the side of the connecting holder 308 (the side plate 212B), whereby the end portion in the side of the holding member 306 of the pipe 302 is taken out from the inserting port 318 of the holding member 306. Accordingly, since it is possible o take out only the pipe 302 from the spray unit 300 arranged between a pair of side plates 212, it is possible to take out the PS printing plate 12 without cutting even when a transferring error such as a jamming or the like is generated in the PS printing plate 12.

As mentioned above, the spray unit 300 can be significantly easily attached to and taken out from the portion between a pair of side plates 212 and the pipe 302 (the spray pipe 62A) does not get in the way even when the transferring error is generated in the PS printing plate 12, so that it is possible to improve an ease of maintenance of the PS printing plate processor 10.

Here, in the present embodiment, the description is given of the embodiment of the spray pipes 62A and 62B provided in the water washing portion 16, however, the structure of the spray unit 300 can be applied to the structure between the spray pipe 64 and the discharging unit 66 provided in the desensitization processing portion 18. In this case, the structure may be made such that the holding member and the connecting holder are formed in correspondence to the cross sectional shapes of the spray pipe 64 and the discharging unit 66 and the opening cross sectional area of the hollow portion within the connecting holder is changed in correspondence to the discharging amount of the gum solution from the spray pipe 64 and the injecting amount of the gum solution from the discharging unit 66.

Further, the present embodiment mentioned above does not limit the structure of the present invention. For example, in the present embodiment, the description is given of the embodiment of the PS printing plate processor 10 for processing the PS printing plate 12 corresponding to the photosensitive material, however, the spray pipe to which the present invention is applied is not limited to the photosensitive surface printing plate of the PS printing plate 12 or the like, and can be applied to a spray pipe having an optional structure opposing to a transferring path of a photosensitive material and injecting a processing solution toward the photosensitive material, in an optional photosensitive material processing apparatus for processing the other photosensitive materials such as an optional printing paper, a camera film and the like.

As mentioned above, in accordance with the present invention, it becomes significantly easy to attach and detach the pipes arranged so as to form a pair in both sides of the transferring path of the photosensitive material. Further, in accordance with the present invention, since it is possible to easily take out only one of the pipes arranged in both sides of the photosensitive material, it is possible to obtain an excellent effect that the maintenance can be easily performed even when the transferring error of the photosensitive material is generated.

<<Fifth Embodiment>>

A description will be given below of a fifth embodiment. In this case, with respect to the same parts and portions as those of the embodiments mentioned above, an overlapping description will be suitably omitted and a description will be mainly given of characteristic portions.

Figure 31:
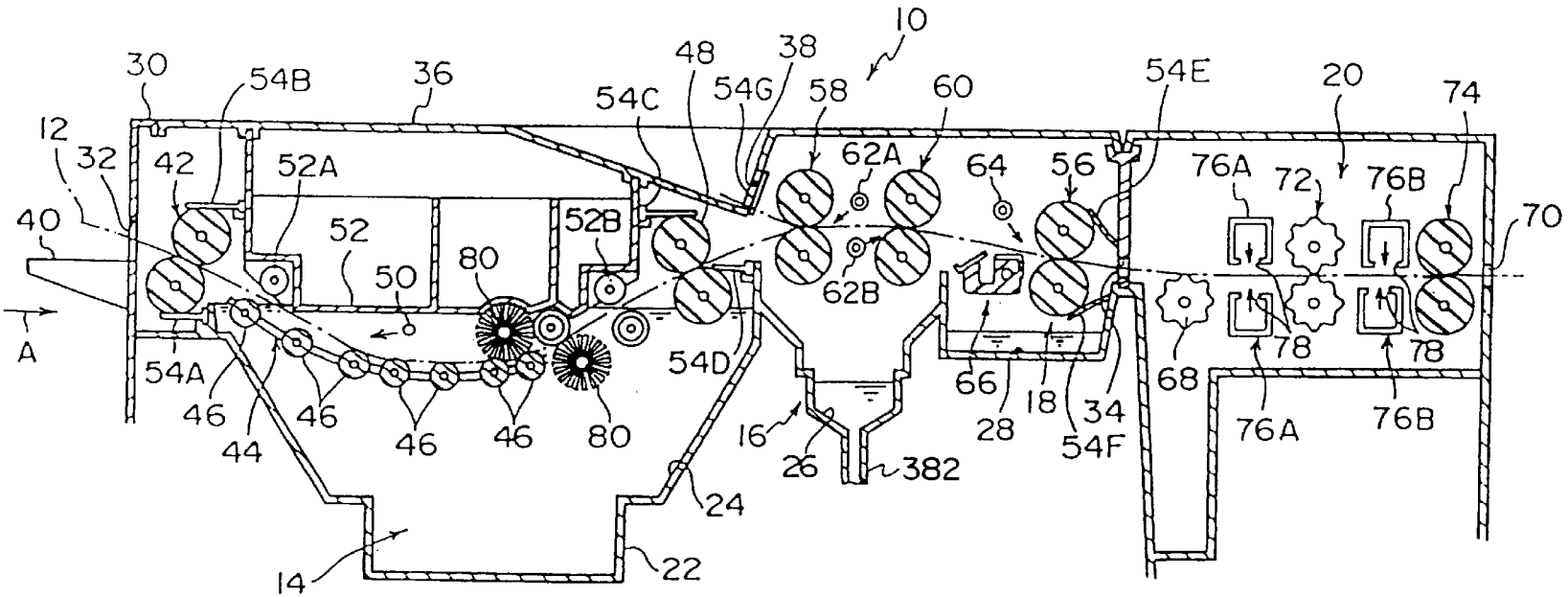
FIG. 31 is a schematic view of a whole of a PS printing plate processor in accordance with a fifth embodiment of the present invention.

With reference to FIG. 31, a filter for removing solid materials in the processing solution such as the developing solution, the washing water, the gum solution and the like is provided in the PS printing plate processor 10. The filter is received in a filter case provided in the middle of the pipe passage through which the processing solution passes. The filter case is, for example, provided in a pipe passage for supplying the developing solution within the developing tank 24 to the spray pipe 50, in the developing portion 14, and the structure is made such that the solid materials in the developing solution are removed (filtered) by the filter provided within the filter case when the developing solution within the developing tank 24 is supplied and circulated by a circulating pump (not shown).

Further, in the water washing portion 16 and the desensitization processing portion 18, filter cases (not shown) are respectively provided in the middle of a pipe passage for supplying the washing water within the water washing tank 26 to the spray pipes 62A and 62B and in the middle of a pipe passage for supplying the gum solution within the desensitization processing tank 28 to the spray pipe 64 and the discharging unit 66, and the structures are respectively made such as to filter the solid materials in the washing water and the gum solution. In this case, since the pipe passage provided with the filter case, the mounting position and the like can employ the conventionally known structure, the detailed description thereof will be omitted in the present embodiment.

Here, a description will be given of a filter case 400 applied to the PS printing plate processor 10 with reference to FIGS. 32 to 36.

Figure 32:
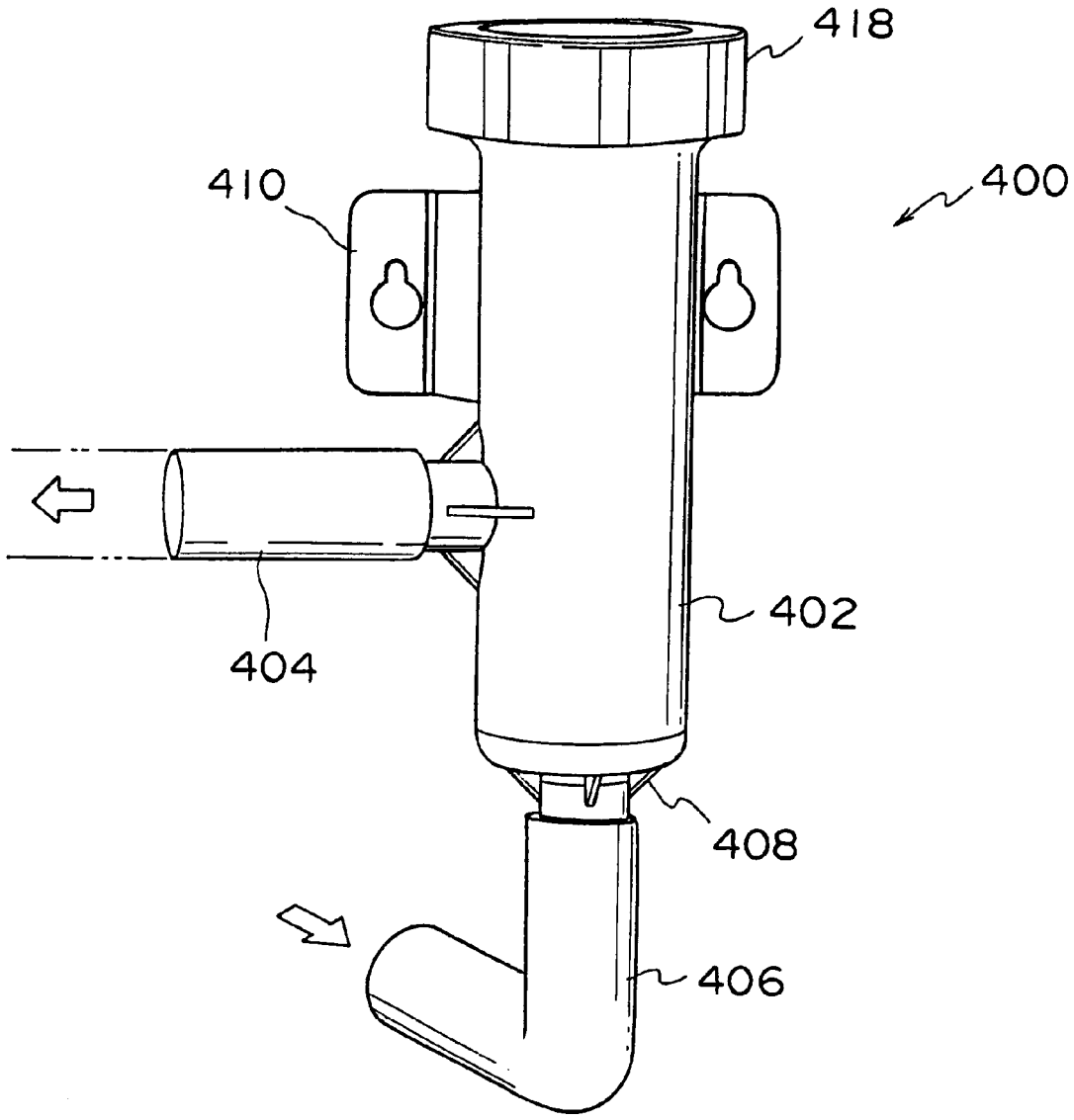
FIG. 32 is a schematic perspective view showing an outer appearance of a filter case.
Figure 33:
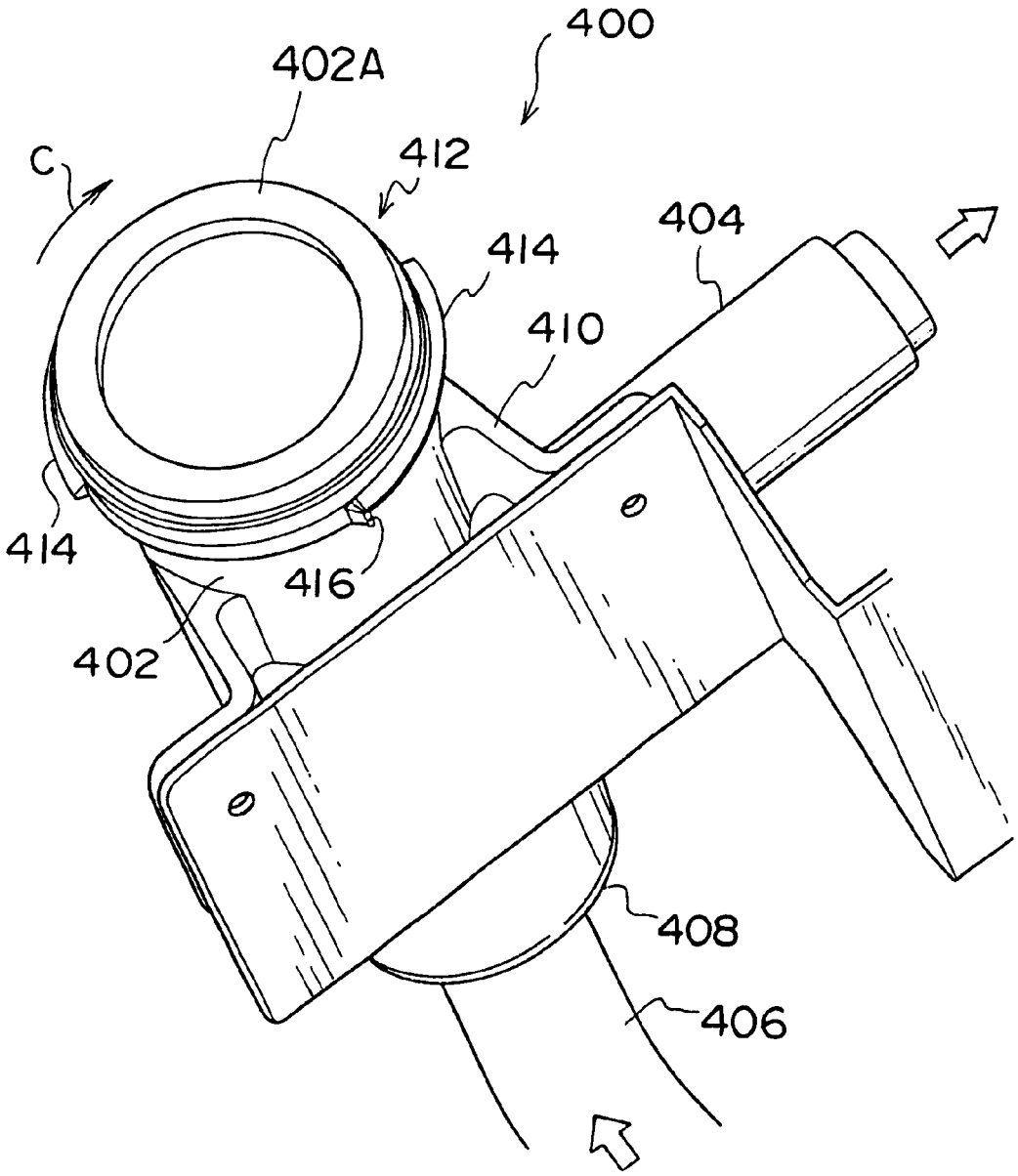
FIG. 33 is a schematic perspective view of the filter case in a state that a cap is taken out, as seen from a different direction from FIG. 32.

As shown in FIG. 32, the filter case 400 is provided with an outer case 402. As shown in FIG. 33, the outer case 402 is formed in a substantially cylindrical shape and one surface along an axial direction thereof is opened.

Further, as shown in FIGS. 32 and 33, an introduction pipe 406 to which the processing solution is fed is connected to a bottom portion 408 in the outer case 402, and a delivery pipe 404 from which the processing solution is fed out is connected to an outer peripheral portion therein. Accordingly, the processing solution fed within the outer case 402 from the introduction pipe 406 flows out from the delivery pipe 404. In this case, a bracket 410 is mounted to the outer peripheral portion in the outer case 402, and the filter case 400 is mounted to a predetermined position within the PS printing plate processor 10 by the bracket 410 so that an opening surface (a surface opposite to the bottom portion 408) is substantially upward.

As shown in FIG. 33, in the outer case 402, an upper end is an opening 402A, and a female screw portion 412 is provided in the periphery of a lower side (an upper end portion of the outer case 402) of the opening 402A. Ribs 414 are provided in the female screw portion 412. A pair of ribs 414 are provided at mutually opposing positions so as to be protruded out from the outer peripheral surface of the outer case 402 along a radial direction, in a predetermined range of angle (for example, 90 degrees) around a center (axis) of the outer case 402.

A stopper 416 extended toward a lower portion (a side of the bottom portion 408) is provided in one end side along a peripheral direction of the outer case 402, in each of the ribs 414. Further, the rib 414 is inclined so that the side of the stopper 416 is a lower side.

As shown in FIG. 32, a cap 418 is attached to an upper end portion of the outer case 402. The cap 418 is attached, whereby an upper portion of the outer case 402 is closed and sealed.

Figure 34:
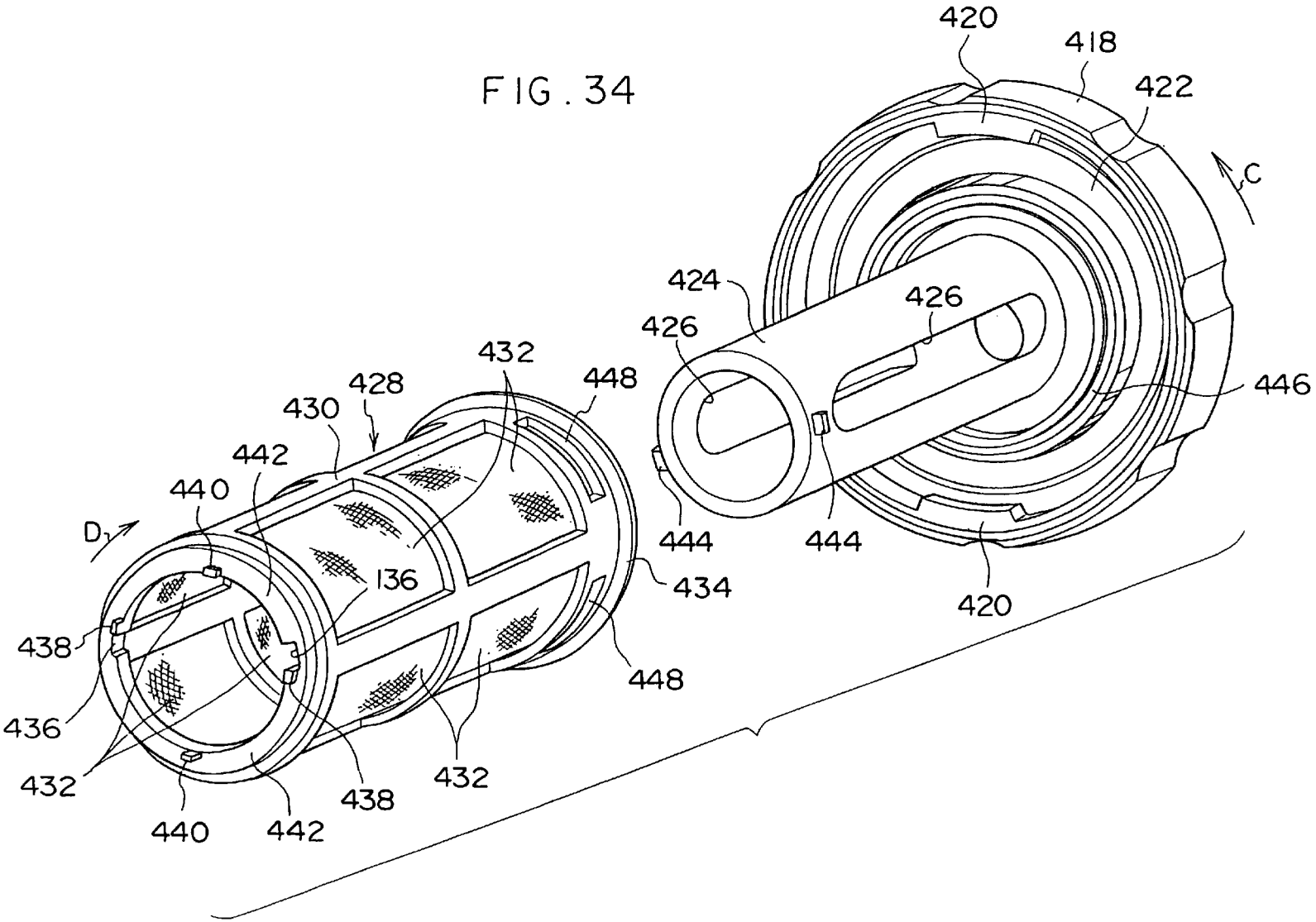
FIG. 34 is a schematic perspective view showing a filter element and the cap.
Figure 35:
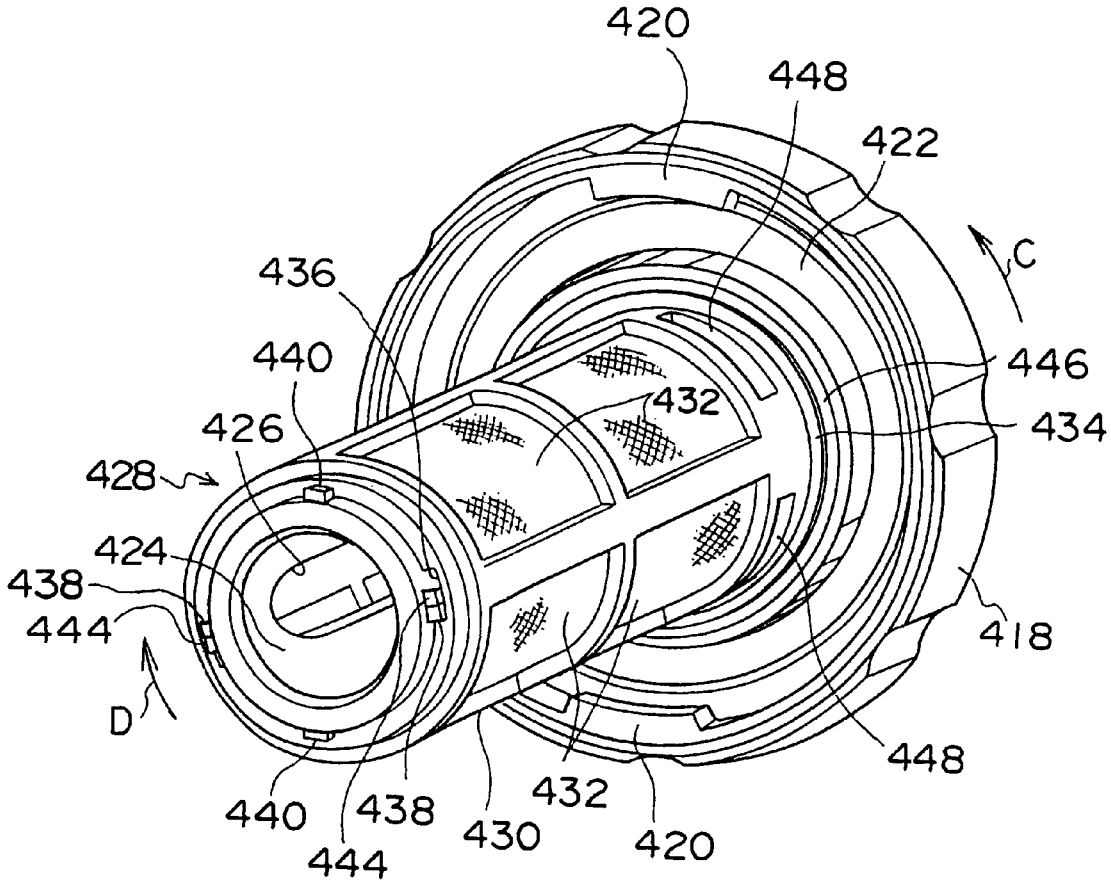
FIG. 35 is a schematic view showing a state that the filter element is attached to the cap.

As shown in FIGS. 34 and 35, a pair of projection portions 420 are provided on an inner surface of the cap 418. The projection portions 420 are protruded inward in a radial direction from the inner surface of the cap 418. Further, a pacing 422 is mounted to a position opposing to the opening 402A of the outer case 402, in the cap 418.

The cap 418 is get on the outer case 402 so that the projection portions 420 are positioned between a pair of ribs 414 provided in the outer case 402. Accordingly, the projection portions 420 can oppose to the lower surfaces of the ribs 414. In this state, by rotating the cap 418 so as to direct the projection portions 420 to the stoppers 416 (about 90 degrees in a direction of an arrow C), the projection portions 420 are slidably contact with the lower surfaces of the ribs 414 and brought into contact with the stoppers 416.

At this time, since the ribs 414 are inclined downward, the opening 402A of the outer case 402 is pressed to the packing 422 provided in the cap 418, whereby the outer case 402 is sealed by the cap 418.

On the other hand, as shown in FIG. 34, an inner tube 424 is protruded toward an inner side of the outer case 402, in the cap 418. The inner tube 424 is structured such that a front end is opened and the open front end is fitted to the opening of the delivery pipe 406 at a time of attaching the cap 418 to the outer case 402 (not shown).

Further, a plurality of opening portions 426 extended along an axial direction are formed in an outer peripheral portion of the inner tube 424.

Accordingly, the processing solution fed to the outer case 402 from the introduction pipe 406 flows out of the inner tube 424 from the opening portion 426 and flows into the delivery pipe 404.

Figure 36:
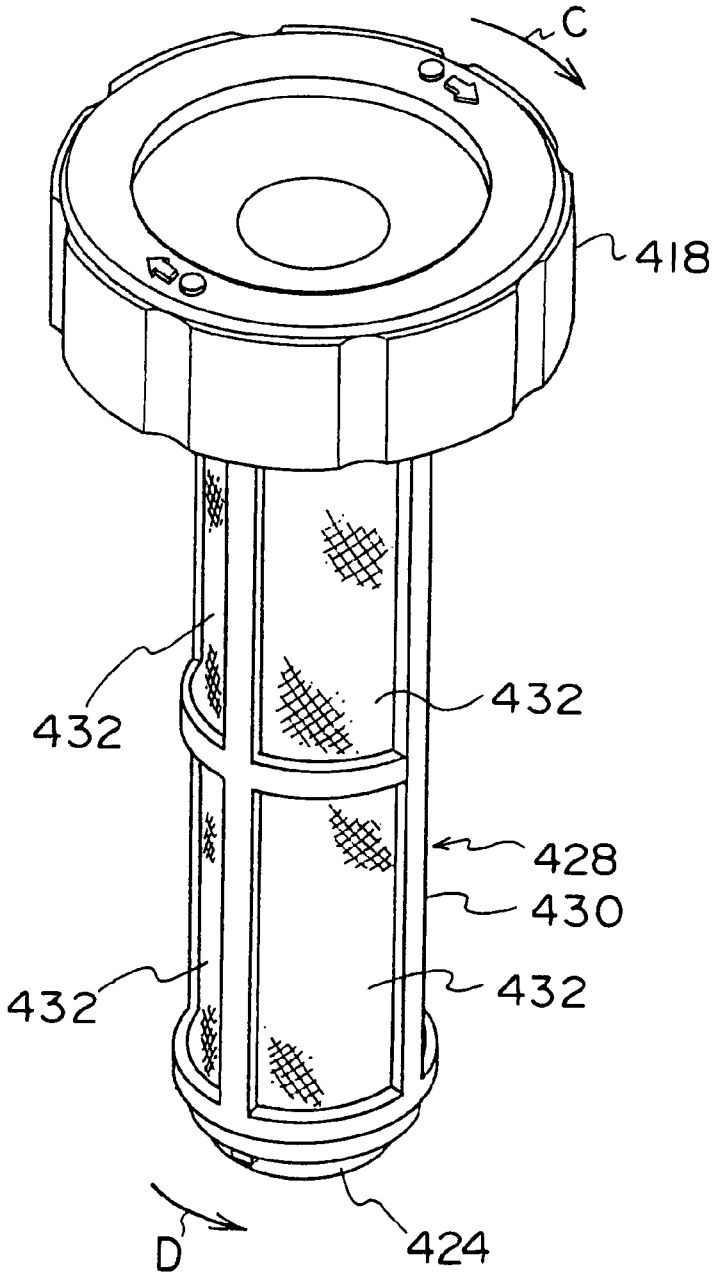
FIG. 36 is a schematic perspective view as seen from a different direction from FIG. 35, showing the state that the filter element is attached to the cap.

A filter element 428 is attached to the inner tube 424. As shown in FIGS. 34 to 36, the filter element 428 is structured such that a filter 432 is provided in an outer peripheral portion of a frame body 430 framed in a substantially cylindrical shape in such a manner as to close the opening of the outer peripheral portion of the frame body 430. Further, as shown in FIGS. 34 and 35, a flange portion 434 extended outward in a radial direction is formed in one end side in an axial direction, in the frame body 430.

The frame body 430 has an inner diameter slightly larger than an outer diameter of the inner tube 424 provided in the cap 418, and the inner tube 424 is inserted into the frame body 430 from the side of the flange portion 434, whereby the filter element 428 is attached to the cap 418. At this time, as shown in FIGS. 35 and 36, a length of the inner tube 424 along the axial direction is slightly longer than a length of the frame body 430 along the axial direction, whereby a front end of the inner tube 424 protrudes from the frame body 430.

In the frame body 430 of the filter element 428, a pair of substantially rectangular notches 436 forming a hole portion are formed in an end portion opposite to the flange portion 434. Further, in a front end of the frame body 430, rectangular projections 438 are formed in an opposite side to a direction of an arrow D of the notch 436, and rectangular projections 440 are respectively formed between the notches 436.

Further, in the front end of the frame body 430, inclined portions 442 are formed between the notches 436 and the projections 440. The inclined portions 442 is inclined so that the front end of the frame body 430 gradually moves from the flange portion 434 in a region from the side of the notches 436 toward the projections 440.

On the other hand, pawl portions 444 are formed at positions opposing to the notches 436 of the frame body 430, in the front end portion of the inner tube 424 inserted into the frame body 430 of the filter element 428. The pawl portions 444 are protruded outward in the radial direction from the outer peripheral portion of the inner tube 424. Further, as shown in FIG. 34, in the cap 418, a packing 446 is provided in the periphery of the inner tube 424 in such a manner as to oppose to the flange portion 434 of the filter element 428.

In this case, the structure may be made such that the notches 436, the projections 440, the inclined portions 442 and the like are provided in the lower end portion of the inner tube 424 and the pawl portions 444 are provided in the lower end portion of the frame body 430.

The inner tube 424 is structured such that the pawl portions 444 enter into the notches 436 so as to oppose to the inclined portions 442 when the inner tube 424 is inserted to the frame body 430 of the filter element 428. In this state, by rotating the filter element 428 in the direction of the arrow D, the pawl portions 444 of the inner tube 424 moves until being brought into contact with the projections 440 while being slidably contact with the inclined portions 442 of the frame body 430.

At this time, the frame body 430 of the filter element 428 relatively moves toward the cap 418 by the pawl portions 444 being in contact with the inclined portions 442, and the flange portion 434 is pressed to the packing 446.

Accordingly, the frame body 430 is gripped between the pawl portions 444 and the packing 446 provided in the cap 418, whereby the filter element 428 is held. That is, the filter element 428 is rotated at about 90 degrees in the direction of the arrow D in a state that the inner tube 424 is inserted to the frame body 430, whereby the frame body 430 is tightly gripped between the pawl portions 444 and the packing 446 so as to be attached to the cap 418.

The filter element 428 is inserted into the outer case 402 in a state of being attached to the cap 418, thereby being attached within the filter case 400.

In the filter case 400 to which the filter element 428 is attached in the manner mentioned above, the processing solution fed within the outer case 402 from the introduction pipe 406 flows out from the opening portion 426 of the inner tube 424 and passes through the filter 432 of the filter element 428 provided in the outer peripheral portion of the inner tube 424. At this time, the solid materials are filtered by the filter 432. Thereafter, the processing solution flows out within the delivery pipe 404 and is discharged out from the outer case 402.

On the other hand, there is a case that the solid materials filtered from the processing solution are attached to the filter 432 provided in the filter element 428, whereby the filter 432 is clogged. Accordingly, it is necessary to perform a maintenance such as a cleaning, a replacement or the like of the filter element 428 (the filter 432) periodically or in correspondence to the clogged state of the filter 432.

That is, the solid materials in the processing solution are attached to the filter 432, whereby a permeability of the processing solution is gradually reduced in the filter 432. Accordingly, a circulating amount of the processing solution or the like is reduced, and there is a risk that a reduction of processing performance of the PS printing plate 12 due to the reduction of the circulating amount is generated.

Further, the clogging of the filter 432 gives a great load to the pump for circulating the processing solution and the motor for driving the pump. In this case, as shown in FIGS. 34 and 35, in the filter element 428 applied to the present embodiment, narrow opening portions 448 in which no filter 432 is provided are formed in the end portion in the side of the flange 434 of the frame body 430. Since the opening portions 448 are provided within the cap 418 covering the outer case 402, the processing solution does not normally flow therein. However, when the clogging is generated in the filter 432, an amount of permeation of the processing solution is largely reduced, the processing solution is stored within the outer case 402 and the liquid surface is ascended to reach the opening portions 448, the processing solution flows into the inner tube 424 from the opening portions 448. Accordingly, it is possible to prevent the clogging of the filter 432 from applying a great load to the pump for circulating the processing solution or the like so as to give troubles to the operation.

In the filter case 400, at a time of performing a maintenance of the filter element, at first, the cap 418 is turned at about 90 degrees in the direction opposite to the direction of an arrow C. Accordingly, when the projection portions 420 provided in the cap 418 are taken out of from the ribs 414 of the outer case 402, it is possible to take out the cap 418, and it is possible to take out the filter element 428 mounted to the cap 418 from the outer case 402 by moving the cap 418 apart from the outer case 402.

Further, in the filter element 428, the pawl portions 444 are opposed to the notches 436 by rotating the frame body 430 with respect to the inner tube 424 (the cap 418) at about 90 degrees in the direction opposite to the direction of an arrow D so as to bring the pawls 444 in the inner tube 424 into contact with the projections 438 and rotate and engage. Accordingly, the filter element 428 can be taken out from the inner tube 424.

As mentioned above, in the filter case 400, it is possible to easily take out the filter element 428 in accordance with an operation of turning the cap 418 and an operation of turning the filter element 428.

On the other hand, at a time of attaching the filter element 428 to the outer case 402, at first, the inner tube 424 provided in the cap 418 is inserted to the frame body 430 of the filter element 428 and the pawl portions 444 of the inner tube 424 are inserted to the notches 436 formed in the frame body 430. In this state, by turning the frame body 430 at about 90 degrees in the direction of the arrow D, the filter element 428 can be attached to the cap 418.

At this time, since the pawl portions 444 of the inner tube 424 move while being slidably contact with the inclined portions 442 of the frame body 430, the filter element 428 is closely attached to the cap 418 or the inner tube 424 when the pawl portions 444 are brought into contact with the projections 440.

Thereafter, the filter element 428 attached to the cap 418 is inserted to the outer case 402, the cap 418 is covered over the outer case 402, and the cap 418 is turned at about 90 degrees in the direction of the arrow C. At this time, the projection portions 420 provided in the cap 418 move while being slidably contact with the ribs 414, whereby the openings 402A of the outer case 402 are pressed to the packing 522. Accordingly, the outer case 402 and the cap 418 are closely attached.

As mentioned above, in the filter case 400, the cap 418 can be attached to the filter element 428 by inserting the inner tube 424 provided in the cap 418 to the frame body 430 of the filter element 428 and turning the frame body 430 in the direction of the arrow D, and the filter element 428 can be attached to the outer case 402 in accordance with a simple operation of turning the cap 418 at about 90 degrees in the direction of the arrow C in a state of inserting the filter element 428 to the outer case 402.

Further, since a range of turning the cap 418 and the filter element 428 is limited by the stoppers 416 provided in the ribs 414 of the outer case 402 and the projections 438 and 440 provided in the frame body 430 of the filter element 428, it is possible to securely attach and detach the filter element 428.

In this case, the present embodiment mentioned above shows one embodiment in accordance with the present invention and does not limit the structure in accordance with the present invention. For example, the outer case 402, the cap 418, the filter element 428 and the like are not limited to a cylindrical shape, and an optional shape such as a rectangular tubular shape or the like can be applied thereto.

Further, in the present embodiment, the description is given of the embodiment of the PS printing plate processor 10 for processing the PS printing plate 12 corresponding to the photosensitive material, however, it is possible to be used in a photosensitive material processing apparatus having an optional structure which processes the other photosensitive materials such as the printing paper, the camera film and the like in addition to the printing plate such as the PS printing plate 12 or the like by the processing solution.

As mentioned above, in accordance with the present invention, it is easy to attach and detach the filter element, so that there is an excellent effect that it is possible to improve an operability at a time of performing the maintenance such as a cleaning of the filter or the like.

What is claimed is:

1. A brush roller which has a rotational axis and is rotatable around said rotational axis for brushing a surface of a photosensitive material, the brush roller comprising:

a cylindrical roller main body;

a web-like member for brushing which is wound around an outer peripheral surface of said roller main body in a helical manner;

a holding member provided at one end portion in an axial direction of said roller main body, which holding member holds one end portion of said web-like member and is rotatable with respect to said roller main body while holding said one end portion of said web-like member; and an urging element which urges said holding member to rotate to a side of a winding direction of said web-like member for reducing slack of said web-like member.

2. A brush roller according to claim 1, further comprising a fixing element which fixes another end portion of said web-like member to another end portion in said axial direction of said roller main body.

3. A brush roller according to claim 1, further comprising a restricting element which limits an angular range of rotation of said holding member with respect to said roller main body.

4. A brush roller according to claim 1, further comprising a plurality of projections formed at said outer peripheral surface of said roller main body, said projections each having a distal end which protrudes toward a side of said winding direction of said web-like member and being engagable with said web-like member for preventing said web-like member shifting toward a side of a direction opposite to said winding direction, and said projections being disposed in a helical pattern.

5. A brush roller according to claim 4, wherein said projections are disposed such that positions thereof along said rotational axial direction of said roller main body have a predetermined interval.

6. A photosensitive material processing apparatus having a transferring path of a photosensitive material and a plurality of brush rollers each including a roller main body and a web-like member for brushing said photosensitive material, said web-like member being wound around an outer peripheral surface of said roller main body in a helical manner and said brush roller potentially forming a track pattern on said photosensitive material at a portion of said photosensitive material that is contacted by a portion of said brush roller corresponding to a boundary portion of said web-like member, wherein at least two of said brush rollers are disposed along said transferring path at one side of said transferring path, and said at least two brush rollers are provided such that a track pattern of one brush roller of said at least two brush rollers is different from a track pattern of another brush roller of said at least two brush rollers.

7. A photosensitive material processing apparatus according to claim 6, wherein a width of said web-like member of said one brush roller is different from a width of said web-like member of said other brush roller.

8. A photosensitive material processing apparatus according to claim 6, wherein said at least two brush rollers are provided such that a track line that constitutes said track pattern of said one brush roller crosses a track line that constitutes said track pattern of said other brush roller.

9. A photosensitive material processing apparatus according to claim 6, wherein an outer diameter of said one brush roller is different from an outer diameter of said other brush roller.

10. A photosensitive material processing apparatus according to claim 6, wherein a rotational speed of said one brush roller is different from a rotational speed of said other brush roller.

11. A photosensitive material processing apparatus according to claim 6, wherein a rotational direction of said one brush roller is different from a rotational direction of said other brush roller.

12. A photosensitive material processing apparatus according to claim 6, wherein a winding direction of said web-like member of said one brush roller is different from a winding direction of said web-like member of said other brush roller.

13. A photosensitive material processing apparatus which performs a brushing treatment of a surface of a photosensitive material with a brush roller formed by helically winding and fixing a web-like member around an outer peripheral surface of a roller main body, said brush roller potentially forming a track pattern on said photosensitive material at a portion of said photosensitive material that is contacted by a portion of said brush roller corresponding to a boundary portion of said web-like member, wherein at least two of said brush roller are disposed along a transferring path of said photosensitive material, at one surface side of said transferring path, such that an angle of inclination of said track pattern of one of said at least two brush rollers with respect to a transferring direction of said photosensitive material is substantially the same as an angle of inclination of said track pattern of another of said at least two brush rollers with respect to said photosensitive material transferring direction, and overlapping of said track patterns is preventable by alteration of at least one of a rotational speed of said one brush roller relative to said other brush roller, a photosensitive material transferring speed, a distance between said one brush roller and said other brush roller along said transferring path, and a position with respect to said photosensitive material of an axial direction end portion of said boundary portion of said web-like member of said one brush roller relative to a position with respect to said photosensitive material of an axial direction end portion of said boundary portion of said web-like member of said other brush roller.

* * * * *